US010960662B2

(12) United States Patent
Matsumoto et al.

(10) Patent No.: US 10,960,662 B2
(45) Date of Patent: Mar. 30, 2021

(54) PRINT HEAD CONTROL CIRCUIT AND LIQUID DISCHARGE APPARATUS

(71) Applicant: SEIKO EPSON CORPORATION, Tokyo (JP)

(72) Inventors: Yusuke Matsumoto, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/572,762

(22) Filed: Sep. 17, 2019

(65) Prior Publication Data

US 2020/0086634 A1 Mar. 19, 2020

(30) Foreign Application Priority Data

Sep. 19, 2018 (JP) ..... JP2018-174368
Feb. 28, 2019 (JP) ..... JP2019-036736

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2/04563; B41J 2/04541; B41J 2/04588; B41J 2/04581; B41J 2/0451; B41J 2/14153; B41J 2/04543
See application file for complete search history.

(56) References Cited

U.S. PATENT DOCUMENTS

2004/0119770 A1 6/2004 Tamura
2017/0173950 A1 6/2017 Hayashi
2017/0182805 A1 6/2017 Kawai
2018/0361739 A1* 12/2018 Umeda ..... B41J 2/175
2019/0009531 A1 1/2019 Furukawa

FOREIGN PATENT DOCUMENTS

JP 2004-090501 A 3/2004
JP 2017-113972 A 6/2017
JP 2017-114020 A 6/2017

* cited by examiner

*Primary Examiner* — Jannelle M Lebron
(74) *Attorney, Agent, or Firm* — Global IP Counselors, LLP

(57) ABSTRACT

A print head control circuit controls an operation of a print head that includes a nozzle plate and has a self-diagnosis function performed based on signals input from a first coupling point, a second coupling point, a third coupling point, and a fourth coupling point. The print head control circuit includes a first cable that includes a first power voltage signal propagation wiring for propagating a first power voltage signal, and a second cable that includes a first diagnosis signal propagation wiring for propagating a first diagnosis signal input to the first coupling point. A shortest distance between the nozzle plate and the first cable is longer than a shortest distance between the nozzle plate and the second cable.

20 Claims, 24 Drawing Sheets

| [SIH, SIL] | | [1, 1] LARGE DOT | [1, 0] MIDDLE DOT | [0, 1] SMALL DOT | [0, 0] NON-RECORDING |
|---|---|---|---|---|---|
| S | T1 | H | H | L | L |
| | T2 | H | L | H | L |
| | T3 | L | L | L | H |

FIG. 17

| WIRING NUMBER | CONTACT SECTION | PROPAGATION SIGNAL |
|---|---|---|
| 197a-1 | 180a-1 | GND |
| 197a-2 | 180a-2 | TH |
| 197a-3 | 180a-3 | GND |
| 197a-4 | 180a-4 | LAT and DIG1 |
| 197a-5 | 180a-5 | GND |
| 197a-6 | 180a-6 | SCK and DIG4 |
| 197a-7 | 180a-7 | GND |
| 197a-8 | 180a-8 | CH and DIG2 |
| 197a-9 | 180a-9 | GND |
| 197a-10 | 180a-10 | SI1 and DIG3 |
| 197a-11 | 180a-11 | GND |
| 197a-12 | 180a-12 | XHOT and DIG5 |
| 197a-13 | 180a-13 | CGND1 |
| 197a-14 | 180a-14 | COM1 |
| 197a-15 | 180a-15 | CGND2 |
| 197a-16 | 180a-16 | COM2 |
| 197a-17 | 180a-17 | CGND3 |
| 197a-18 | 180a-18 | COM3 |
| 197a-19 | 180a-19 | CGND4 |
| 197a-20 | 180a-20 | COM4 |
| 197a-21 | 180a-21 | CGND5 |
| 197a-22 | 180a-22 | COM5 |
| 197a-23 | 180a-23 | CGND6 |
| 197a-24 | 180a-24 | COM6 |

FIG. 18

| WIRING NUMBER | CONTACT SECTION | PROPAGATION SIGNAL |
|---|---|---|
| 197b-1 | 180b-1 | CGND6 |
| 197b-2 | 180b-2 | COM6 |
| 197b-3 | 180b-3 | CGND5 |
| 197b-4 | 180b-4 | COM5 |
| 197b-5 | 180b-5 | CGND4 |
| 197b-6 | 180b-6 | COM4 |
| 197b-7 | 180b-7 | CGND3 |
| 197b-8 | 180b-8 | COM3 |
| 197b-9 | 180b-9 | CGND2 |
| 197b-10 | 180b-10 | COM2 |
| 197b-11 | 180b-11 | CGND1 |
| 197b-12 | 180b-12 | COM1 |
| 197b-13 | 180b-13 | GND |
| 197b-14 | 180b-14 | VHV |
| 197b-15 | 180b-15 | GND |
| 197b-16 | 180b-16 | SI6 |
| 197b-17 | 180b-17 | GND |
| 197b-18 | 180b-18 | SI5 |
| 197b-19 | 180b-19 | GND |
| 197b-20 | 180b-20 | SI4 |
| 197b-21 | 180b-21 | GND |
| 197b-22 | 180b-22 | SI3 |
| 197b-23 | 180b-23 | VDD |
| 197b-24 | 180b-24 | SI2 |

FIG. 23

| WIRING NUMBER | CONTACT SECTION | PROPAGATION SIGNAL |
|---|---|---|
| 197a-1 | 180a-1 | GND |
| 197a-2 | 180a-2 | TH |
| 197a-3 | 180a-3 | GND |
| 197a-4 | 180a-4 | LATa and DIG1 |
| 197a-5 | 180a-5 | GND |
| 197a-6 | 180a-6 | SCKa and DIG4 |
| 197a-7 | 180a-7 | GND |
| 197a-8 | 180a-8 | CHa and DIG2 |
| 197a-9 | 180a-9 | GND |
| 197a-10 | 180a-10 | SI1 and DIG3 |
| 197a-11 | 180a-11 | CGND1 |
| 197a-12 | 180a-12 | COM1 |
| 197a-13 | 180a-13 | CGND2 |
| 197a-14 | 180a-14 | COM2 |
| 197a-15 | 180a-15 | CGND3 |
| 197a-16 | 180a-16 | COM3 |
| 197a-17 | 180a-17 | CGND4 |
| 197a-18 | 180a-18 | COM4 |
| 197a-19 | 180a-19 | CGND5 |
| 197a-20 | 180a-20 | COM5 |

FIG. 24

| WIRING NUMBER | CONTACT SECTION | PROPAGATION SIGNAL |
|---|---|---|
| 197b-1 | 180b-1 | CGND5 |
| 197b-2 | 180b-2 | COM5 |
| 197b-3 | 180b-3 | CGND4 |
| 197b-4 | 180b-4 | COM4 |
| 197b-5 | 180b-5 | CGND3 |
| 197b-6 | 180b-6 | COM3 |
| 197b-7 | 180b-7 | CGND2 |
| 197b-8 | 180b-8 | COM2 |
| 197b-9 | 180b-9 | CGND1 |
| 197b-10 | 180b-10 | COM1 |
| 197b-11 | 180b-11 | GND |
| 197b-12 | 180b-12 | SI5 |
| 197b-13 | 180b-13 | GND |
| 197b-14 | 180b-14 | SI4 |
| 197b-15 | 180b-15 | GND |
| 197b-16 | 180b-16 | SI3 |
| 197b-17 | 180b-17 | GND |
| 197b-18 | 180b-18 | SI2 |
| 197b-19 | 180b-19 | GND |
| 197b-20 | 180b-20 | VDD |

FIG. 25

| WIRING NUMBER | CONTACT SECTION | PROPAGATION SIGNAL |
|---|---|---|
| 197c-1 | 180c-1 | CGND6 |
| 197c-2 | 180c-2 | COM6 |
| 197c-3 | 180c-3 | CGND7 |
| 197c-4 | 180c-4 | COM7 |
| 197c-5 | 180c-5 | CGND8 |
| 197c-6 | 180c-6 | COM8 |
| 197c-7 | 180c-7 | CGND9 |
| 197c-8 | 180c-8 | COM9 |
| 197c-9 | 180c-9 | CGND10 |
| 197c-10 | 180c-10 | COM10 |
| 197c-11 | 180c-11 | GND |
| 197c-12 | 180c-12 | XHOT and DIG5 |
| 197c-13 | 180c-13 | GND |
| 197c-14 | 180c-14 | LATb and DIG6 |
| 197c-15 | 180c-15 | GND |
| 197c-16 | 180c-16 | SCKb and DIG9 |
| 197c-17 | 180c-17 | GND |
| 197c-18 | 180c-18 | CHb and DIG7 |
| 197c-19 | 180c-19 | GND |
| 197c-20 | 180c-20 | SI10 and DIG8 |

FIG. 26

| WIRING NUMBER | CONTACT SECTION | PROPAGATION SIGNAL |
|---|---|---|
| 197d-1 | 180d-1 | GND |
| 197d-2 | 180d-2 | SI9 |
| 197d-3 | 180d-3 | GND |
| 197d-4 | 180d-4 | SI8 |
| 197d-5 | 180d-5 | VDD |
| 197d-6 | 180d-6 | SI7 |
| 197d-7 | 180d-7 | GND |
| 197d-8 | 180d-8 | SI6 |
| 197d-9 | 180d-9 | GND |
| 197d-10 | 180d-10 | VHV |
| 197d-11 | 180d-11 | CGND10 |
| 197d-12 | 180d-12 | COM10 |
| 197d-13 | 180d-13 | CGND9 |
| 197d-14 | 180d-14 | COM9 |
| 197d-15 | 180d-15 | CGND8 |
| 197d-16 | 180d-16 | COM8 |
| 197d-17 | 180d-17 | CGND7 |
| 197d-18 | 180d-18 | COM7 |
| 197d-19 | 180d-19 | CGND6 |
| 197d-20 | 180d-20 | COM6 |

PRINT HEAD CONTROL CIRCUIT AND LIQUID DISCHARGE APPARATUS

The present application is based on, and claims priority from JP Application Serial Number 2018-174368, filed Sep. 19, 2018 and JP Application Serial Number 2019-036736, filed Feb. 28, 2019, the disclosures of which are hereby incorporated by reference herein in their entirety.

BACKGROUND

1. Technical Field

The present disclosure relates to a print head control circuit and a liquid discharge apparatus.

2. Related Art

A liquid discharge apparatus, such as an ink jet printer, discharges liquid, such as ink with which a cavity is filled, from a nozzle by driving a piezoelectric element provided in a print head using a driving signal, and forms a letter or an image on a medium. In the liquid discharge apparatus, when malfunction occurs in the print head, there is a problem in that discharge abnormality occurs in which it is not possible to normally discharge the liquid from the nozzle. Furthermore, when the discharge abnormality occurs, discharge accuracy of ink discharged from the nozzle is deteriorated, and thus there is a problem in that a quality of the image formed on the medium is deteriorated. The print head is known which has a self-checking function for diagnosing whether or not the discharge accuracy of the ink is deteriorated by the print head itself.

JP-A-2017-114020 discloses a print head which has a self-checking function for determining, by the print head itself, whether or not it is possible to form dots which satisfy a normal print quality based on a plurality of signals which are input to the print head.

In addition, JP-A-2017-113972 discloses a technology for reducing malfunction, such as short-circuit, which occurs because ink mist, which floats on an inside of a liquid discharge apparatus, adheres to a head substrate.

In the liquid discharge apparatus, most of ink discharged from a nozzle impacts on a medium and forms an image. However, a part of the ink discharged from the nozzle is misted before impacting on the medium, and floats on an inside of the liquid discharge apparatus. Furthermore, even after the ink discharged from the nozzle impacts on the medium, there is a case where the ink floats again on the inside of the liquid discharge apparatus due to airflow which occurs with movement of a carriage, on which the print head is mounted, or transportation of the medium. The ink, which floats on the inside of the liquid discharge apparatus, is extremely small, and, therefore, is charged due to Lenard effect. As a result, the ink, which floats on the inside of the liquid discharge apparatus, is drawn to a cable which supplies various signals to the print head and a conductive part such as a wiring pattern formed on the print head. In addition, the ink, which floats on the inside of the liquid discharge apparatus, is drawn to the conductive part, such as a terminal, which causes the cable to be electrically coupled to the print head. Furthermore, the ink, which floats on the inside of the liquid discharge apparatus, is attached to the cable or the conductive part, such as the wiring pattern or the terminal, there is a case where short-circuit occurs between the conductive parts. The short-circuit causes distortion to be generated on waveforms of the various signals propagated in the print head.

However, JP-A-2017-114020 does not disclose a technology relevant to the self-diagnosis in a case where the conductive part short-circuits because the ink, which floats on the inside of the liquid discharge apparatus, adheres to the print head as described above.

In addition, JP-A-2017-113972 discloses a technology for reducing electrical malfunction when the ink adheres to the cable which supplies the signals to the print head, but does not disclose a technology for performing self-diagnoses of whether or not the ink mist adheres to the print head.

As above, in the technologies disclosed in JP-A-2017-114020 and JP-A-2017-113972, there is a problem in that it is not possible to perform the self-diagnosis of whether or not the discharge accuracy of the ink is deteriorated due to an effect of the ink mist, which floats on the inside of the liquid discharge apparatus, as the self-diagnosis of the print head.

SUMMARY

According to an aspect of the present disclosure, there is provided a print head control circuit, which controls an operation of a print head that includes a nozzle plate having a nozzle for discharging liquid based on a driving signal, a first coupling point, a second coupling point, a third coupling point, and a fourth coupling point, and that has a self-diagnosis function performed based on signals input from the first coupling point, the second coupling point, the third coupling point, and the fourth coupling point, the print head control circuit including: a first cable that includes a first power voltage signal propagation wiring for propagating a first power voltage signal; a second cable that includes a first diagnosis signal propagation wiring for propagating a first diagnosis signal input to the first coupling point, a second diagnosis signal propagation wiring for propagating a second diagnosis signal input to the second coupling point, a third diagnosis signal propagation wiring for propagating a third diagnosis signal input to the third coupling point, and a fourth diagnosis signal propagation wiring for propagating a fourth diagnosis signal input to the fourth coupling point; a diagnosis signal output circuit that outputs the first diagnosis signal, the second diagnosis signal, the third diagnosis signal, and the fourth diagnosis signal; and a driving signal output circuit that outputs the driving signal, in which a shortest distance between the nozzle plate and the first cable is longer than a shortest distance between the nozzle plate and the second cable.

In the print head control circuit, the second cable may further include a driving signal propagation wiring for propagating the driving signal, and, in the second cable, the driving signal propagation wiring may not be located between the first diagnosis signal propagation wiring and the second diagnosis signal propagation wiring, between the second diagnosis signal propagation wiring and the third diagnosis signal propagation wiring, between the third diagnosis signal propagation wiring and the fourth diagnosis signal propagation wiring, and between the fourth diagnosis signal propagation wiring and the first diagnosis signal propagation wiring.

In the print head control circuit, the second cable may further include a plurality of ground signal propagation wirings for propagating a voltage signal with a ground potential, and, in the second cable, any of the plurality of ground signal propagation wirings may be located between the first diagnosis signal propagation wiring and the second diagnosis signal propagation wiring, between the second diagnosis signal propagation wiring and the third diagnosis signal propagation wiring, between the third diagnosis signal propagation wiring and the fourth diagnosis signal propagation wiring, and between the fourth diagnosis signal propagation wiring and the first diagnosis signal propagation wiring.

In the print head control circuit, the print head may further include a sixth coupling point, a seventh coupling point, an eighth coupling point, and a ninth coupling point, and may further have a self-diagnosis function performed based on signals input from the sixth coupling point, the seventh coupling point, the eighth coupling point, and the ninth coupling point, the print head control circuit may further include a third cable that includes a second power voltage signal propagation wiring for propagating a second power voltage signal; and a fourth cable that includes a sixth diagnosis signal propagation wiring for propagating a sixth diagnosis signal input to the sixth coupling point, a seventh diagnosis signal propagation wiring for propagating a seventh diagnosis signal input to the seventh coupling point, an eighth diagnosis signal propagation wiring for propagating an eighth diagnosis signal input to the eighth coupling point, and a ninth diagnosis signal propagation wiring for propagating a ninth diagnosis signal input to the ninth coupling point, and a shortest distance between the nozzle plate and the third cable may be longer than a shortest distance between the nozzle plate and the fourth cable.

According to another aspect of the present disclosure, there is provided a print head control circuit, which controls an operation of a print head that includes a nozzle plate having a nozzle for discharging liquid based on a driving signal, a first coupling point, a second coupling point, a third coupling point, a fourth coupling point, and a tenth coupling point, and that has a self-diagnosis function performed based on signals input from the first coupling point, the second coupling point, the third coupling point, and the fourth coupling point, the print head control circuit including: a first cable that includes a first power voltage signal propagation wiring for propagating a first power voltage signal input to the tenth coupling point; a second cable that includes a first diagnosis signal propagation wiring for propagating a first diagnosis signal input to the first coupling point, a second diagnosis signal propagation wiring for propagating a second diagnosis signal input to the second coupling point, a third diagnosis signal propagation wiring for propagating a third diagnosis signal input to the third coupling point, and a fourth diagnosis signal propagation wiring for propagating a fourth diagnosis signal input to the fourth coupling point; a diagnosis signal output circuit that outputs the first diagnosis signal, the second diagnosis signal, the third diagnosis signal, and the fourth diagnosis signal; and a driving signal output circuit that outputs the driving signal, in which the first diagnosis signal propagation wiring may be in electrical contact with the first coupling point at a first contact section, the second diagnosis signal propagation wiring may be in electrical contact with the second coupling point at a second contact section, the third diagnosis signal propagation wiring may be in electrical contact with the third coupling point at a third contact section, the fourth diagnosis signal propagation wiring may be in electrical contact with the fourth coupling point at a fourth contact section, the first power voltage signal propagation wiring may be in electrical contact with the tenth coupling point at a tenth contact section, and a shortest distance between the tenth contact section and the nozzle plate may be longer than a shortest distance between the first contact section and the nozzle plate.

In the print head control circuit, the print head may further include an eleventh coupling point, the second cable may further include a driving signal propagation wiring for propagating the driving signal input to the eleventh coupling point, the driving signal propagation wiring may be in electrical contact with the eleventh coupling point at an eleventh contact section, and the eleventh contact section may not be located between the first contact section and the second contact section, between the second contact section and the third contact section, between the third contact section and the fourth contact section, and between the fourth contact section and the first contact section.

In the print head control circuit, the print head may further include a plurality of ground coupling points, the second cable may further include a plurality of ground signal propagation wirings for propagating a voltage signal with a ground potential, the plurality of ground signal propagation wirings may be in electrical contact with the plurality of ground coupling points at a plurality of ground contact sections, and any of the plurality of ground contact sections may be located between the first contact section and the second contact section, between the second contact section and the third contact section, between the third contact section and the fourth contact section, and between the fourth contact section and the first contact section.

In the print head control circuit, the print head may further include a sixth coupling point, a seventh coupling point, an eighth coupling point, a ninth coupling point, and a twelfth coupling point, and may further have a self-diagnosis function performed based on signals input from the sixth coupling point, the seventh coupling point, the eighth coupling point, and the ninth coupling point, the print head control circuit may further include a third cable that includes a second power voltage signal propagation wiring for propagating a second power voltage signal input to the twelfth coupling point; and a fourth cable that includes a sixth diagnosis signal propagation wiring for propagating a sixth diagnosis signal input to the sixth coupling point, a seventh diagnosis signal propagation wiring for propagating a seventh diagnosis signal input to the seventh coupling point, an eighth diagnosis signal propagation wiring for propagating an eighth diagnosis signal input to the eighth coupling point, and a ninth diagnosis signal propagation wiring for propagating a ninth diagnosis signal input to the ninth coupling point, the sixth diagnosis signal propagation wiring may be in electrical contact with the sixth coupling point at a sixth contact section, the seventh diagnosis signal propagation wiring may be in electrical contact with the seventh coupling point at a seventh contact section, the eighth diagnosis signal propagation wiring may be in electrical contact with the eighth coupling point at an eighth contact section, the ninth diagnosis signal propagation wiring may be in electrical contact with the ninth coupling point at a ninth contact section, the second power voltage signal propagation wiring may be in electrical contact with the twelfth coupling point at a twelfth contact section, and a shortest distance between the twelfth contact section and the nozzle plate may be longer than a shortest distance between the sixth contact section and the nozzle plate.

In the print head control circuit, the first diagnosis signal propagation wiring may function as a wiring for propagating a signal for prescribing a discharge timing of the liquid.

In the print head control circuit, the second diagnosis signal propagation wiring may function as a wiring for propagating a signal for prescribing a waveform switching timing of the driving signal.

In the print head control circuit, the third diagnosis signal propagation wiring may function as a wiring for propagating a signal for prescribing selection of a waveform of the driving signal.

In the print head control circuit, the fourth diagnosis signal propagation wiring may function as a wiring for propagating a clock signal.

In the print head control circuit, the print head may further include a fifth coupling point, and the second cable may further include a fifth diagnosis signal propagation wiring for propagating a fifth diagnosis signal which is output from the fifth coupling point and which indicates a result of self-diagnosis of the print head.

In the print head control circuit, the fifth diagnosis signal propagation wiring may function as a wiring for propagating a signal which indicates existence/non-existence of temperature abnormality of the print head.

According to still another aspect of the present disclosure, there is provided a liquid discharge apparatus including: a print head that includes a nozzle plate having a nozzle for discharging liquid based on a driving signal, a first coupling point, a second coupling point, a third coupling point, and a fourth coupling point, and that has a self-diagnosis function performed based on signals input from the first coupling point, the second coupling point, the third coupling point, and the fourth coupling point; and a print head control circuit that controls an operation of the print head, in which the print head control circuit may include a first cable that includes a first power voltage signal propagation wiring for propagating a first power voltage signal, a second cable that includes a first diagnosis signal propagation wiring for propagating a first diagnosis signal input to the first coupling point, a second diagnosis signal propagation wiring for propagating a second diagnosis signal input to the second coupling point, a third diagnosis signal propagation wiring for propagating a third diagnosis signal input to the third coupling point, and a fourth diagnosis signal propagation wiring for propagating a fourth diagnosis signal input to the fourth coupling point, a diagnosis signal output circuit that outputs the first diagnosis signal, the second diagnosis signal, the third diagnosis signal, and the fourth diagnosis signal, and a driving signal output circuit that outputs the driving signal, and a shortest distance between the nozzle plate and the first cable may be longer than a shortest distance between the nozzle plate and the second cable.

In the liquid discharge apparatus, the second cable may further include a driving signal propagation wiring for propagating the driving signal, and, in the second cable, the driving signal propagation wiring may not be located between the first diagnosis signal propagation wiring and the second diagnosis signal propagation wiring, between the second diagnosis signal propagation wiring and the third diagnosis signal propagation wiring, between the third diagnosis signal propagation wiring and the fourth diagnosis signal propagation wiring, and between the fourth diagnosis signal propagation wiring and the first diagnosis signal propagation wiring.

In the liquid discharge apparatus, the second cable may further include a plurality of ground signal propagation wirings for propagating a voltage signal with a ground potential, and, in the second cable, any of the plurality of ground signal propagation wirings may be located between the first diagnosis signal propagation wiring and the second diagnosis signal propagation wiring, between the second diagnosis signal propagation wiring and the third diagnosis signal propagation wiring, between the third diagnosis signal propagation wiring and the fourth diagnosis signal propagation wiring, and between the fourth diagnosis signal propagation wiring and the first diagnosis signal propagation wiring.

In the liquid discharge apparatus, the print head may further include a sixth coupling point, a seventh coupling point, an eighth coupling point, and a ninth coupling point, and may further have a self-diagnosis function performed based on signals input from the sixth coupling point, the seventh coupling point, the eighth coupling point, and the ninth coupling point, the print head control circuit may further include a third cable that includes a second power voltage signal propagation wiring for propagating a second power voltage signal, and a fourth cable that includes a sixth diagnosis signal propagation wiring for propagating a sixth diagnosis signal input to the sixth coupling point, a seventh diagnosis signal propagation wiring for propagating a seventh diagnosis signal input to the seventh coupling point, an eighth diagnosis signal propagation wiring for propagating an eighth diagnosis signal input to the eighth coupling point, and a ninth diagnosis signal propagation wiring for propagating a ninth diagnosis signal input to the ninth coupling point, and a shortest distance between the nozzle plate and the third cable may be longer than a shortest distance between the nozzle plate and the fourth cable.

According to an aspect of the present disclosure, there is provided a liquid discharge apparatus including: a print head that includes a nozzle plate having a nozzle for discharging liquid based on a driving signal, a first coupling point, a second coupling point, a third coupling point, a fourth coupling point, and a tenth coupling point, and that has a self-diagnosis function performed based on signals input from the first coupling point, the second coupling point, the third coupling point, and the fourth coupling point; and a print head control circuit that controls an operation of the print head, in which the print head control circuit may include a first cable that includes a first power voltage signal propagation wiring for propagating a first power voltage signal input to the tenth coupling point, a second cable that includes a first diagnosis signal propagation wiring for propagating a first diagnosis signal input to the first coupling point, a second diagnosis signal propagation wiring for propagating a second diagnosis signal input to the second coupling point, a third diagnosis signal propagation wiring for propagating a third diagnosis signal input to the third coupling point, and a fourth diagnosis signal propagation wiring for propagating a fourth diagnosis signal input to the fourth coupling point, a diagnosis signal output circuit that outputs the first diagnosis signal, the second diagnosis signal, the third diagnosis signal, and the fourth diagnosis signal, and a driving signal output circuit that outputs the driving signal, the first diagnosis signal propagation wiring may be in electrical contact with the first coupling point at a first contact section, the second diagnosis signal propagation wiring may be in electrical contact with the second coupling point at a second contact section, the third diagnosis signal propagation wiring may be in electrical contact with the third coupling point at a third contact section, the fourth diagnosis signal propagation wiring may be in electrical contact with the fourth coupling point at a fourth contact section, the first power voltage signal propagation wiring may be in electrical contact with the tenth coupling point at a tenth contact section, and a shortest distance between the tenth contact section and the nozzle plate may be longer than a shortest distance between the first contact section and the nozzle plate.

In the liquid discharge apparatus, the print head may further include an eleventh coupling point, the second cable may further include a driving signal propagation wiring for propagating the driving signal input to the eleventh coupling point, the driving signal propagation wiring may be in electrical contact with the eleventh coupling point at an eleventh contact section, and the eleventh contact section may not be located between the first contact section and the second contact section, between the second contact section and the third contact section, between the third contact section and the fourth contact section, and between the fourth contact section and the first contact section.

In the liquid discharge apparatus, the print head may further include a plurality of ground coupling points, the second cable may further include a plurality of ground signal propagation wirings for propagating a voltage signal with a ground potential input to the plurality of ground coupling points, the plurality of ground signal propagation wirings may be in electrical contact with the plurality of ground coupling points at a plurality of ground contact sections, and any of the plurality of ground contact sections may be located between the first contact section and the second contact section, between the second contact section and the third contact section, between the third contact section and the fourth contact section, and between the fourth contact section and the first contact section.

In the liquid discharge apparatus, the print head may further include a sixth coupling point, a seventh coupling point, an eighth coupling point, a ninth coupling point, and a twelfth coupling point, and has a self-diagnosis function performed based on signals input from the sixth coupling point, the seventh coupling point, the eighth coupling point, and the ninth coupling point, the print head control circuit may further include a third cable that includes a second power voltage signal propagation wiring for propagating a second power voltage signal input to the twelfth coupling point, and a fourth cable that includes a sixth diagnosis signal propagation wiring for propagating a sixth diagnosis signal input to the sixth coupling point, a seventh diagnosis signal propagation wiring for propagating a seventh diagnosis signal input to the seventh coupling point, an eighth diagnosis signal propagation wiring for propagating an eighth diagnosis signal input to the eighth coupling point, and a ninth diagnosis signal propagation wiring for propagating a ninth diagnosis signal input to the ninth coupling point, the sixth diagnosis signal propagation wiring may be in electrical contact with the sixth coupling point at a sixth contact section, the seventh diagnosis signal propagation wiring may be in electrical contact with the seventh coupling point at a seventh contact section, the eighth diagnosis signal propagation wiring may be in electrical contact with the eighth coupling point at an eighth contact section, the ninth diagnosis signal propagation wiring may be in electrical contact with the ninth coupling point at a ninth contact section, the second power voltage signal propagation wiring may be in electrical contact with the twelfth coupling point at a twelfth contact section, and a shortest distance between the twelfth contact section and the nozzle plate may be longer than a shortest distance between the sixth contact section and the nozzle plate.

In the liquid discharge apparatus, the first diagnosis signal propagation wiring may function as a wiring for propagating a signal for prescribing a discharge timing of the liquid.

In the liquid discharge apparatus, the second diagnosis signal propagation wiring may function as a wiring for propagating a signal for prescribing a waveform switching timing of the driving signal.

In the liquid discharge apparatus the third diagnosis signal propagation wiring may function as a wiring for propagating a signal for prescribing selection of a waveform of the driving signal.

In the liquid discharge apparatus, the fourth diagnosis signal propagation wiring may function as a wiring for propagating a clock signal.

In the liquid discharge apparatus, the print head may further include a fifth coupling point, and the second cable may further include a fifth diagnosis signal propagation wiring for propagating a fifth diagnosis signal which is output from the fifth coupling point and which indicates a result of self-diagnosis of the print head.

In the liquid discharge apparatus, the fifth diagnosis signal propagation wiring may function as a wiring for propagating a signal which indicates existence/non-existence of temperature abnormality of the print head.

BRIEF DESCRIPTION OF THE DRAWINGS

FIG. 17 is a diagram illustrating details of signals which are propagated through a cable.

FIG. 18 is a diagram illustrating details of signals which are propagated through a cable.

FIG. 23 is a diagram illustrating details of signals which are propagated through a cable according to the second embodiment.

FIG. 24 is a diagram illustrating details of signals which are propagated through a cable according to the second embodiment.

FIG. 25 is a diagram illustrating details of signals which are propagated through a cable according to the second embodiment.

FIG. 26 is a diagram illustrating details of signals which are propagated through a cable according to the second embodiment.

DESCRIPTION OF EXEMPLARY EMBODIMENTS

Hereinafter, preferable embodiments of the present disclosure will be described with reference to the accompanying drawings. The accompanying drawings are used for convenience of description. Meanwhile, the embodiments which will be described below do not unreasonably limit content of the present disclosure disclosed in claims. In addition, all configurations which will be described below are not limited to essential components of the present disclosure.

Hereinafter, a print head control circuit, which operates a print head that is applied to a liquid discharge apparatus and that has a self-checking function, will be described as an example.

1 First Embodiment

1.1 Configuration of Liquid Discharge Apparatus

Figure 1:
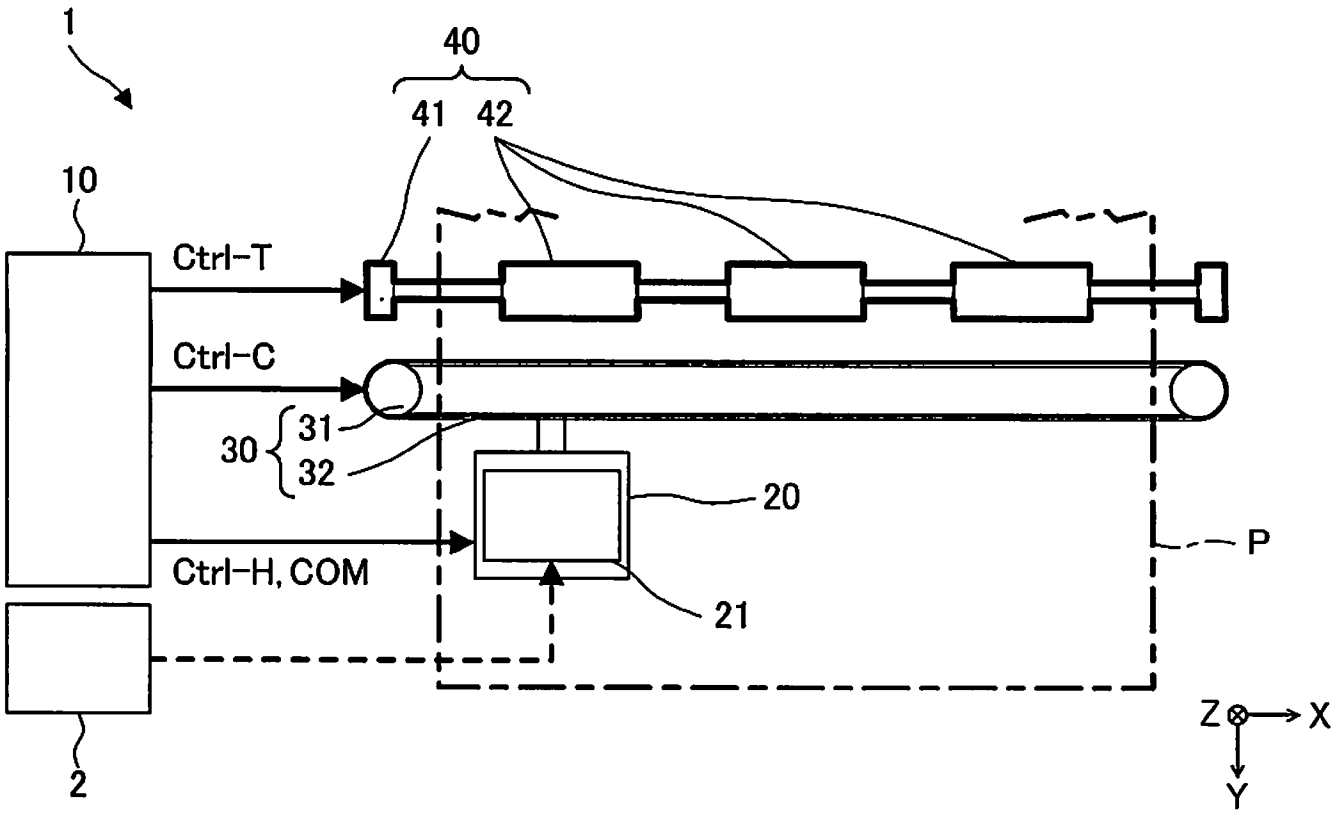
FIG. 1 is a diagram illustrating a schematic configuration of a liquid discharge apparatus.

FIG. 1 is a diagram illustrating a schematic configuration of a liquid discharge apparatus 1. The liquid discharge apparatus 1 is a serial print-type ink jet printer which forms an image with respect to a medium P in such a way that the carriage 20, on which the print head 21 for discharging ink as an example of liquid is mounted, reciprocates and the ink is discharged with respect to the medium P which is transported. In the description below, description will be performed in such a way that a direction in which the carriage 20 moves is set to an X direction, a direction to which the medium P is transported is set to a Y direction, and a direction to which the ink is discharged is set to a Z direction. Meanwhile, the description will be performed in such a way that the X direction, the Y direction, and the Z direction are directions which are orthogonal to each other. In addition, a random printing target, such as printing paper, a resin film, or a fabric, may be used as the medium P.

The liquid discharge apparatus 1 includes the liquid container 2, a control mechanism 10, the carriage 20, a movement mechanism 30, and a transport mechanism 40.

A plurality of types of ink discharged to the medium P are stored in the liquid container 2. A color of black, a color of cyan, a color of magenta, a color of yellow, a color of red, a color of gray, and the like are exemplified as colors of the ink stored in the liquid container 2. An ink cartridge, a bursiform ink pack formed of a flexible film, an ink tank enabling supply of the ink, or the like is used as the liquid container 2 which stores the ink.

The control mechanism 10 includes, for example, a processing circuit, such as a Central Processing Unit (CPU) or a Field Programmable Gate Array (FPGA), and a memory circuit, such as a semiconductor memory, and controls respective elements of the liquid discharge apparatus 1.

The print head 21 is mounted on the carriage 20. In addition, in a state in which the print head 21 is mounted on the carriage 20, the carriage 20 is fixed to an endless belt 32 included in the movement mechanism 30. Meanwhile, the liquid container 2 may also be mounted on the carriage 20.

A control signal Ctrl-H for controlling the print head 21 and one or more driving signals COM for driving the print head 21 are input to the print head 21 from the control mechanism 10. Furthermore, the print head 21 discharges the ink supplied from the liquid container 2 in the Z direction based on the control signal Ctrl-H and the driving signals COM.

The movement mechanism 30 includes a carriage motor 31 and the endless belt 32. The carriage motor 31 operates based on a control signal Ctrl-C input from the control mechanism 10. Furthermore, the endless belt 32 rotates according to an operation of the carriage motor 31. Therefore, the carriage 20 fixed to the endless belt 32 reciprocates in the X direction.

The transport mechanism 40 includes a transport motor 41 and a transport roller 42. The transport motor 41 operates based on a control signal Ctrl-T input from the control mechanism 10. Furthermore, the transport roller 42 rotates according to an operation of the transport motor 41. The medium P is transported in the Y direction in accordance with rotation of the transport roller 42.

As described above, when the liquid discharge apparatus 1 discharges the ink from the print head 21 mounted on the carriage 20 in conjunction with transportation of the medium P by the transport mechanism 40 and reciprocating movement of the carriage 20 by the movement mechanism 30, the ink impacts on a random location of a surface of the medium P, and thus a desired image is formed on the medium P.

1.2 Electrical Configuration of Liquid Discharge Apparatus

Figure 2:
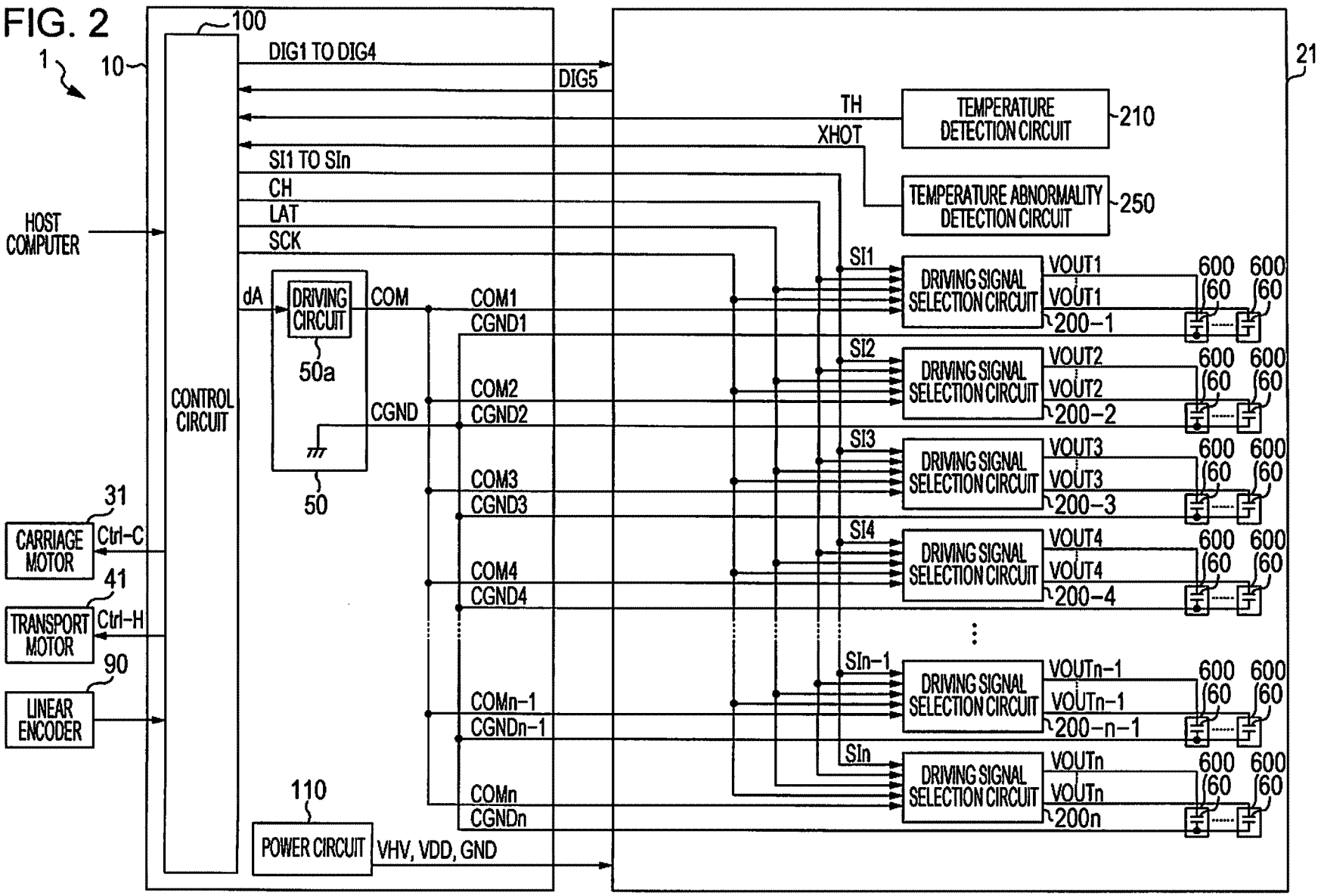
FIG. 2 is a block diagram illustrating an electrical configuration of the liquid discharge apparatus.

FIG. 2 is a block diagram illustrating an electrical configuration of the liquid discharge apparatus 1. The liquid discharge apparatus 1 includes the control mechanism 10, the print head 21, the carriage motor 31, the transport motor 41, and a linear encoder 90. As illustrated in FIG. 2, the control mechanism 10 includes a driving signal output circuit 50, a control circuit 100, and a power circuit 110.

The control circuit 100 includes, for example, a processor such as a micro-controller. Furthermore, the control circuit 100 generates and outputs data and various signals for controlling the liquid discharge apparatus 1 based on various signals such as image data input from a host computer.

Specifically, the control circuit 100 grasps a scanning location of the print head 21 based on a detection signal input from the linear encoder 90. Furthermore, the control circuit 100 outputs the control signal Ctrl-C according to the scanning location of the print head 21 to the carriage motor 31. Therefore, reciprocation of the print head 21 is controlled. In addition, the control circuit 100 outputs the control signal Ctrl-T to the transport motor 41. Therefore, the transportation of the medium P is controlled. Meanwhile, after signal conversion is performed on the control signal Ctrl-C through a not-shown carriage motor driver, the control signal Ctrl-C may be input to the carriage motor 31. In the same manner, after signal conversion is performed on the control signal Ctrl-T through a not-shown transport motor driver, the control signal Ctrl-T may be input to the transport motor 41.

In addition, the control circuit 100 outputs print data signals SI1 to SIn, a change signal CH, a latch signal LAT, and a clock signal SCK, as the control signal Ctrl-H for controlling the print head 21, to the print head 21 based on the various signals, such as the image data, input from the host computer.

In addition, the control circuit 100 outputs diagnosis signals DIG1 to DIG4 for performing self-diagnosis on the print head 21, and a diagnosis signal DIG5 which indicates a result of the self-diagnosis of the print head 21 is input to the control circuit 100. The control circuit 100 which outputs the diagnosis signals DIG1 to DIG4 is an example of a diagnosis signal output circuit.

In addition, the control circuit 100 outputs a driving control signal dA, which is the digital signal, to the driving signal output circuit 50.

The driving signal output circuit 50 includes a driving circuit 50*a*. The driving control signal dA is a digital data signal for prescribing a waveform of the driving signal COM, and is input to the driving circuit 50*a*. After digital/analog conversion is performed on the driving control signal dA, the driving circuit 50*a* generates the driving signal COM by performing class D amplification on an analog signal acquired through the conversion. That is, the driving circuit 50*a* generates the driving signal COM by performing class D amplification on a waveform prescribed using the driving control signal dA. Furthermore, the driving signal output circuit 50 outputs the driving signal COM. Meanwhile, the driving control signal dA may be a signal for prescribing the waveform of the driving signal COM, and may be, for example, an analog signal. In addition, the driving circuit 50*a* may be able to amplify the waveform prescribed using the driving control signal dA, and may include, for example, circuits for class A amplification, class B amplification, class AB amplification, and the like.

In addition, the driving signal output circuit 50 outputs a reference voltage signal CGND for indicating a reference potential, for example, a ground potential (0 V) of the driving signal COM. Meanwhile, the reference voltage signal CGND is not limited to a signal of the ground potential, and may be, for example, a signal of a direct current voltage of DC 6V.

The driving signal COM and the reference voltage signal CGND are output to the print head 21 after branching off in the control mechanism 10. Specifically, the driving signal COM is output to the print head 21 after branching off to n number of driving signals COM1 to COMn, which respectively correspond to n number of driving signal selection circuits 200 that will be described later, in the control mechanism 10. In the same manner, the reference voltage signal CGND is output to the print head 21 after branching off to n number of reference voltage signals CGND1 to CGNDn in the control mechanism 10. Here, the driving signal COM, which includes the driving signals COM1 to COMn, is an example of driving signal.

The power circuit 110 generates and outputs a high voltage signal VHV, a low voltage signal VDD, and a ground signal GND. The high voltage signal VHV is a signal having a voltage of, for example, DC 42 V. In addition, the low voltage signal VDD is a signal having a voltage of, for example, 3.3 V. In addition, the ground signal GND is a signal which indicates a reference potential of the high voltage signal VHV and the low voltage signal VDD, and is a signal of, for example, the ground potential (0 V). The high voltage signal VHV is used for an amplification voltage or the like in the driving signal output circuit 50. In addition, the low voltage signal VDD and the ground signal GND are respectively used for power voltages of various components in the control mechanism 10. In addition, the high voltage signal VHV, the low voltage signal VDD, and the ground signal GND are also output to the print head 21, respectively. Meanwhile, voltages of the high voltage signal VHV, the low voltage signal VDD, and the ground signal GND are not limited to the above-described DC 42 V, DC 3.3 V, and 0 V. In addition, the power circuit 110 may generate and output a plurality of voltage signals other than the high voltage signal VHV, the low voltage signal VDD, and the ground signal GND.

The print head 21 includes n number of driving signal selection circuits 200, a temperature detection circuit 210, a temperature abnormality detection circuit 250, and a plurality of discharge sections 600. Respective driving signal selection circuits 200-1 to 200-*n* perform selection or non-selection on the driving signal COM based on the print data signals SI1 to SIn, the clock signal SCK, the latch signal LAT, and the change signal CH which are input. Therefore, the respective driving signal selection circuits 200-1 to 200-*n* generate driving signals VOUT1 to VOUTn. Furthermore, the respective driving signal selection circuits 200-1 to 200-*n* supply the generated driving signals VOUT1 to VOUTn to piezoelectric elements 60 included in the relevant discharge sections 600. The piezoelectric element 60 is displaced when the driving signal VOUT is supplied. Furthermore, an amount of ink corresponding to the displacement is discharged from the discharge section 600.

Specifically, the driving signal COM1, the print data signal SI1, the latch signal LAT, the change signal CH, and the clock signal SCK are input to the driving signal selection circuit 200-1. Furthermore, the driving signal selection circuit 200-1 outputs the driving signal VOUT1 by performing selection or non-selection on the waveform of the driving signal COM1 based on the print data signal SI1, the latch signal LAT, the change signal CH, and the clock signal SCK. The driving signal VOUT1 is supplied to one end of the piezoelectric element 60 of the relevantly provided discharge section 600. In addition, the reference voltage signal CGND1 is supplied to another end of the piezoelectric element 60. Furthermore, the piezoelectric element 60 displaces according to a potential difference between the driving signal VOUT1 and the reference voltage signal CGND1.

In the same manner, a driving signal COMi, a print data signal SIi, the latch signal LAT, the change signal CH, and the clock signal SCK are input to a driving signal selection circuit 200-*i* (i is any one of 1 to n). Furthermore, the driving signal selection circuit 200-*i* outputs a driving signal VOUTi by performing selection or non-selection on a waveform of the driving signal COMi based on the print data signal SIi, the latch signal LAT, the change signal CH, and the clock signal SCK. The driving signal VOUTi is supplied to one end of the piezoelectric element 60 of the relatively provided discharge section 600. In addition, a reference voltage signal CGNDi is supplied to another end of the piezoelectric element 60. Furthermore, the piezoelectric element 60 displaces according to a potential difference between the driving signal VOUTi and the reference voltage signal CGNDi.

Here, driving signal selection circuits 200-1 to 200-*n* have the same circuit configuration. Therefore, in the description below, when it is not necessary to distinguish between the driving signal selection circuits 200-1 to 200-*n*, there is a case where the driving signal selection circuits 200-1 to 200-*n* are referred to as the driving signal selection circuit 200. In addition, in this case, the driving signals COM1 to COMn, which are input to the driving signal selection circuit 200, are referred to as the driving signal COM, and the print data signals SI1 to SIn are referred to as the print data signal SI. In addition, the driving signals VOUT1 to VOUTn, which are output from the driving signal selection circuit 200, are referred to as the driving signal VOUT. The respective driving signal selection circuits 200-1 to 200-*i* may be formed as, for example, an Integrated Circuit (IC) apparatus.

The temperature detection circuit 210 includes a not-shown temperature sensor such as a thermistor. The temperature sensor detects a temperature of the print head 21. Furthermore, the temperature detection circuit 210 generates a temperature signal TH which is an analog signal including temperature information of the print head 21, and outputs the temperature signal TH to the control circuit 100.

The temperature abnormality detection circuit 250 outputs a digital abnormality signal XHOT which indicates whether or not temperatures of the print head 21 and the driving signal selection circuits 200-1 to 200-*n* are abnormal. Specifically, the temperature abnormality detection circuit 250 diagnoses whether or not the temperature of the print head 21 is abnormal. When it is determined that the temperature of the print head 21 is normal, the temperature abnormality detection circuit 250 generates the abnormality signal XHOT at an H level, and outputs the abnormality signal XHOT to the control circuit 100. In addition, when it is determined that the temperature of the print head 21 is abnormal, the temperature abnormality detection circuit 250 generates the abnormality signal XHOT at an L level, and outputs the abnormality signal XHOT to the control circuit 100. Meanwhile, a logical level of the abnormality signal XHOT is an example. For example, when it is determined that the temperature of the print head 21 is normal, the temperature abnormality detection circuit 250 may generate the abnormality signal XHOT at the L level. When it is determined that the temperature of the print head 21 is abnormal, the temperature abnormality detection circuit 250 may generate the abnormality signal XHOT at the H level.

The control circuit 100 performs various processes, such as stop of the operation of the liquid discharge apparatus 1 and correction of the waveform of the driving signal COM, according to the temperature signal TH and the abnormality signal XHOT. That is, the abnormality signal XHOT is a signal which indicates existence/non-existence of temperature abnormality of the print head 21 and the driving signal selection circuits 200-1 to 200-*n*. Therefore, it is possible to increase a discharge accuracy of the ink from the discharge section 600, and it is possible to prevent the operation abnormality, a failure, and the like of the print head 21 in a print state from occurring. Meanwhile, the temperature abnormality detection circuit 250 may be formed as, for example, an IC apparatus. In addition, the temperature abnormality detection circuit 250 may be provided in plural so as to correspond to the respective driving signal selection circuits 200-1 to 200-*n*. In this case, the respective driving signal selection circuits 200-1 to 200-*n* and the relevant temperature abnormality detection circuit 250 may be formed as one IC apparatus.

1.3 Example of Waveform of Driving Signal

Here, an example of the waveform of the driving signal COM, which is generated by the driving signal output circuit 50, and an example of the waveform of the driving signal VOUT, which is supplied to the piezoelectric element 60, will be described with reference to FIGS. 3 and 4.

Figure 3:
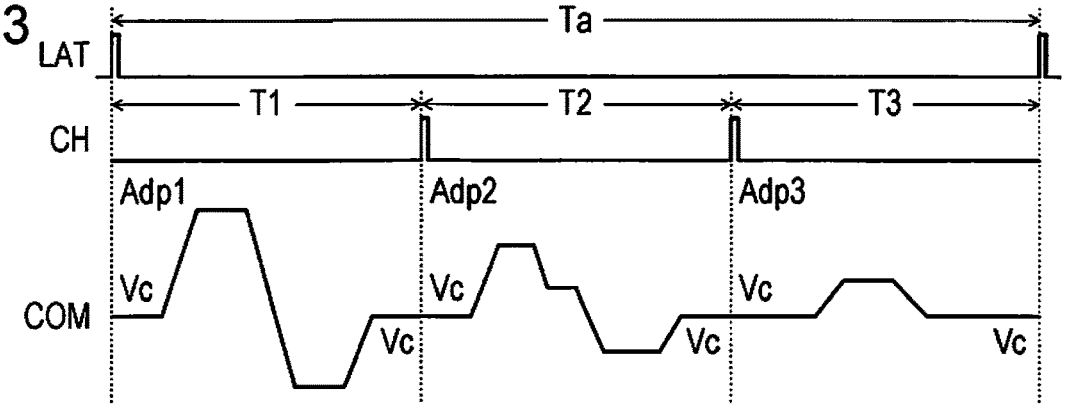
FIG. 3 is a diagram illustrating an example of a waveform of a driving signal.

FIG. 3 is a diagram illustrating the example of the waveform of the driving signal COM. As illustrated in FIG. 3, the driving signal COM is a waveform acquired by coupling a trapezoid waveform Adp1 disposed in a period T1 from when the latch signal LAT rises to when the change signal CH rises, a trapezoid waveform Adp2 disposed in a period T2 until the change signal CH subsequently rises after the period T1, and a trapezoid waveform Adp3 disposed in a period T3 until the latch signal LAT subsequently rises after the period T2. Furthermore, when the trapezoid waveform Adp1 is supplied to one end of the piezoelectric element 60, an intermediate amount of ink is discharged from the discharge section 600 corresponding to the piezoelectric element 60. In addition, when the trapezoid waveform Adp2 is supplied to one end of the piezoelectric element 60, a small amount, which is less than the intermediate amount, of ink is discharged from the discharge section 600 corresponding to the piezoelectric element 60. In addition, when the trapezoid waveform Adp3 is supplied to one end of the piezoelectric element 60, the ink is not discharged from the discharge section 600 corresponding to the piezoelectric element 60. Here, the trapezoid waveform Adp3 is a waveform for preventing ink viscosity from increasing by slightly vibrating the ink in a vicinity of a nozzle opening section of the discharge section 600.

Here, a cycle Ta, from when the latch signal LAT illustrated in FIG. 3 rises to when the latch signal LAT subsequently rises, corresponds to a print cycle at which a new dot is formed on the medium P. That is, the latch signal LAT is a signal for prescribing timing at which the ink from the print head 21 is discharged, and the change signal CH is a signal for prescribing waveform switching timing of the trapezoid waveforms Adp1, Adp2, and Adp3 included in the driving signal COM.

In addition, all voltages at timings, at which the respective trapezoid waveforms Adp1, Adp2, and Adp3 start and end, are common to a voltage Vc. That is, the respective trapezoid waveforms Adp1, Adp2, and Adp3 are waveforms which start with the voltage Vc and end with the voltage Vc. Meanwhile, the driving signal COM may be, at the cycle Ta, a signal having a waveform acquired by succeeding one or two trapezoid waveforms or may be a signal having a waveform acquired by succeeding four or more trapezoid waveforms.

Figure 4:
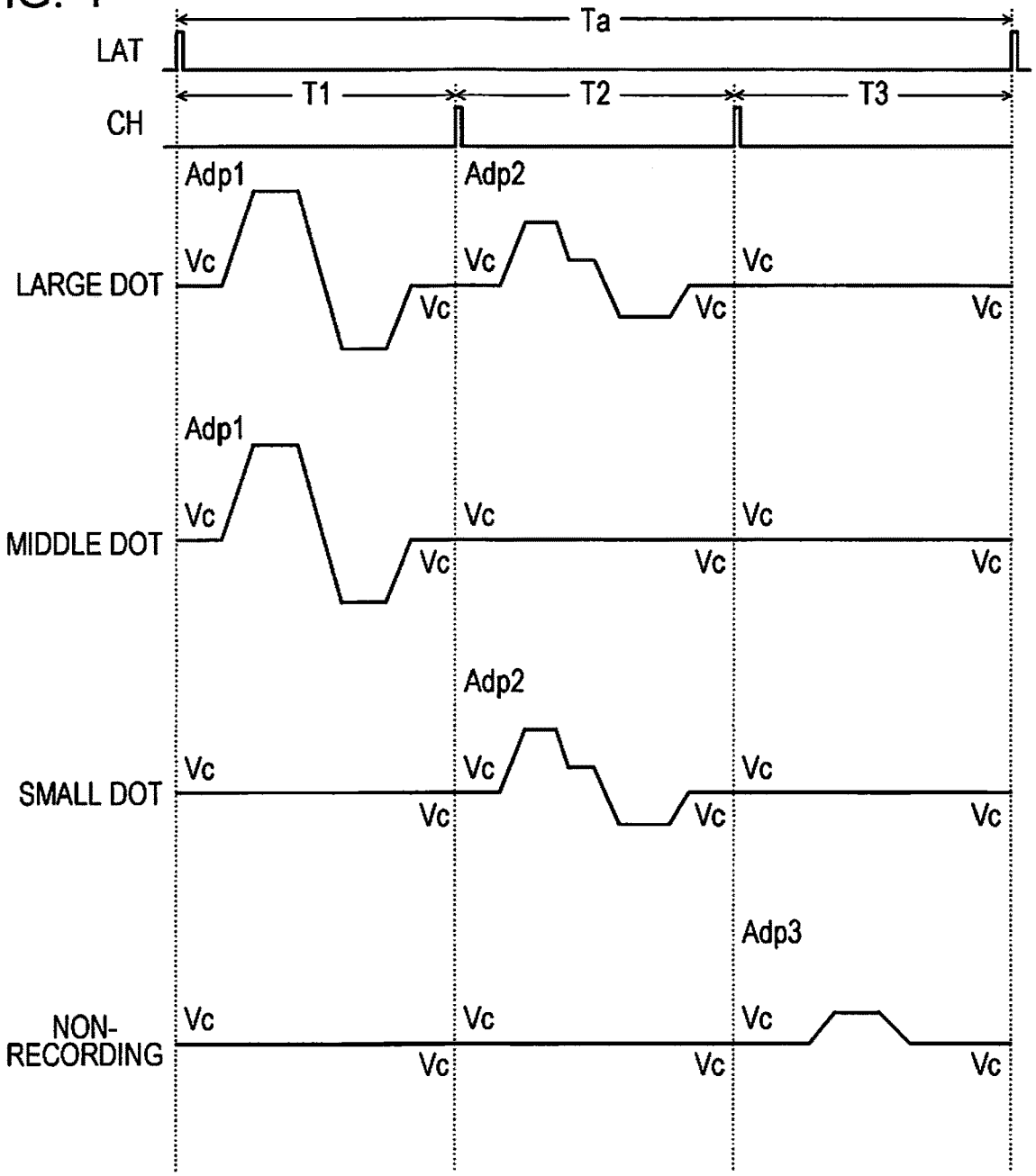
FIG. 4 is a diagram illustrating an example of a waveform of a driving signal.

FIG. 4 is a diagram illustrating an example of a waveform of the driving signal VOUT corresponding to each of a "large dot", a "middle dot", a "small dot", and a "non-recording".

As illustrated in FIG. 4, the driving signal VOUT corresponding to the "large dot" has a waveform acquired by succeeding, at the cycle Ta, the trapezoid waveform Adp1 disposed in the period T1, the trapezoid waveform Adp2 disposed in the period T2, and a voltage waveform disposed in the period T3 to be fixed at the voltage Vc. When the driving signal VOUT is supplied to one end of the piezoelectric element 60, an intermediate amount of ink and a small amount of ink are discharged from the discharge section 600 corresponding to the piezoelectric element 60 at the cycle Ta. Therefore, the ink impacts and combines with each other on the medium P, and thus the large dot is formed.

The driving signal VOUT corresponding to the "middle dot" is a waveform acquired by succeeding, at the cycle Ta, the trapezoid waveform Adp1 disposed in the period T1 and a voltage waveforms disposed in the periods T2 and T3 to be fixed at the voltage Vc. When the driving signal VOUT is supplied to one end of the piezoelectric element 60, an intermediate amount of ink is discharged from the discharge section 600 corresponding to the piezoelectric element 60 at the cycle Ta. Therefore, the ink impacts on the medium P, and thus a middle dot is formed.

The driving signal VOUT corresponding to the "small dot" is a waveform acquired by succeeding, at the cycle Ta, the voltage waveforms disposed in the periods T1 and T3 to be fixed at the voltage Vc and the trapezoid waveform Adp2 disposed in the period T2. When the driving signal VOUT is supplied to one end of the piezoelectric element 60, a small amount of ink is discharged from the discharge section 600 corresponding to the piezoelectric element 60 at the cycle Ta. Therefore, the ink impacts on the medium P, and thus the small dot is formed.

The driving signal VOUT corresponding to the "non-recording" is a waveform acquired by succeeding, at the cycle Ta, the voltage waveforms disposed in the periods T1 and T2 to be fixed at the voltage Vc and the trapezoid waveform Adp3 disposed in the period T3. When the driving signal VOUT is supplied to one end of the piezoelectric element 60, the ink in the vicinity of the nozzle opening section of the discharge section 600 corresponding to the piezoelectric element 60 only slightly vibrates at the cycle Ta, and thus the ink is not discharged. Therefore, the ink is not impacted on the medium P and the dot is not formed.

Here, the voltage waveform fixed at the voltage Vc is a waveform having a voltage, in which an immediately before voltage Vc is maintained by a capacity component of the piezoelectric element 60, when none of the trapezoid waveforms Adp1, Adp2, and Adp3 is selected as the driving signal VOUT. Therefore, when none of the trapezoid waveforms Adp1, Adp2, and Adp3 is selected as the driving signal VOUT, the voltage waveform fixed at the voltage Vc is supplied, as the driving signal VOUT, to the piezoelectric element 60.

Meanwhile, the driving signal COM and the driving signal VOUT, which are illustrated in FIGS. 3 and 4, are only examples, and a combination of various waveforms may be used according to a movement speed of the carriage 20 on which the print head 21 is mounted, a physical property of the ink supplied to the print head 21, a material of the medium P, and the like.

1.4 Configuration and Operation of Driving Signal Selection Circuit

Figure 5:
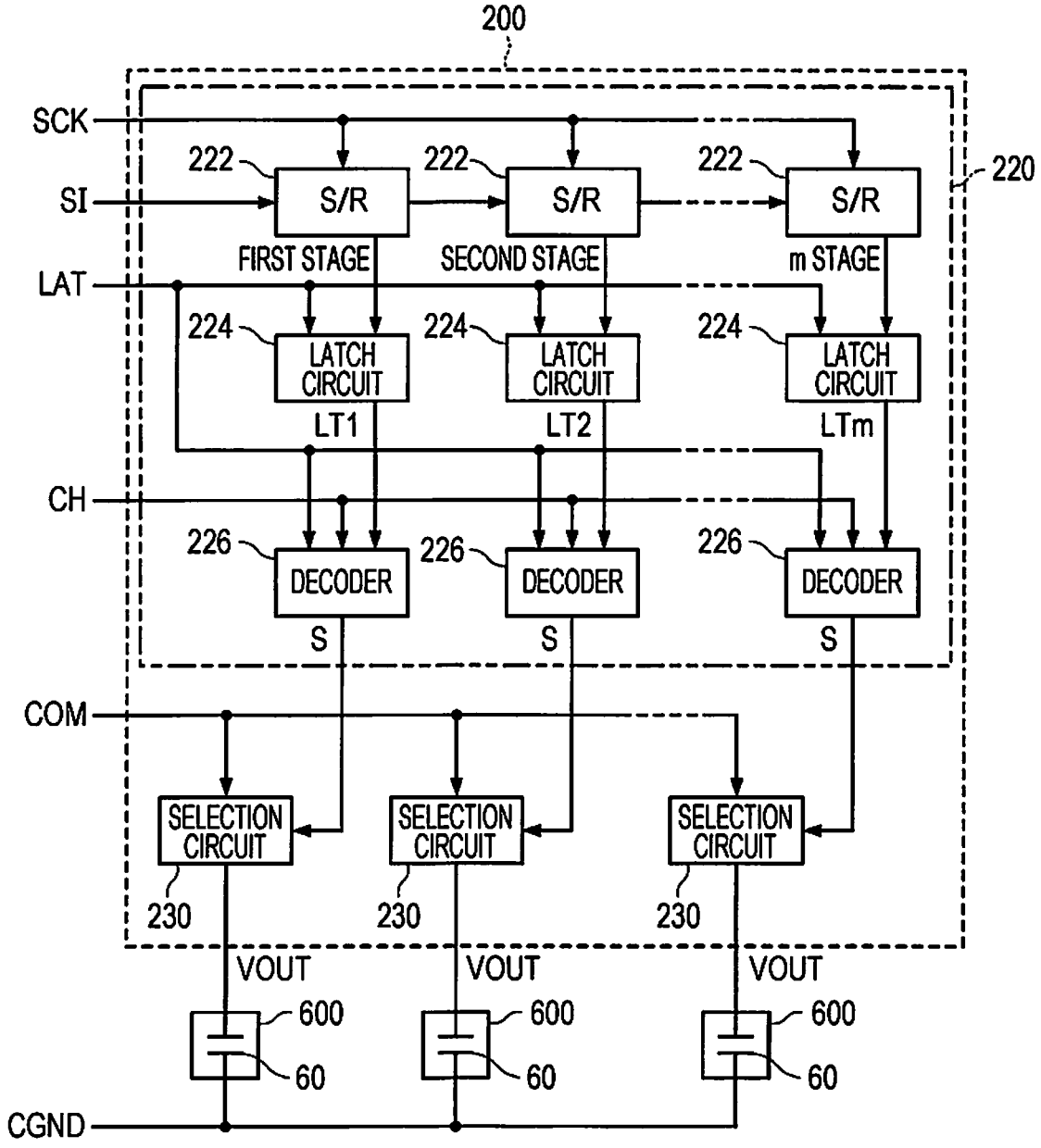
FIG. 5 is a diagram illustrating a configuration of a driving signal selection circuit.

Subsequently, a configuration and an operation of the driving signal selection circuit 200 will be described with reference to FIGS. 5 to 8. FIG. 5 is a diagram illustrating a configuration of the driving signal selection circuit 200. As illustrate in FIG. 5, the driving signal selection circuit 200 includes a selection control circuit 220 and a plurality of selection circuits 230.

The print data signal SI, the latch signal LAT, the change signal CH, and the clock signal SCK are input to the selection control circuit 220. In addition, in the selection control circuit 220, a set of a shift register (S/R) 222, a latch circuit 224, and a decoder 226 is provided to correspond to each of the plurality of discharge sections 600. That is, the driving signal selection circuit 200 includes sets of the shift register 222, the latch circuit 224, and the decoder 226, the number of sets being the same as a total number m of the relevant discharge sections 600. Here, the print data signal SI is a signal for prescribing selection of the waveform of the driving signal COM. In addition, the clock signal SCK is a clock signal for inputting the print data signal SI.

Specifically, the print data signal SI is a signal synchronized with the clock signal SCK, and is a total 2m-bit signal including 2-bit print data [SIH, SIL] for selecting any of the "large dot", the "middle dot", the "small dot", and the "non-recording" with respect to each of the m number of discharge sections 600. The print data signal SI is maintained in the shift register 222 for each of the 2-bit print data [SIH, SIL] included in the print data signal SI to be correspond to the discharge section 600. Specifically, the stage shift registers 222 in m stages corresponding to the discharge sections 600 are cascade coupled to each other, and the serially-input print data signal SI is sequentially transmitted to a subsequent stage according to the clock signal SCK. Meanwhile, in FIG. 5, in order to distinguish the shift registers 222, a first stage, a second stage, . . . , an m-th stage are sequentially described from upstream to which the print data signal SI is input.

Each of the m number of latch circuits 224 latches the 2-bit print data [SIH, SIL] maintained in each of the m number of shift register 222 when the latch signal LAT rises.

Each of the m number of decoders 226 decodes the 2-bit print data [SIH, SIL] latched by each of the m number of latch circuits 224. Furthermore, the decoder 226 outputs a selection signal S for each of the periods T1, T2, and T3 prescribed by the latch signal LAT and the change signal CH.

Figures 6, 7:
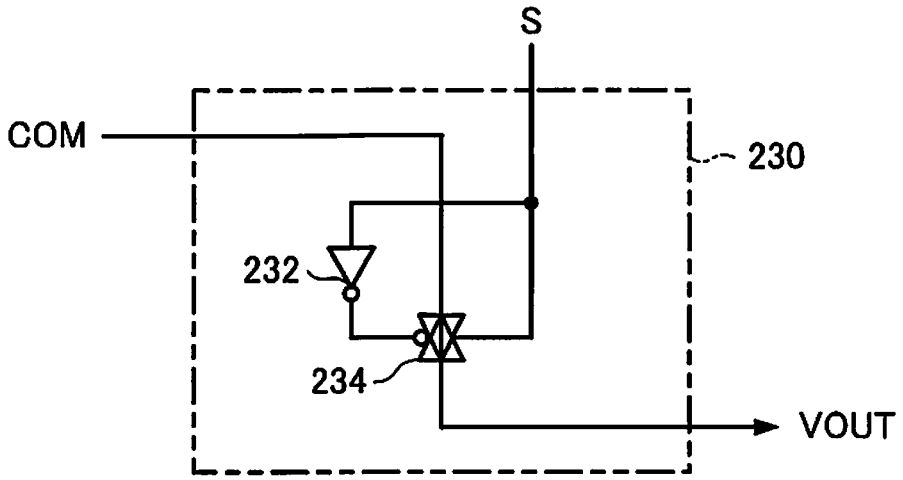
FIG. 6 is a table illustrating decoding content of a decoder.
FIG. 7 is a diagram illustrating a configuration of a selection circuit corresponding to one discharge section.

FIG. 6 is a table illustrating decoding content of the decoder 226. The decoder 226 outputs the selection signal S according to the latched 2-bit print data [SIH, SIL]. For example, when the 2-bit print data [SIH, SIL] is [1, 0], the decoder 226 outputs the selection signal S while setting a logical level of the selection signal to H, H, and L levels in the respective periods T1, T2, and T3.

The selection circuits 230 are provided to correspond to the respective discharge sections 600. That is, the number of selection circuits 230 included in the driving signal selection circuit 200 is the same as the total number m of the relevant discharge sections 600. FIG. 7 is a diagram illustrating a configuration of the selection circuit 230 corresponding to one discharge section 600. As illustrated in FIG. 7, the selection circuit 230 includes an inverter 232 which is a NOT circuit and a transfer gate 234.

The selection signal S is input to a positive control end, to which a round mark is not attached, in the transfer gate 234, and is input to a negative control end, to which the round mark is attached, in the transfer gate 234 by being logically inverted by the inverter 232. In addition, the driving signal COM is supplied to an input end of the transfer gate 234. Specifically, when the selection signal S is at the H level, the transfer gate 234 conducts (on) between the input end and the output end. When the selection signal S is at the L level, the transfer gate 234 does not conduct (off) between the input end and the output end. Furthermore, the driving signal VOUT is output from the output end of the transfer gate 234.

Figure 8:
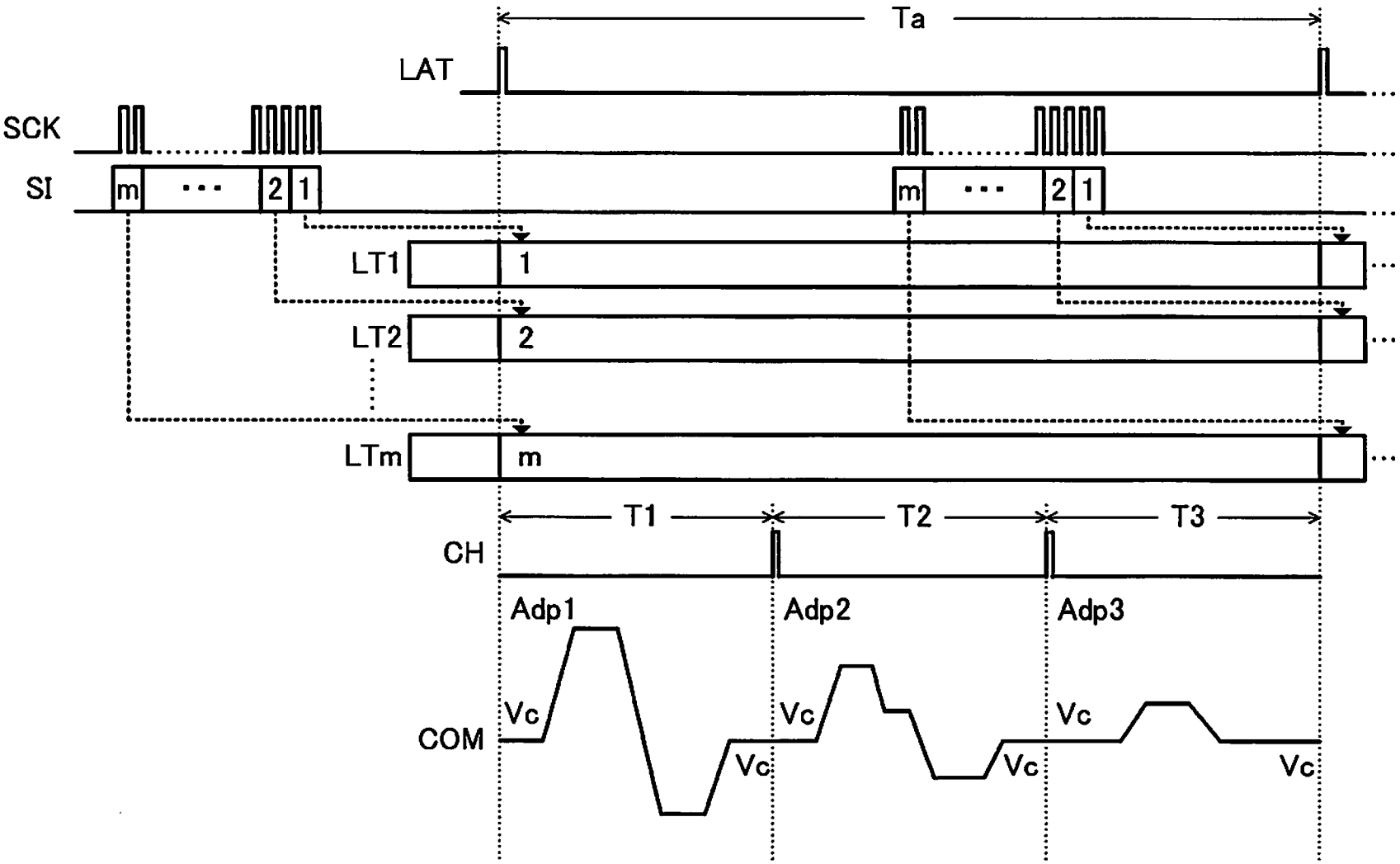
FIG. 8 is a diagram illustrating an operation of the driving signal selection circuit.

Here, an operation of the driving signal selection circuit 200 will be described with reference to FIG. 8. FIG. 8 is a diagram illustrating the operation of the driving signal selection circuit 200. The print data signal SI is serially input in synchronization with the clock signal SCK, and is sequentially transmitted in the shift registers 222 corresponding to the discharge sections 600. Furthermore, when the input of the clock signal SCK stops, the 2-bit print data [SIH, SIL] corresponding to each of the discharge sections 600 is maintained in each of the shift registers 222. Meanwhile, the print data signal SI is input in order which corresponds to the discharge sections 600 at the m-th stage, . . . , the second stage, and the first stage of the shift registers 222.

Furthermore, when the latch signal LAT rises, the respective latch circuits 224 simultaneously latch the 2-bit print data [SIH, SIL] maintained in the shift registers 222. Meanwhile, in FIG. 8, LT1, LT2, . . . , LTm indicate the 2-bit print data [SIR, SIL] latched by the latch circuits 224 corresponding to the first stage, the second stage, . . . , the m-th stage shift registers 222.

The decoder 226 outputs the logical levels of the selection signal S with the content illustrated in FIG. 6 in the respective periods T1, T2, T3 according to the size of the dot prescribed by the latched 2-bit print data [SIH, SIL].

Specifically, when the print data [SIH, SIL] is [1, 1], the decoder 226 sets the selection signal S to H, H, and L levels in the periods T1, T2, and T3. In this case, the selection circuit 230 selects the trapezoid waveform Adp1 in the period T1, selects the trapezoid waveform Adp2 in the period T2, and does not select the trapezoid waveform Adp3 in the period T3. As a result, the driving signal VOUT corresponding to the "large dot" illustrated in FIG. 4 is generated.

In addition, when the print data [SIR, SIL] is [1, 0], the decoder 226 sets the selection signal S to H, L, and L levels in the periods T1, T2, and T3. In this case, the selection circuit 230 selects the trapezoid waveform Adp1 in the period T1, does not selects the trapezoid waveform Adp2 in the period T2, and does not select the trapezoid waveform Adp3 in the period T3. As a result, the driving signal VOUT corresponding to the "middle dot" illustrated in FIG. 4 is generated.

In addition, when the print data [SIH, SIL] is [0, 1], the decoder 226 sets the selection signal S to L, H, and L levels in the periods T1, T2, and T3. In this case, the selection circuit 230 does not select the trapezoid waveform Adp1 in the period T1, selects the trapezoid waveform Adp2 in the period T2, and does not select the trapezoid waveform Adp3 in the period T3. As a result, the driving signal VOUT corresponding to the "small dot" illustrated in FIG. 4 is generated.

In addition, when the print data [SIH, SIL] is [0, 0], the decoder 226 sets the selection signal S to L, L, and H levels in the periods T1, T2, and T3. In this case, the selection circuit 230 does not select the trapezoid waveform Adp1 in the period T1, does not select the trapezoid waveform Adp2 in the period T2, and selects the trapezoid waveform Adp3 in the period T3. As a result, the driving signal VOUT corresponding to the "non-recording" illustrated in FIG. 4 is generated.

As above, the driving signal selection circuit 200 selects the waveform of the driving signal COM based on the print data signal SI, the latch signal LAT, the change signal CH, and the clock signal SCK, and outputs the driving signal VOUT. That is, in the driving signal selection circuit 200, the driving signal VOUT is generated through the selection or non-selection of the waveform of the driving signal COM. Therefore, the driving signal VOUT based on the driving signal COM is also an example of the driving signal.

1.5 Configuration of Temperature Abnormality Detection Circuit

Figure 9:
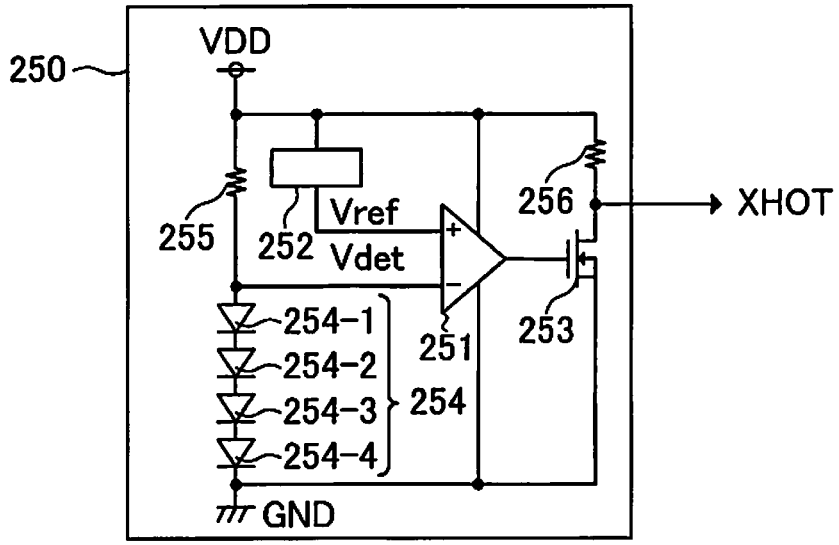
FIG. 9 is a diagram illustrating a configuration of a temperature abnormality detection circuit.

Subsequently, the temperature abnormality detection circuit 250 will be described with reference to FIG. 9. FIG. 9 is a diagram illustrating a configuration of the temperature abnormality detection circuit 250. As illustrated in FIG. 9, the temperature abnormality detection circuit 250 includes a comparator 251, a reference voltage output circuit 252, a transistor 253, a plurality of diodes 254, and resistors 255 and 256.

The low voltage signal VDD is input to the reference voltage output circuit 252. The reference voltage output circuit 252 generates a voltage Vref by transforming the low voltage signal VDD, and supplies the voltage Vref to a + side input terminal of the comparator 251. The reference voltage output circuit 252 includes, for example, a voltage regulator circuit or the like.

The plurality of diodes 254 are coupled to each other in series. Furthermore, the low voltage signal VDD is supplied to an anode terminal of the diode 254, which is located on a highest potential side of the plurality of diodes 254 which are coupled in series, through the resistor 255, and the ground signal GND is supplied to a cathode terminal of the diode 254 which is located on a lowest potential side. Specifically, the temperature abnormality detection circuit 250 includes diodes 254-1, 254-2, 254-3, and 254-4 as the plurality of diodes 254. The low voltage signal VDD is supplied to an anode terminal of the diode 254-1 through the resistor 255, and the anode terminal of the diode 254-1 is coupled to a − side input terminal of the comparator 251. A cathode terminal of the diode 254-1 is coupled to an anode terminal of the diode 254-2. A cathode terminal of the diode 254-2 is coupled to an anode terminal of the diode 254-3. A cathode terminal of the diode 254-3 is coupled to an anode terminal of the diode 254-4. The ground signal GND is supplied to a cathode terminal of the diode 254-4. A voltage Vdet, which is the sum of forward voltages of the plurality of respective diodes 254, is supplied to a − side input terminal of the comparator 251 by the resistor 255 and the plurality of diodes 254, which are formed as above. Meanwhile, the number of plurality of diodes 254 included in the temperature abnormality detection circuit 250 is not limited to four.

The comparator 251 operates due to potential difference between the low voltage signal VDD and the ground signal GND. Furthermore, the comparator 251 compares the voltage Vref supplied to the + side input terminal with the voltage Vdet supplied to the − side input terminal, and outputs a signal, based on a result of the comparison, from the output terminal.

The low voltage signal VDD is supplied to a drain terminal of the transistor 253 through the resistors 256. In addition, the transistor 253 includes a gate terminal coupled to the output terminal of the comparator 251 and a source terminal to which the ground signal GND is supplied. A voltage supplied to the drain terminal, which is coupled as above, of the transistor 253 is output, as the abnormality signal XHOT, from the temperature abnormality detection circuit 250.

A voltage value of the voltage Vref generated by the reference voltage output circuit 252 is lower than the voltage Vdet which is acquired when the temperatures of the plurality of diodes 254 are included in a prescribed range. In this case, the comparator 251 outputs a signal at the L level. Therefore, control is performed such that the transistor 253 is off, and, as a result, the temperature abnormality detection circuit 250 outputs the abnormality signal XHOT at the H level.

The forward voltage of the diode 254 has a characteristic of being lowered when the temperature rises. Therefore, when the temperature abnormality occurs in the print head 21, the temperature of the diode 254 rises, and thus the voltage Vdet lowers in accordance therewith. Furthermore, when the voltage Vdet is lower than the voltage Vref because the temperature rises, the output signal of the comparator 251 changes from the L level to the H level. Therefore, control is performed such that the transistor 253 is on. As a result, the temperature abnormality detection circuit 250 outputs the abnormality signal XHOT at the L level. That is, when the control is performed such that the transistor 253 is on or off based on the temperature of the driving signal selection circuit 200, the temperature abnormality detection circuit 250 outputs, as the abnormality signal XHOT at the H level, the low voltage signal VDD supplied as a pull-up voltage of the transistor 253, and outputs, as the abnormality signal XHOT at the L level, the ground signal GND.

1.6 Configuration of Print Head

Subsequently, a configuration of the print head 21 will be described with reference to FIGS. 10 to 13. Meanwhile, in the description below, description is performed while it is assumed that the print head 21 of the first embodiment includes six number of driving signal selection circuits 200-1 to 200-6. Therefore, in the print head 21 of the first embodiment, the six number of print data signals SI1 to SI6, the six number of driving signals COM1 to COM6, and the six number of reference voltage signals CGND1 to CGND6, which correspond to the six number of driving signal selection circuits 200-1 to 200-6, respectively, are input.

Figure 10:
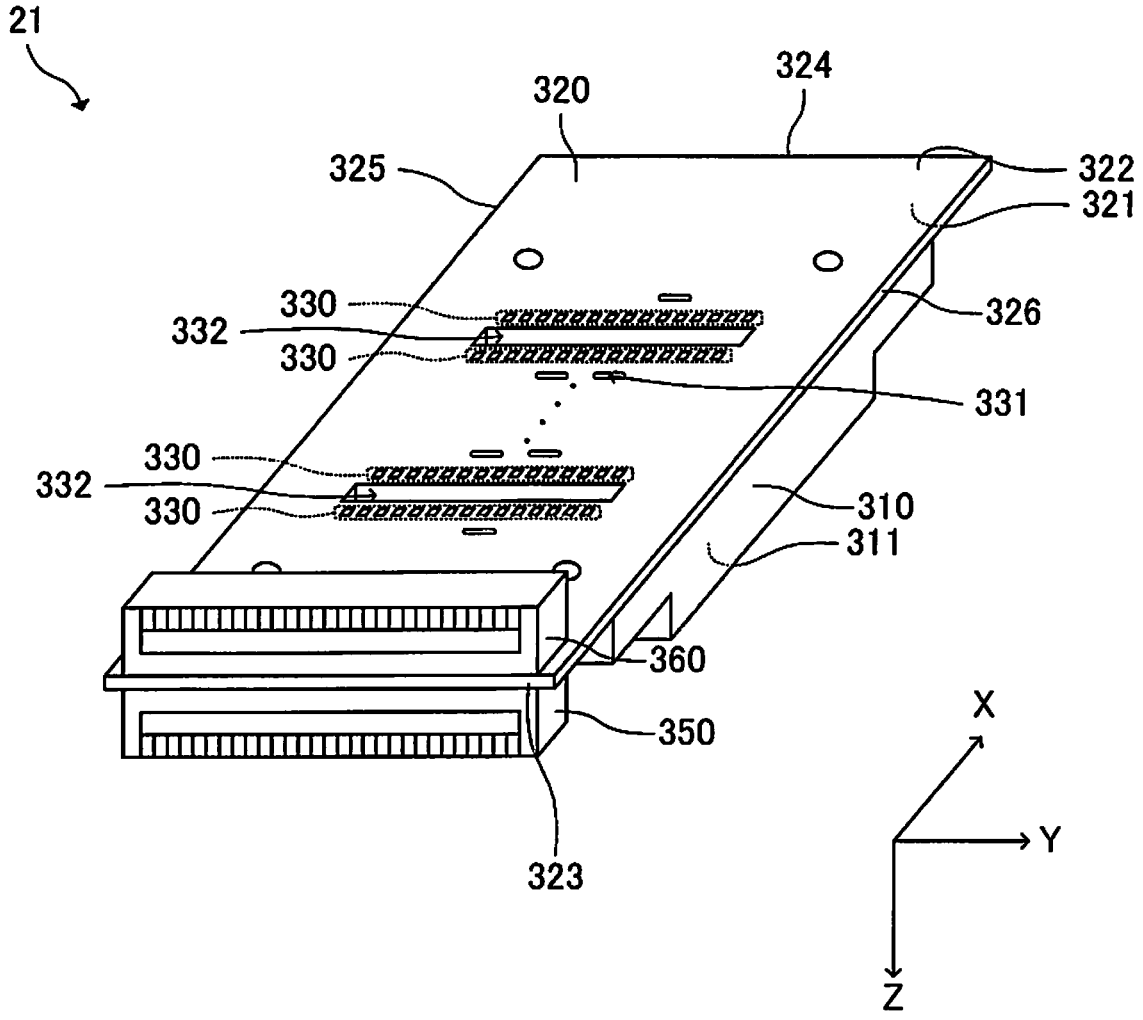
FIG. 10 is a perspective diagram schematically illustrating a configuration of a print head.

FIG. 10 is a perspective diagram illustrating the configuration of the print head 21. As illustrated in FIG. 10, the print head 21 includes a head 310 and a substrate 320. In addition, an ink discharge surface 311, which is formed with the plurality of discharge sections 600, is located on a surface of the head 310 on a lower side in the Z direction.

Figure 11:
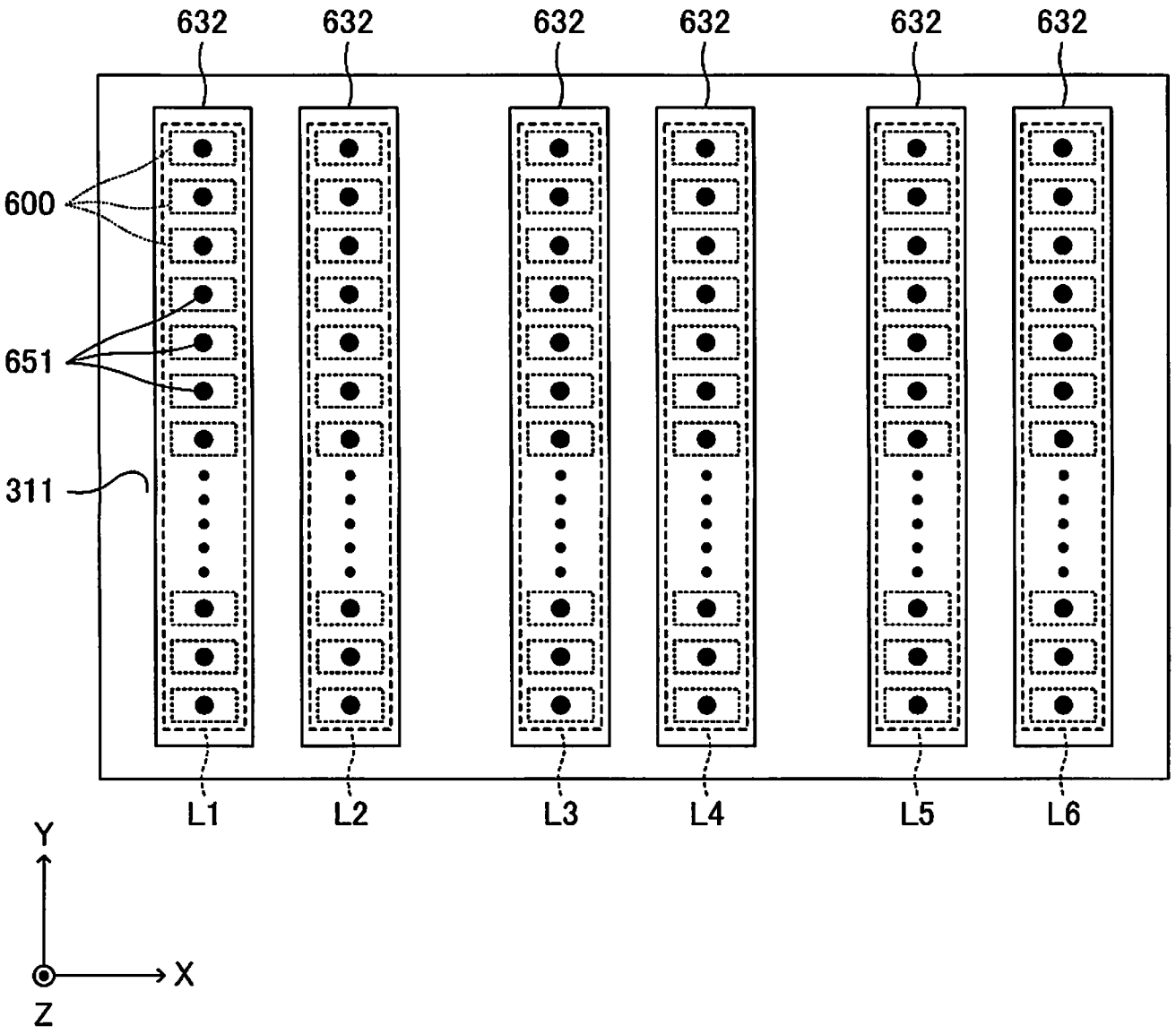
FIG. 11 is a plan diagram illustrating an ink discharge surface.

FIG. 11 is a plan diagram illustrating the ink discharge surface 311. As illustrated in FIG. 11, on the ink discharge surface 311, six number of nozzle plates 632, which each include the nozzles 651 included in the plurality of discharge sections 600, are provided in line along the X direction. In addition, in each of the nozzle plates 632, the nozzles 651 are provided in line along the Y direction. Therefore, nozzle columns L1 to L6 are formed on the ink discharge surface 311. Meanwhile, in FIG. 11, in the nozzle columns L1 to L6 formed on the respective nozzle plates 632, the nozzles 651 are provided in one column along the Y direction. However, the nozzles 651 may be provided in line in two or more columns along the Y direction.

The nozzle columns L1 to L6 are provided to correspond to the respective driving signal selection circuits 200-1 to 200-6. Specifically, the driving signal VOUT1, which is output by the driving signal selection circuit 200-1, is supplied to one ends of the piezoelectric elements 60 included in the plurality of discharge sections 600 provided in the nozzle column L1. In addition, the reference voltage signal CGND1 is supplied to another ends of the piezoelectric elements 60. In the same manner, the driving signal VOUT2, which is output by the driving signal selection circuit 200-2, is supplied to one ends of the piezoelectric elements 60 included in the plurality of discharge sections 600 provided in the nozzle column L2, and the reference voltage signal CGND2 is supplied to another ends of the piezoelectric elements 60. In the same manner, the driving signal VOUT3, which is output by the driving signal selection circuit 200-3, is supplied to one ends of the piezoelectric elements 60 included in the plurality of discharge sections 600 provided in the nozzle column L3, and the reference voltage signal CGND3 is supplied to the another ends of the piezoelectric elements 60. In the same manner, the driving signal VOUT4, which is output by the driving signal selection circuit 200-4, is supplied to one ends of the piezoelectric elements 60 included in the plurality of discharge sections 600 provided in the nozzle column L4, and the reference voltage signal CGND4 is supplied to the another ends of the piezoelectric elements 60. In the same manner, the driving signal VOUT5, which is output by the driving signal selection circuit 200-5, is supplied to one ends of the piezoelectric elements 60 included in the plurality of discharge sections 600 provided in the nozzle columns L5, and the reference voltage signal CGND5 is supplied to the another ends of the piezoelectric elements 60. In the same manner, the driving signal VOUT6, which is output by the driving signal selection circuit 200-6, is supplied to one ends of the piezoelectric elements 60 included in the plurality of discharge sections 600 provided in the nozzle columns L6, and the reference voltage signal CGND6 is supplied to the another ends of the piezoelectric elements 60.

Figure 12:
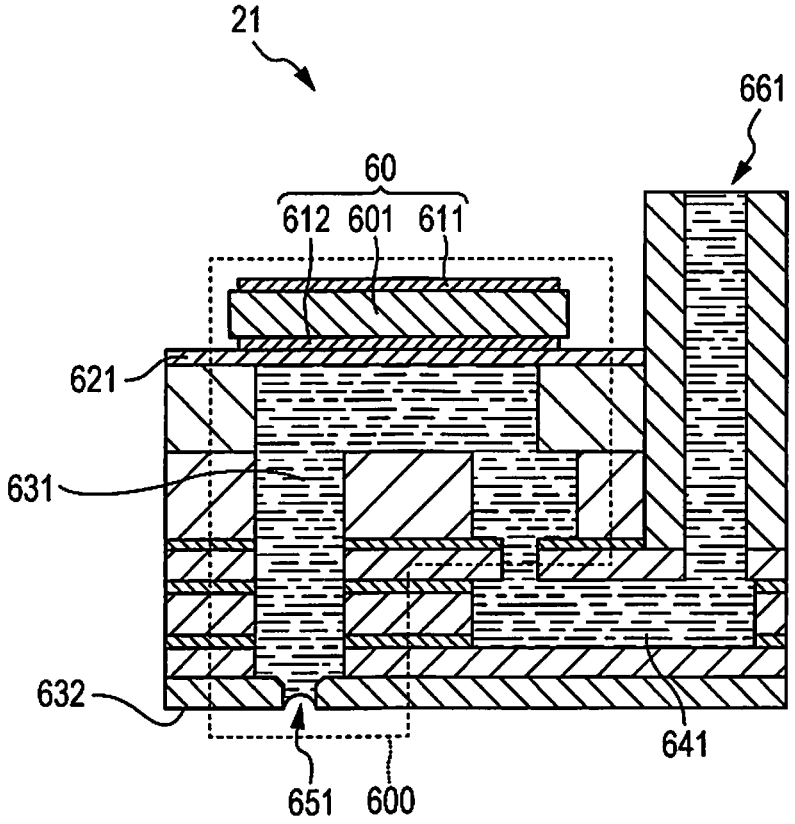
FIG. 12 is a diagram illustrating a schematic configuration of the discharge section.

Subsequently, a configuration of the discharge section 600 included in the head 310 will be described with reference to FIG. 12. FIG. 12 is a diagram illustrating a schematic configuration of one of the plurality of discharge sections 600 included in the head 310. As illustrated in FIG. 12, the head 310 includes the discharge section 600 and a reservoir 641.

The reservoir 641 is provided in each of the nozzle columns L1 to L6. Furthermore, the ink is introduced from an ink supply port 661 to the reservoir 641.

The discharge section 600 includes a piezoelectric element 60, a vibration plate 621, a cavity 631, and a nozzle 651. The vibration plate 621 varies in accordance with displacement of the piezoelectric element 60 provided on an upper surface in FIG. 12. Furthermore, the vibration plate 621 functions as a diaphragm which enlarges/reduces an internal volume of the cavity 631. An inside of the cavity 631 is filled with the ink. Furthermore, the cavity 631 functions as a pressure chamber in which the internal volume changes according to the displacement of the piezoelectric element 60. The nozzle 651 is an opening section which is formed on the nozzle plate 632 and which communicates with the cavity 631. Furthermore, the nozzle 651 communicates with the cavity 631, and discharges the ink on the inside of the cavity 631 according to the change in the internal volume of the cavity 631.

The piezoelectric element 60 has a structure in which a piezoelectric substance 601 is sandwiched between a pair of electrodes 611 and 612. In the piezoelectric substance 601 of the structure, according to a voltage which is supplied to the electrodes 611 and 612, central parts of the electrodes 611 and 612 and the vibration plate 621 are bent in upper and lower directions with respect to both end parts in FIG. 12. Specifically, the driving signal VOUT is supplied to the electrode 611, and the reference voltage signal CGND is supplied to the electrode 612. Furthermore, when the voltage of the driving signal VOUT becomes high, the central part of the piezoelectric element 60 is bent in the upper direction. When the voltage of the driving signal VOUT becomes low, the central part of the piezoelectric element 60 is bent in the lower direction. That is, when the piezoelectric element 60 is bent in the upper direction, the internal volume of the cavity 631 is enlarged.

Therefore, the ink is drawn from the reservoir 641. In addition, when the piezoelectric element 60 is bent in the lower direction, the internal volume of the cavity 631 is reduced. Therefore, an amount of ink according to a degree of reduction in the internal volume of the cavity 631 is discharged from the nozzle 651. As above, the nozzle 651 discharges the ink based on the driving signal COM which is the basis of the driving signal VOUT and the driving signal VOUT.

Meanwhile, the piezoelectric element 60 is not limited to the illustrated structure, and may be a type which is capable of discharging the ink in accordance with the displacement of the piezoelectric element 60. In addition, the piezoelectric element 60 is not limited to flexural vibration, and may have a configuration using longitudinal vibration.

Returning to FIG. 10, the substrate 320 includes a surface 321, and a surface 322 which is different from the surface 321, and has a substantially rectangular shape formed with a side 323, a side 324 which faces the side 323 in the X direction, a side 325, and a side 326 which faces the side 325 in the Y direction. Meanwhile, the shape of the substrate 320 is not limited to the rectangular shape. The shape of the substrate 320 may be, for example, a polygon, such as a hexagon or an octagon, and, furthermore, a notch, an arch, or the like may be formed at a part. That is, in the substrate 320, the surface 321 and the surface 322 are surfaces which are located to face each other through a base material of the substrate 320, in other words, the surface 321 and the surface 322 are front and back surfaces of the substrate 320.

In the print head 21, the substrate 320 is provided to be located on an opposite side of the ink discharge surface 311, from which the ink is discharged with respect to the nozzle plate 632, that is, the surface 321 is on the side of the nozzle plate 632. In addition, connectors 350 and 360 are provided in the substrate 320. The connector 350 is provided on a side of the surface 321 of the substrate 320 along the side 323. In addition, the connector 360 is provided on a side of the surface 322 of the substrate 320 along the side 323.

Figure 13:
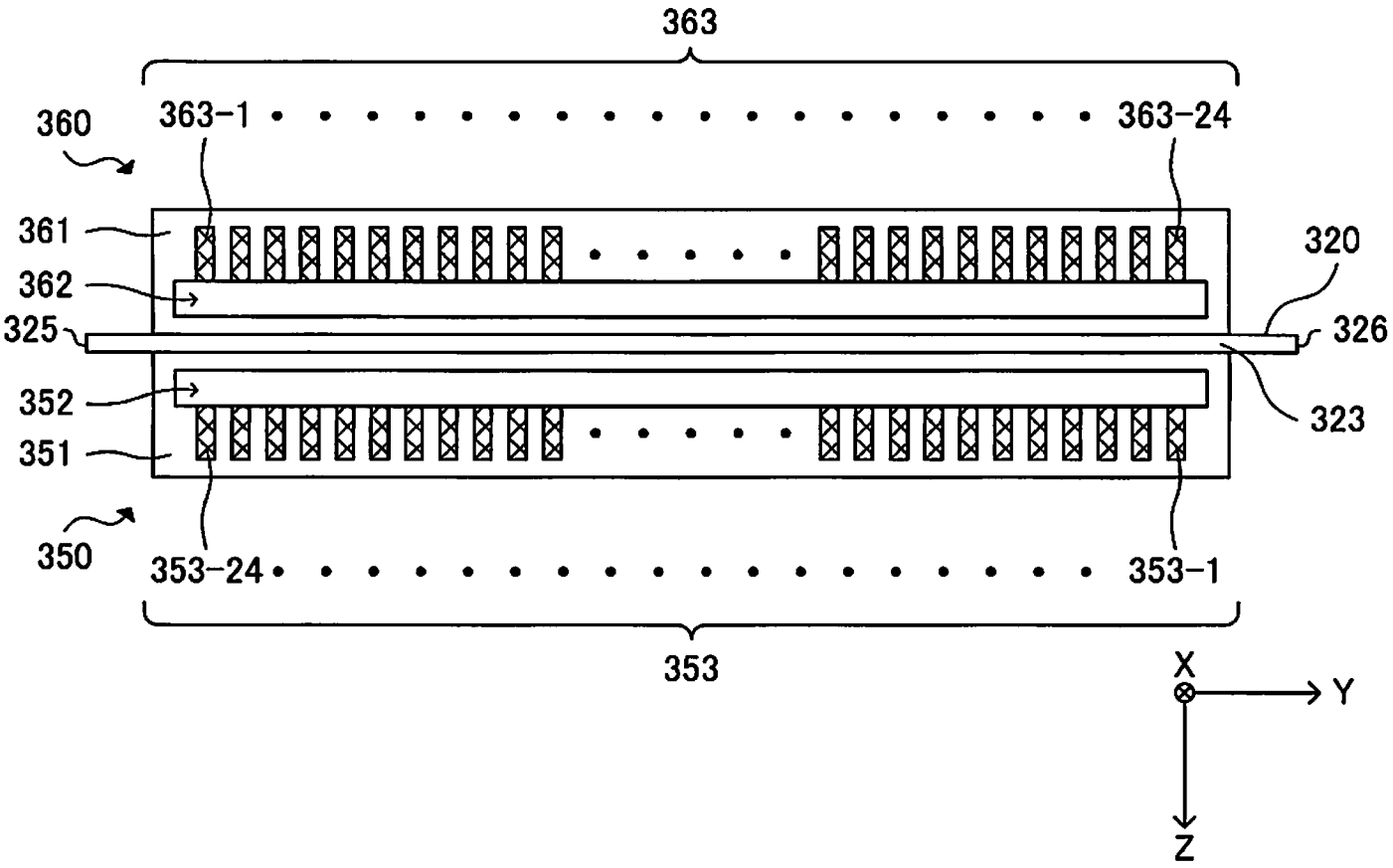
FIG. 13 is a diagram illustrating configurations of connectors.

Here, configurations of the connectors 350 and 360 will be described with reference to FIG. 13. FIG. 13 is a diagram illustrating the configurations of the connectors 350 and 360.

The connector 350 includes a housing 351, a cable attachment section 352, and a plurality of terminals 353. A cable 19 for electrically coupling the control mechanism 10 to the print head 21 is attached to the cable attachment section 352. The plurality of terminals 353 are provided in parallel along the side 323. Furthermore, when the cable 19 is attached to the cable attachment section 352, the plurality of respective terminals, which are included in the cable 19, are electrically coupled to the plurality of respective terminals 353 which are included in the connector 350. Therefore, the various signals output by the control mechanism 10 are input to the print head 21. Meanwhile, in the first embodiment, description is performed while it is assumed that 24 number of terminals 353 are provided in parallel along the side 323 in the connector 350. Here, there is a case where the 24 number of terminals 353, which are provided in parallel, are sequentially referred to as terminals 353-1, 353-2, . . . , 353-24 from a side of the side 326 toward a side of the side 325 in the direction along the side 323.

The connector 360 includes a housing 361, a cable attachment section 362, and a plurality of terminals 363. The cable 19 for electrically coupling the control mechanism 10 to the print head 21 is attached to the cable attachment section 362. The plurality of terminals 363 are provided in parallel along the side 323. Furthermore, when the cable 19 is attached to the cable attachment section 362, the plurality of respective terminals, which are included in the cable 19, are electrically coupled to the plurality of respective terminals 363 which are included in the connector 360. Therefore, the various signals output by the control mechanism 10 are input to the print head 21. Meanwhile, in the first embodiment, description is performed while it is assumed that 24 number of terminals 363 are provided in parallel along the side 323 in the connector 360. Here, there is a case where the 24 number of terminals 363, which are provided in parallel, are sequentially referred to as terminals 363-1, 363-2, . . . , 363-24 from the side of the side 326 toward the side of the side 325 in the direction along the side 323. Meanwhile, details of the cable coupled to the connectors 350 and 360 will be described later.

Returning to FIG. 10, a plurality of electrode groups 330 are formed on the surface 322 of the substrate 320. Furthermore, a plurality of FPC insertion holes 332 and a plurality of ink supply path insertion holes 331, which pass through the surface 321 and the surface 322, are formed in the substrate 320. Specifically, in the substrate 320, a set of the FPC insertion hole 332 and two electrode groups 330, which are located on a side of the side 323 and a side of the side 324 of the FPC insertion hole 332, is provided in plural along the X direction. In addition, the ink supply path insertion hole 331 is located between the sets of the FPC insertion hole 332 and the two electrode groups 330, which are provided in line along the X direction, and two ink supply path insertion holes 331 are provided in line along the Y direction. Furthermore, the ink supply path insertion holes 331 are provided at an end on the side of the side 323 and an end on the side of the side 324 of the set of the FPC insertion hole 332 and the two electrode groups 330, which are provided in line along the X direction, respectively.

Each of the plurality of electrode groups 330 includes a plurality of electrodes provided in parallel along the Y direction. Various signals, which are input from the connectors 350 and 360, are supplied to the plurality of electrode groups 330. Furthermore, a not-shown flexible wiring substrate (Flexible Printed Circuit (FPC)) is coupled to each of the plurality of electrode groups 330. The FPC insertion hole 332 is inserted into the FPC coupled to the electrode groups 330, and the FPC coupled to the electrode groups 330 is electrically coupled to the head 310. Therefore, the various signals, which are input to the print head 21 through the connectors 350 and 360, are supplied to the head 310.

Specifically, signals, which include the print data signal SI1, the change signal CH, the latch signal LAT, the clock signal SCK, the driving signal COMA1, and the reference voltage signal CGND1 and which are used to control the discharge of the ink from the discharge sections 600 included in the nozzle column L1, are supplied to the electrode group 330, which is located to be closest to the side of the side 323, of the plurality of electrode groups 330. Furthermore, the various input signals are supplied to the driving signal selection circuit 200-1 through the FPC coupled to the electrode group 330. In the same manner, signals, which include a print data signal SIj, the change signal CH, the latch signal LAT, the clock signal SCK, a driving signal COMAj, and a reference voltage signal CGNDj, are supplied to the electrode group 330, which is located at j-th (j is any of 1 to 6) from the side of the side 323, of the plurality of electrode groups 330 in order to control the discharge of the ink from the discharge sections 600 included in a nozzle column Lj. Furthermore, the various input signals are supplied to the driving signal selection circuit **200-*j* through the FPC coupled to the electrode group 330. Here, although not shown in the drawing, each of the driving signal selection circuits 200-1 to 200-6 may be mounted on the FPC coupled to each of the electrode groups 330 in a Chip On Film (COF) manner, and, in addition, may be provided on an inside of the head 310**.

The respective ink supply path insertion holes 331 are provided to correspond to the nozzle columns L1 to L6. Some of not-shown ink supply paths for supplying the ink to the ink supply ports 661 corresponding to the discharge sections 600 included in the relevantly provided nozzle columns L1 to L6, are inserted into the ink supply path insertion holes 331.

The print head 21, which is formed as above, has a self-diagnosis function performed based on diagnosis signals DIG1 to DIG4 which are input from the control mechanism 10. The self-diagnosis function of the print head 21 is a function of self-diagnosing whether or not the print head 21 is normal, and is a function of diagnosing whether or not it is possible to form dots which satisfy a normal print quality based on, for example, the diagnosis signals DIG1 to DIG4 which are input from the control mechanism 10, by the print head 21 itself.

The self-diagnosis function is performed at prescribed timing in a non-print status such as a case where power is supplied to the liquid discharge apparatus 1, a case where a process of shutting down the liquid discharge apparatus 1 is performed, or a case where a print start instruction or a print end instruction is generated. In addition, the self-diagnosis function may be performed at the prescribed timing when the power of the liquid discharge apparatus 1 is continuously supplied and the non-print status is continued.

The self-diagnosis may be performed by a not-shown diagnosis circuit based on, for example, the diagnosis signals DIG1 to DIG4 which are input from the connector 350. Specifically, the print head 21 may check connection between the print head 21 and the control mechanism 10 as the self-diagnosis based on whether or not all or any of voltages of the input diagnosis signals DIG1 to DIG4 are normal. In addition, the print head 21 may check operations of various components included in the print head 21, as the self-diagnosis, by operating random components, such as the driving signal selection circuit 200 and the piezoelectric element 60 included in the print head 21, according to a combination of all or any of logical levels of the input diagnosis signals DIG1 to DIG4, and by detecting a voltage signal caused by the operation. In addition, the print head 21 may check the operations of the random components, such as the driving signal selection circuit 200 and the piezoelectric element 60 included in the print head 21, as the self-diagnosis, according to a prescribed command included in all or any of the input diagnosis signals DIG1 to DIG4. Meanwhile, the self-diagnosis of the print head 21 is not limited to the above-described methods, and may include, for example, detection based on a temperature detected by the temperature detection circuit 210, temperature abnormality detection performed by the temperature abnormality detection circuit 250, and the like.

In addition, the print head 21 may output a diagnosis signal DIG5 which indicates a result of the self-diagnosis, and, furthermore, may be configured such that the diagnosis signal DIG5 is input to the control circuit 100. Furthermore, the control circuit 100 performs various processes, such as stop of the operation of the liquid discharge apparatus 1 and correction of the waveform of the driving signal COM, according to the input diagnosis signal DIG5.

Here, the diagnosis signal DIG1 is an example of a first diagnosis signal, the diagnosis signal DIG2 is an example of a second diagnosis signal, the diagnosis signal DIG3 is an example of a third diagnosis signal, the diagnosis signal DIG4 is an example of a fourth diagnosis signal, and the diagnosis signal DIG5 is an example of a fifth diagnosis signal.

1.7 Configuration of Print Head Control Circuit

Figure 14:
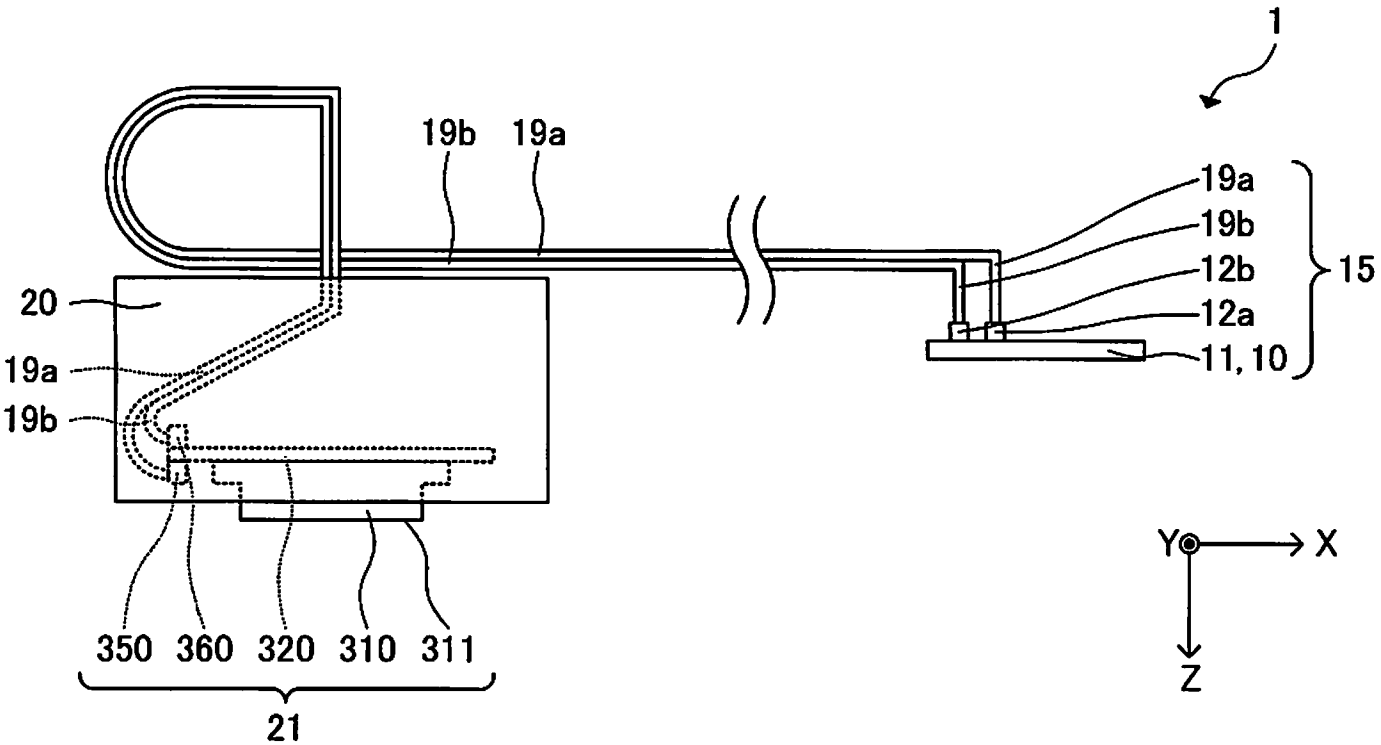
FIG. 14 is a diagram schematically illustrating an inner configuration when the liquid discharge apparatus is viewed from a Y direction.

FIG. 14 is a diagram schematically illustrating an inner configuration when the liquid discharge apparatus 1 is viewed from the Y direction. As illustrated in FIG. 14, the liquid discharge apparatus 1 includes a main substrate 11, cables 19*a* and 19*b*, and the print head 21.

In the main substrate 11, various circuits, which include the driving signal output circuit 50 and the control circuit 100 that are included in the control mechanism 10 illustrated in FIGS. 1 and 2, are mounted. In addition, connectors 12*a* and 12*b* are mounted in the main substrate 11. Furthermore, one end of the cable 19*a* is attached to the connector 12*a*, and one end of the cable 19*b* is attached to the connector 12*b*. Meanwhile, although FIG. 14 illustrates one circuit substrate as the main substrate 11, the main substrate 11 may be formed with two or more circuit substrates.

The print head 21 includes the head 310, the substrate 320, and the connectors 350 and 360. Another end of the cable 19*a* is coupled to the connector 350, and another end of the cable 19*b* is attached to the connector 360. That is, the cable 19*a* is attached to the connector 350 provided on the surface 321 on which the head 310 is provided in the substrate 320 of the print head 21, and the cable 19*b* is attached to the connector 360 provided on the surface 322 on which the head 310 is not provided in the substrate 320 of the print head 21. In other words, a shortest distance between the nozzle plate 632 of the head 310 and the cable 19*b* is longer than a shortest distance between the nozzle plate 632 and the cable 19*a*.

The liquid discharge apparatus 1, which is formed as above, outputs the various signals, which includes the driving signals COM1 to COM6, the reference voltage signals CGND1 to CGND6, the print data signals SI1 to SI6, the latch signal LAT, the change signal CH, the clock signal SCK, and the diagnosis signals DIG1 to DIG5, from the control mechanism 10 mounted in the main substrate 11, and controls the operation of the print head 21 based on the signals. That is, in the liquid discharge apparatus 1 illustrated in FIG. 14, a configuration including the control mechanism 10, which outputs the various signals for controlling the operation of the print head 21, and the cables 19*a* and 19*b*, through which the various signals for controlling the operation of the print head 21 are propagated, is an example of the print head control circuit 15 which operates the print head 21 having the self-diagnoses function.

Here, the configurations of the cables 19*a* and 19*b* will be described with reference to FIG. 15. Meanwhile, the cables 19*a* and 19*b* of the first embodiment have the same configuration, and the cables 19*a* and 19*b* are referred to as a cable 19 when particular distinction is not necessary.

Figure 15:
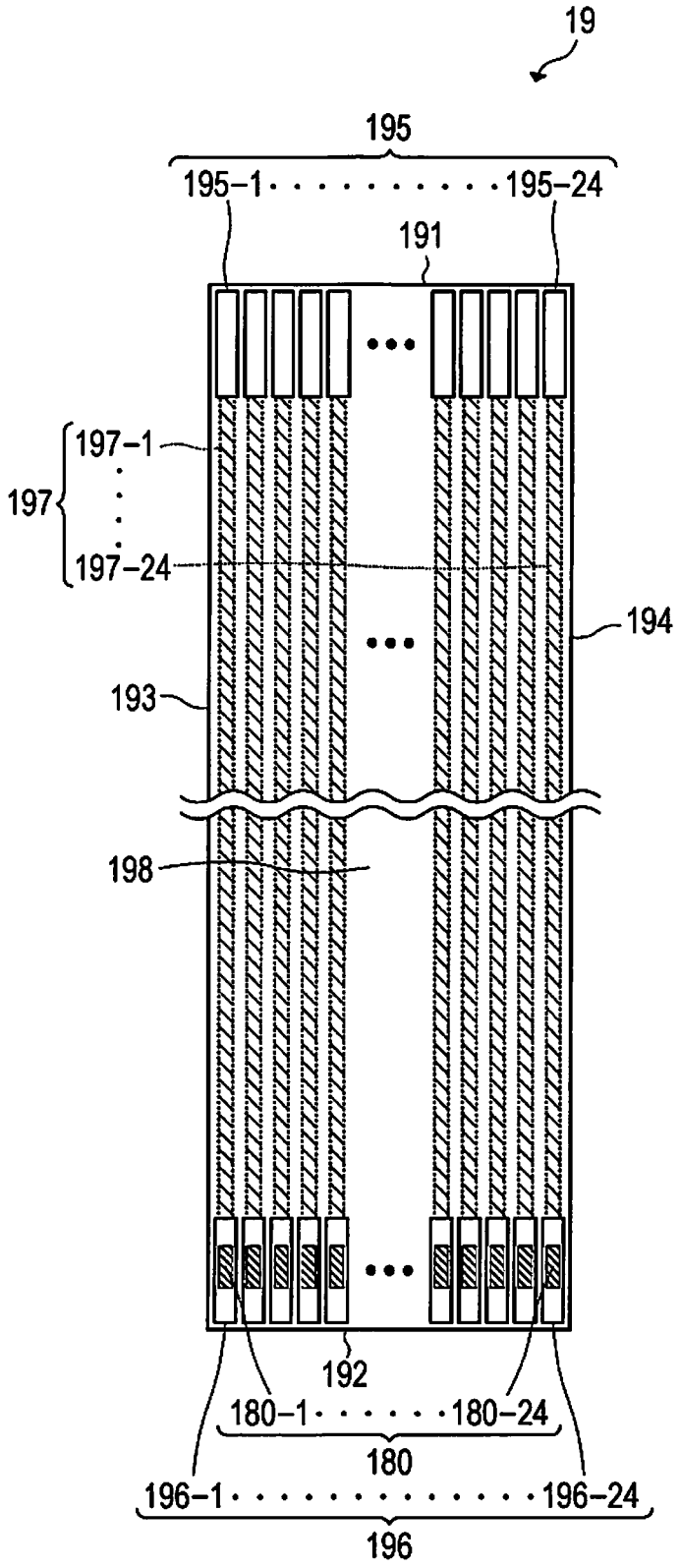
FIG. 15 is a diagram illustrating a configuration of a cable.

FIG. 15 is a diagram illustrating the configuration of the cable 19. The cable 19 is a substantially rectangle including short sides 191 and 192, which fact to each other, and long sides 193 and 194, which fact to each other, and is, for example, a Flexible Flat Cable (FFC).

On a side of a short side 191 of the cable 19, 24 numbers of terminals 195 are provided in line in order of terminals 195-1 to 195-24 from a side of a long side 193 toward a side of a long side 194. In addition, on a side of a short side 192 of the cable 19, 24 numbers of terminals 196 are provided in line in order of terminals 196-1 to 196-24 from the side of the long side 193 toward the side of the long side 194. In addition, in the cable 19, 24 numbers of wirings 197, which electrically couple the respective terminal 195 to the respective terminals 196, are provided in line in order of wirings 197-1 to 197-24 from the side of the long side 193 to the side of the long side 194. Specifically, a wiring 197-*k* (k is any of 1 to 24) causes a terminal 195-*k* to be electrically coupled to a terminal 196-*k*.

Each of the wirings 197-1 to 197-24 is insulated between the wirings and from an outside of the cable 19 by an insulator 198. Furthermore, the cable 19 propagates a signal, which is input from the main substrate 11 to the terminal 195-*k*, through the wiring 197-*k*, and outputs the signal to the substrate 320 through the terminal 196-*k*. Meanwhile, the configuration of the cable 19 illustrated in FIG. 15 is an example, and the present disclosure is not limited thereto. For example, the 24 numbers of terminals 195-1 to 195-24 and the 24 numbers of terminals 196-1 to 196-24, which are included in the cable 19, may be provided on another surface of the cable 19. In addition, for example, the 24 numbers of terminals 195-1 to 195-24 and the 24 numbers of terminals 196-1 to 196-24, which are included in the cable 19, may be provided on both-side surfaces of a front surface and a rear surface of the cable 19.

Figure 16:
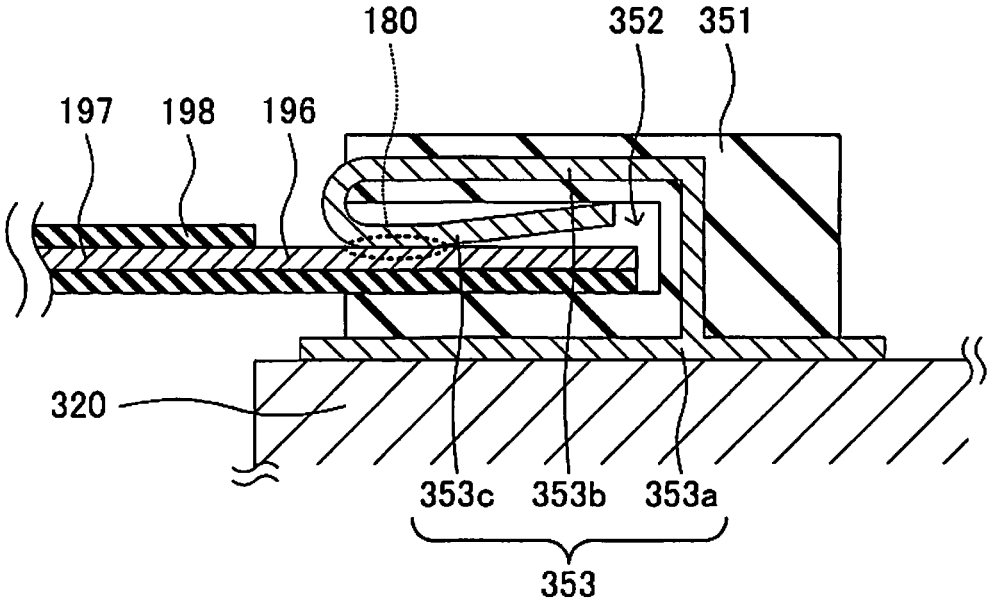
FIG. 16 is a diagram illustrating a contact section when the cable is attached to connector.

In addition, FIG. 15 illustrates a contact section 180 at which the terminal 196 is in electrical contact with the terminal 353 of the connector 350 or the terminal 363 of the connector 360, the connector 350 and the connector 360 being provided in the substrate 320. FIG. 16 is a diagram illustrating the contact section 180 when the cable 19 is attached to connector 350. Meanwhile, the connector 350 and the connector 360 have the same configuration. Therefore, in FIG. 16, a case where the cable 19 is attached to the connector 350 is described, and the case where the cable 19 is attached to the connector 360 will not be described.

As illustrated in FIG. 16, the terminal 353 of the connector 350 includes a substrate attachment section 353*a*, a housing insertion section 353*b*, and a cable maintaining section 353*c*. The substrate attachment section 353*a* is located at a lower part of the connector 350, and is provided between the housing 351 and the substrate 320. Furthermore, the substrate attachment section 353*a* is electrically coupled to a not-shown electrode provided in the substrate 320 through, for example, solder or the like. The housing insertion section 353*b* is inserted into the inside of the housing 351. Furthermore, the housing insertion section 353*b* causes the substrate attachment section 353*a* to be electrically coupled to the cable maintaining section 353*c*. The cable maintaining section 353*c* has a curved shape which protrudes to an inside of the cable attachment section 352. Furthermore, when the cable 19 is attached to the cable attachment section 352, the cable maintaining section 353*c* is in electrical contact with the terminal 196. Therefore, the cable 19 is electrically coupled to the connector 350 and the substrate 320. In this case, when the cable 19 is attached, stress occurs in the curved shape formed in the cable maintaining section 353*c*. Furthermore, the cable 19 is maintained on the inside of the cable attachment section 352 by the stress. A contact point, at which the terminal 196 is electrically coupled to the cable maintaining section 353*c*, is the contact section 180.

Meanwhile, the shape of the connector 350 is not limited to the above-described shape. The connector 350 may have a shape, which maintains the cable 19 and enables the signals propagated through the cable 19 to be propagated to the substrate 320, and may have a configuration in which, for example, the connector 350 has a lock mechanism and the cable 19 is electrically coupled to the connector 350 in accordance with an operation of the lock mechanism while the cable 19 is maintained by the lock mechanism. That is, the contact section 180 is a contact point at which the cable 19 included in the print head control circuit 15 is in electrical contact with the print head 21 and, in other words, a point at which the print head control circuit 15 outputs various control signals.

Meanwhile, in the description below, there is a case where the contact section 180, at which each of the terminals 196-1 to 196-24 is in contact with the connector 350 or the connector 360, is referred to as contact sections 180-1 to 180-24.

Subsequently, details of the signals, which are propagated through the respective cables 19*a* and 19*b*, will be described with reference to FIGS. 17 and 18. Meanwhile, in the description with reference to FIGS. 17 and 18, description is performed while it is assumed that the terminals 195-*k* and 196-*k*, the wiring 197-*k*, and the contact section 180-*k*, which are provided in the cable 19*a*, are referred to as terminals 195*a*-*k* and 196*a*-*k*, a wiring 197*a*-*k*, and a contact section 180*a*-*k*, respectively. Furthermore, description is performed while it is assumed that the terminal 195*a*-*k* is electrically coupled to the connector 12*a*, and the terminal 196*a*-*k* is electrically coupled to the terminal 353-*k* of the connector 350 through the contact section 180*a*-*k*. In the same manner, the terminals 195-*k* and 196-*k*, the wiring 197-*k*, and the contact section 180-*k*, which are provided in the cable 19*b*, are referred to as terminals 195*b*-*k* and 196*b*-*k*, a wiring 197*b*-*k*, and a contact section 180*b*-*k*, respectively. Furthermore, description is performed while it is assumed that the terminal 195*b*-*k* is electrically coupled to the connector 12*b*, and the terminal 196*b*-*k* is electrically coupled to the terminal 363-*k* of the connector 360 through the contact section 180*b*-*k*.

FIG. 17 is a diagram illustrating details of signals which are propagated through the cable 19*a*. As illustrated in FIG. 17, the cable 19*a* includes a plurality of wirings for propagating the print data signal SI1, the change signal CH, the latch signal LAT, the clock signal SCK, the temperature signal TH, and the abnormality signal XHOT, a plurality of wirings for propagating the diagnosis signals DIG1 to DIG5, a plurality of wirings for propagating the plurality of ground signals GND, a plurality of wirings for propagating the driving signals COM1 to COM6, and a plurality of wirings for propagating the reference voltage signals CGND1 to CGND6.

The print data signal SI1, the change signal CH, the latch signal LAT, the clock signal SCK, the temperature signal TH, the abnormality signal XHOT, the diagnosis signals DIG1 to DIG5, and the plurality of ground signals GND are propagated through the wirings 197*a*-1 to 197*a*-12, and are output through the contact sections 180*a*-1 to 180*a*-12. In addition, the driving signals COM1 to COM6 and the reference voltage signals CGND1 to CGND6 are propagated through the wirings 197*a*-13 to 197*a*-24, and are output through the contact sections 180*a*-13 to 180*a*-24.

That is, in the cable 19*a*, a signal of a low voltage is propagated through the wiring located on the side of the long side 193, and a signal of a high voltage is propagated through the wiring located on the side of the long side 194. Furthermore, the wiring through which the signal of the low voltage is propagated and the wiring through which the signal of the high voltage is propagated are separately located in the cable 19*a*. Specifically, in the cable 19*a*, the wirings for propagating the driving signals COM1 to COM6 are not located between the wiring 197*a*-4 for propagating the diagnosis signal DIG1 and the wiring 197*a*-8 for propagating the diagnosis signal DIG2, between the wiring 197*a*-8 for propagating the diagnosis signal DIG2 and the wiring 197*a*-10 for propagating the diagnosis signal DIG3, between the wiring 197*a*-10 for propagating the diagnosis signal DIG3 and the wiring 197*a*-6 for propagating the diagnosis signal DIG4, and between the wiring 197*a*-6 for propagating the diagnosis signal DIG4 and the wiring 197*a*-4 for propagating the diagnosis signal DIG1. Therefore, it is possible to reduce a problem in that the signal, such as the driving signal COM, of the high voltage interferes in the signal of the low voltage, which is propagated through the cable 19*a*.

In addition, in the print head control circuit 15, the signal of the low voltage is output from the contact section located on the side of the long side 193, and the signal of the high voltage is output from the contact section located on the side of the long side 194.

Furthermore, the contact section, from which the signal of the low voltage is output, and the contact section, from which the signal of the high voltage is output, are separately located in the print head control circuit 15. Specifically, in the print head control circuit 15, the contact section 180 which outputs the driving signals COM1 to COM6 is not located between the contact section 180*a*-4 which outputs the diagnosis signal DIG1 and the contact section 180*a*-8 which outputs the diagnosis signal DIG2, between the contact section 180*a*-8 which outputs the diagnosis signal DIG2 and the contact section 180*a*-10 which outputs the diagnosis signal DIG3, between the contact section 180*a*-10 which outputs the diagnosis signal DIG3 and the contact section 180*a*-6 which outputs the diagnosis signal DIG4, and between the contact section 180*a*-6 which outputs the diagnosis signal DIG4 and the contact section 180*a*-4 which outputs the diagnosis signal DIG1. Therefore, it is possible to reduce a problem in that the signal, such as the driving signal COM, of the high voltage interferes in the signal of the low voltage which is output from the print head control circuit 15.

In addition, in the signals propagated through the cable 19*a*, the diagnosis signals DIG1 to DIG4 for performing the self-diagnosis of the print head 21, the diagnosis signal DIG5 for indicating the result of the self-diagnosis of the print head 21, the print data signal SI' for controlling the discharge of the print head 21, the change signal CH, the latch signal LAT, the clock signal SCK, and the abnormality signal XHOT may be propagated through different wirings. However, it is preferable that the signals are propagated through a common wiring as illustrated in FIG. 17.

Specifically, as illustrated in FIG. 17, it is preferable that the wiring 197*a*-4 functions as the wiring for propagating the diagnosis signal DIG1 and the wiring for propagating the latch signal LAT for prescribing the ink discharge timing. In addition, it is preferable that the wiring 197*a*-8 functions as the wiring for propagating the diagnosis signal DIG2 and the wiring for propagating the change signal CH for prescribing the timing at which the waveform of the driving signal COM is switched. In addition, it is preferable that the wiring 197*a*-10 functions as the wiring for propagating the diagnosis signal DIG3 and the wiring for propagating the print data signal SI1 for prescribing the selection of the waveform of the driving signal COM. In addition, it is preferable that the wiring 197*a*-6 functions as the wiring for propagating the diagnosis signal DIG4 and the wiring for propagating the clock signal SCK. In addition, it is preferable that the wiring 197*a*-12 functions as the wiring for propagating the diagnosis signal DIG5 and the wiring for propagating the abnormality signal XHOT which indicates the existence/non-existence of the temperature abnormality of the print head 21.

The print data signal SI1, the change signal CH, the latch signal LAT, the clock signal SCK, and the abnormality signal XHOT are important signals for controlling the discharge of the print head 21. When a connection failure or the like occurs in the wirings through which the signals are propagated, there is a problem in that the discharge accuracy of the ink is deteriorated. When the wirings, through which the important signals are propagated, and the wirings, through which signals for performing the self-diagnosis by the print head 21 is propagated, are set to the common wiring, it is possible to diagnose a connection state of the wirings, through which the print data signal SI1, the change signal CH, the latch signal LAT, the clock signal SCK, and the abnormality signal XHOT are propagate, based on the result of the self-diagnosis of the print head 21. Furthermore, since the plurality of signals are propagated through one wiring, it is possible to reduce the number of wirings to be provided in the cable 19*a*.

Here, as a method for propagating the diagnosis signals DIG1 to DIG5, the print data signal SI1, the change signal CH, the latch signal LAT, the clock signal SCK, and the abnormality signal XHOT through the common wiring, for example, a configuration in which a signal propagated through a prescribed wiring is switched by a not-shown switch circuit may be provided. Specifically, the control circuit 100 outputs the diagnosis signal DIG1 and the latch signal LAT, and the switch circuit switches the signal to be supplied to the wiring 197*a*-4. In addition, the control circuit 100 outputs the diagnosis signal DIG2 and the change signal CH, and the switch circuit switches the signal to be supplied to the wiring 197*a*-8. In addition, the control circuit 100 outputs the diagnosis signal DIG3 and the print data signal SI1, and the switch circuit switches the signal to be supplied to the wiring 197*a*-10. In addition, the control circuit 100 outputs the diagnosis signal DIG4 and the clock signal SCK, and the switch circuit switches the signal to be supplied to the wiring 197*a*-6. In addition, a not-shown diagnosis circuit included in the print head 21 outputs the diagnosis signal DIG5, the temperature abnormality detection circuit 250 outputs the abnormality signal XHOT, and the switch circuit switches the signal to be supplied to the wiring 197*a*-12.

In addition, for example, the control circuit 100 and the temperature abnormality detection circuit 250 may generate the signals propagated through the prescribed wiring in a time division manner. Specifically, the control circuit 100 outputs the diagnosis signal DIG1 when the self-diagnosis of the print head 21 is performed with respect to the wiring 197*a*-4, and outputs the latch signal LAT in a print status. In addition, the control circuit 100 outputs the diagnosis signal DIG2 when the self-diagnosis of the print head 21 is performed with respect to the wiring 197*a*-8, and outputs the change signal CH in the print status. In addition, the control circuit 100 outputs the diagnosis signal DIG3 when the self-diagnosis of the print head 21 is performed with respect to the wiring 197*a*-10, and outputs the print data signal SI1 in the print status. In addition, the control circuit 100 outputs the diagnosis signal DIG4 when the self-diagnosis of the print head 21 is performed with respect to the wiring 197*a*-6, and outputs the clock signal SCK in the print status. In addition, the temperature abnormality detection circuit 250 outputs the diagnosis signal DIG5 when the self-diagnosis of the print head 21 is performed with respect to the wiring 197*a*-12, and outputs the abnormality signal XHOT in the print status.

Here, an example of a configuration in which the temperature abnormality detection circuit 250 outputs the diagnosis signal DIG5 will be described with reference to the above-described FIG. 9. A result of the diagnosis in the not-shown diagnosis circuit included in the print head 21 is input to the temperature abnormality detection circuit 250. Furthermore, the temperature abnormality detection circuit 250 changes the logical level of the abnormality signal XHOT based on a signal which indicates the result of the diagnosis. Specifically, the signal which indicates the result of the diagnosis is input to the temperature abnormality detection circuit 250. Furthermore, the temperature abnormality detection circuit 250 controls the transistor 253 based on the signal which indicates the result of the diagnosis. For example, when the result of the diagnosis input from the diagnosis circuit is a signal which indicates that the print head 21 is normal, control is performed such that the transistor 253 is turned off. Therefore, the temperature abnormality detection circuit 250 outputs the diagnosis signal DIG5 at the H level. In contrast, when the signal which indicates the result of the diagnosis is a signal which indicates that abnormality occurs in the print head 21, the temperature abnormality detection circuit 250 performs control such that the transistor 253 is turned on. Therefore, the temperature abnormality detection circuit 250 outputs the diagnosis signal DIG5 at the L level. Meanwhile, the temperature abnormality detection circuit 250 may output the diagnosis signal DIG5 corresponding to the prescribed command by controlling the transistor 253 at the prescribed timing based on the result of the diagnosis performed by the diagnosis circuit.

Furthermore, as illustrated in FIG. 17, it is preferable that the wiring through which the ground signal GND is propagated is located between the wirings through which the respective diagnosis signals DIG1 to DIG5 are propagated. Specifically, it is preferable that the wirings 197*a*-5, 197*a*-7, and 197*a*-9, through which the ground signal GND is propagated, are located between the wiring 197*a*-4 through which the diagnosis signal DIG1 is propagated and the wiring 197*a*-8 through which the diagnosis signal DIG2 is propagated, between the wiring 197*a*-8 through which the diagnosis signal DIG2 is propagated and the wiring 197*a*-10 through which the diagnosis signal DIG3 is propagated, between the wiring 197*a*-10 through which the diagnosis signal DIG3 is propagated and the wiring 197*a*-6 through which the diagnosis signal DIG4 is propagated, between the wiring 197*a*-6 through which the diagnosis signal DIG4 is propagated and the wiring 197*a*-4 through which the diagnosis signal DIG1 is propagated. Therefore, it is possible to reduce a problem in that the diagnosis signals DIG1 to DIG4, which are propagated through the cable 19*a*, interfere in each other.

Here, the wiring 197*a*-4 for propagating the diagnosis signal DIG1 is an example of a first diagnosis signal propagation wiring, the wiring 197*a*-8 for propagating the diagnosis signal DIG2 is an example of a second diagnosis signal propagation wiring, the wiring 197*a*-10 for propagating the diagnosis signal DIG3 is an example of a third diagnosis signal propagation wiring, the wiring 197*a*-6 for propagating the diagnosis signal DIG4 is an example of a fourth diagnosis signal propagation wiring, and the wiring 197*a*-12 for propagating the diagnosis signal DIG5 is an example of a fifth diagnosis signal propagation wiring. In addition, any of the wirings 197*a*-14, 197*a*-16, 197*a*-18, 197*a*-20, 197*a*-22, and 197*a*-24 for propagating the driving signals COM1 to COME is an example of a driving signal propagation wiring. In addition, any of the wirings 197*a*-1, 197*a*-3, 197*a*-5, 197*a*-7, 197*a*-9, and 197*a*-11 for propagating the ground signal GND that is the voltage signal with the ground potential is an example of a plurality of ground signal propagation wirings. Furthermore, the cable 19*a*, which includes the wirings 197*a*-1 to 197*a*-24, is an example of a second cable.

Subsequently, details of the signals propagated through the cable 19*b* will be described with reference to FIG. 18. FIG. 18 is a diagram illustrating the details of signals which are propagated through the cable 19*b*. As illustrated in FIG. 18, the cable 19*b* includes the plurality of wirings for propagating the driving signals COM1 to COM6, the plurality of wirings for propagating the reference voltage signals CGND1 to CGND6, the wiring for propagating the high voltage signal VHV, the plurality of wirings for propagating the print data signals SI2 to SI6, the wiring for propagating the low voltage signal VDD, and the plurality of wirings for propagating the plurality of ground signals GND.

The driving signals COM1 to COM6 and the reference voltage signals CGND1 to CGND6 are propagated through the wirings 197*b*-1 to 197*b*-12, and are output through the contact sections 180*b*-1 to 180*b*-12. In addition, the print data signals SI2 to SI6, the low voltage signal VDD, and the plurality of ground signals GND are propagated through the wirings 197*b*-15 to 197*b*-24, and are output through the contact sections 180*b*-15 to 180*b*-24. That is, in the cable 19*b*, the signal of the high voltage is propagated through the wiring located on the side of the long side 193, and the signal of the low voltage is propagated through the wiring located on the side of the long side 194. In other words, in the print head control circuit 15, the signal of the high voltage is output from the contact section located on the side of the long side 193, and the signal of the low voltage is output from the contact section located on the side of the long side 194.

In addition, the high voltage signal VHV is propagated through the wiring 197*b*-14 located between the wiring through which the signal of the high voltage is propagated and the wiring through which the signal of low voltage is propagated, and is output through the contact section 180*b*-14. In the cable 19*b*, which is formed as above, the wiring through which the signal of the high voltage is propagated and the wiring through which the signal of the low voltage is propagated are separately located. Therefore, the problem is reduced in that the signal, such as the driving signal COM, of the high voltage interferes in the signal of the low voltage, which is propagated through the cable 19*b*. In addition, in the print head control circuit 15, the contact section, from which the signal of the high voltage is output, and the contact section, from which the signal of the low voltage is output, are separately located. Therefore, the problem is reduced in that the signal, such as the driving signal COM, of the high voltage interferes in the signal of the low voltage, which is output from the print head control circuit 15.

Furthermore, the wiring 197*b*-14 through which the high voltage signal VHV is propagated is located between the wirings through which the driving signals COM1 to COM6 are propagated and the wirings through which the print data signals SI2 to SI6 are propagated. The wiring 197*b*-14 functions as a shield wiring for reducing mutual interference which occurs between the wirings through which the driving signals COM1 to COM6 are propagated and the wirings through which the print data signals SI2 to SI6 are propagated. Therefore, it is possible to further reduce the problem in that the voltage signal of the high voltage interferes in the voltage signal of the low voltage, which is propagated through the cable 19*b*.

In the same manner, the wiring 197*b*-14 from which the high voltage signal VHV is output is located between the contact sections, from which the driving signals COM1 to COM6 are output, and the contact sections from which the print data signals SI2 to SI6 are output. Therefore, the contact section 180*b*-14 functions as a shield for reducing the mutual interference which occurs between the contact sections, from which the driving signals COM1 to COM6 are output, and the contact sections from which the print data signals SI2 to SI6 are output. Therefore, it is possible to further reduce the problem in that the voltage signal of the high voltage interferes in the voltage signal of the low voltage, which is output from the print head control circuit 15.

Here, the high voltage signal VHV is an example of a first power voltage signal, and the wiring 197*b*-14 for propagating the high voltage signal VHV is an example of a first power voltage signal propagation wiring. In addition, the low voltage signal VDD is another example of the first power voltage signal, and the low voltage signal VDD wiring for propagating 197*b*-23 is another example of the first power voltage signal propagation wiring. Furthermore, the cable 19*b* including the wirings 197*b*-14 and 197*b*-23 is an example of a first cable.

Furthermore, when the respective cables 19*a* and 19*b* are electrically coupled to the respective connectors 350 and 360, the print head control circuit 15 supplies the various signals generated in the control mechanism 10 to the print head 21. Specifically, the cable 19*a* is electrically coupled to the connector 350 provided on the surface 321, which is a surface on the side of the ink discharge surface 311, on which the nozzle plate 632 is provided, in the print head 21 of the substrate 320.

Specifically, the diagnosis signal DIG1 output from the control circuit 100 is propagated through the wiring 197*a*-4, and is input to the print head 21 through the terminal 196*a*-4, the contact section 180*a*-4, and the terminal 353-4. In addition, the diagnosis signal DIG2 is propagated through the wiring 197*a*-8, and is input to the print head 21 through the terminal 196*a*-8, the contact section 180*a*-8, and the terminal 353-8. In addition, the diagnosis signal DIG3 is propagated through the wiring 197*a*-10, and is input to the print head 21 through the terminal 196*a*-10, the contact section 180*a*-10, and the terminal 353-10. In addition, the diagnosis signal DIG4 is propagated through the wiring 197*a*-6, and is input to the print head 21 through the terminal 196*a*-6, the contact section 180*b*-6, and the terminal 353-6. In addition, the diagnosis signal DIG5 is supplied from the print head 21 to the terminal 353-12, and is propagated through the wiring 197*a*-12 via the contact section 180*a*-12 and the terminal 196*a*-12.

In addition, the cable 19*b* is electrically coupled to the connector 360 provided on the surface 322 of the substrate 320. Furthermore, the signals output from the control mechanism 10 are supplied to the terminal 195*b*-*k* and are propagated through the wiring 197*b*-*k*, and, thereafter, the signals are supplied to the print head 21 through the terminal 196*b*-*k*, the contact section 180*b*-*k*, and the terminal 363-*k* included in the connector 360.

That is, as illustrated in FIG. 14, the print head control circuit 15 is provided such that the shortest distance between the nozzle plate 632 and the cable 19*b* is longer than the shortest distance between the nozzle plate 632 and the cable 19*a*. In other words, the shortest distance between the contact section 180*b*-14, at which the wiring 197*b*-14 through which the high voltage signal VHV is propagated is in contact with the terminal 363-14 of the connector 360, and the nozzle plate 632 is longer than the shortest distance between the contact section 180*a*-4, at which the wiring 197*a*-4 through which the diagnosis signal DIG1 is propagated is in contact with the terminal 353-4 of the connector 350, and the nozzle plate 632.

Here, the terminal 353-4 of the connector 350 to which the diagnosis signal DIG1 is input is an example of a first coupling point, the terminal 353-8 to which the diagnosis signal DIG2 is input is an example of a second coupling point, the terminal 353-10 to which the diagnosis signal DIG3 is input is an example of a third coupling point, the terminal 353-6 to which the diagnosis signal DIG4 is input is an example of a fourth coupling point, and the terminal 353-12 to which the diagnosis signal DIG5 is input is an example of a fifth coupling point. In addition, the terminal 363-14 of the connector 360 to which the high voltage signal VHV is input is an example of a tenth coupling point. In addition, any of the terminals 353-14, 353-16, 353-18, 353-20, 353-22, and 353-24 of the connector 350 to which the driving signal COM is input is an example of an eleventh connect terminal. In addition, any of the terminals 353-5, 353-7, and 353-9, to which the ground signal GND that is a voltage signal with the ground potential is input, is an example of a plurality of ground coupling points.

Furthermore, the contact section 180*a*-4, at which the terminal 353-4 is in electrical contact with the terminal 196*a*-4 of the cable 19*a*, is an example of a first contact section, the contact section 180*a*-8, at which the terminal 353-8 is in electrical contact with the terminal 196*a*-8 of the cable 19*a*, is an example of a second contact section, the contact section 180*a*-10, at which the terminal 353-10 is in electrical contact with the terminal 196*a*-10 of the cable 19*a*, is an example of a third contact section, and the contact section 180*a*-6, at which the terminal 353-6 is in electrical contact with the terminal 196*a*-6 of the cable 19*a*, is an example of a fourth contact section. In addition, the contact section 180*b*-14, at which the terminal 363-14 is in electrical contact with the terminal 196*b*-14 of the cable 19*b*, is an example of a tenth contact section. In addition, any of the contact sections 180*a*-14, 180*a*-16, 180*a*-18, 180*a*-20, 180*a*-22, and 180*a*-24, at which the respective terminals 353-14, 353-16, 353-18, 353-20, 353-22, and 353-24 are in electrical contact with the respective terminals 196*a*-14, 196*a*-16, 196*a*-18, 196*a*-20, 196*a*-22, and 196*a*-24 of the cable 19*a*, is an example of an eleventh contact section. In addition, any of the contact sections 180*a*-5, 180*a*-7, and 180*a*-9, at which the respective terminals 353-5, 353-7, and 353-9 are in electrical contact with the respective terminals 196*a*-5, 196*a*-7, and 196*a*-9 of the cable 19*a*, is an example of a ground contact section.

1.8 Effects

The print head control circuit 15 used for the liquid discharge apparatus 1 according to the above-described first embodiment includes the cable 19*b* for propagating the high voltage signal VHV and the low voltage signal VDD, and the cable 19*a* for propagating the diagnosis signals DIG1 to DIG4. Furthermore, the cable 19*a* is provided to be close to the nozzle plate 632, which includes the nozzles 651 for discharging the ink, rather than the cable 19*b*. In other words, the cable 19*a* is provided in a location, to which the ink floating on the inside of the liquid discharge apparatus 1 easily adheres, rather than the cable 19*b*. Furthermore, when the ink floating on the inside of the liquid discharge apparatus 1 adheres to the cable 19*a* and thus short-circuit occurs at least one of between the wirings 197*a*-1 to 197*a*-24 included in the cable 19*a* and between the plurality of terminals 353 of the connector 350 to which the cable 19*a* is coupled, distortion occurs in the waveforms of the diagnosis signals DIG1 to DIG4 supplied to the print head 21. Furthermore, the print head 21 performs the self-diagnoses of whether or not there is a problem in that the discharge accuracy of the ink is deteriorated due to influence of the floating ink by detecting the distortion of the waveforms of the diagnosis signals DIG1 to DIG4.

Furthermore, in the print head control circuit 15 used for the liquid discharge apparatus 1 according to the first embodiment, the cable 19*b* for propagating the high voltage signal VHV or the low voltage signal VDD is located in a location to which it is difficult for the ink floating on the inside of the liquid discharge apparatus 1 to adhere. Therefore, the problem is reduced in that the floating ink adheres to the wirings 197*b*-1 to 197*b*-24, through which the high voltage signal VHV and the low voltage signal VDD are propagated, the high voltage signal VHV and the low voltage signal VDD functioning as the power voltage of the print head 21, and the terminal 363 of the connector 360 to which the cable 19*b* is coupled. Therefore, it is possible to reduce the problem in that short-circuit occurs because the floating ink adheres to the cable 19*b* and the terminal 363 of the connector 360 to which the cable 19*b* is coupled. That is, to problem is reduced in that abnormality occurs in the power voltage used for the print head 21 to perform the self-diagnosis. Accordingly, the power voltage is stably supplied to the print head 21. Therefore, it is possible for the print head 21 to perform the self-diagnosis at a stable state.

In addition, the print head control circuit 15 used for the liquid discharge apparatus 1 according to the first embodiment includes the cable 19*b* for propagating the high voltage signal VHV and the low voltage signal VDD, and the cable 19*a* for propagating the diagnosis signals DIG1 to DIG4. Furthermore, the shortest distance between the contact section 180*b*-14, at which the wiring 197*b*-14 for propagating the high voltage signal VHV, the wiring 197*b*-14 being included in the cable 19*b*, is in contact with the terminal 363-14 of the print head 21, and the nozzle plate 632 is longer than the shortest distance between the contact section 180*a*-4, at which the wiring 197*a*-4 for propagating the diagnosis signal DIG1, the wiring 197*a*-4 being included in the cable 19*a*, is in contact with the terminal 353-4 of the print head 21, and the nozzle plate 632. In other words, the contact section 180*a*-4, which outputs the diagnosis signal DIG1 from the print head control circuit 15, is located in a location to which the ink floating on the inside of the liquid discharge apparatus 1 easily adheres, rather than the contact section 180*b*-14 which outputs the high voltage signal VHV from the print head control circuit 15. Furthermore, when the ink floating on the inside of the liquid discharge apparatus 1 adheres to the contact section 180*a*-4 and thus short-circuit occurs between the contact section 180*a*-4 and a different contact section 180, the distortion occurs in the waveform of the diagnosis signal DIG1 supplied from the print head 21. Furthermore, the print head 21 performs the self-diagnoses of whether or not there is a problem in that the discharge accuracy of the ink is deteriorated due to influence of the floating ink by detecting the distortion of the waveforms of the diagnosis signal DIG1.

Furthermore, in the print head control circuit 15 used for the liquid discharge apparatus 1 according to the first embodiment, the contact sections 180*b*-14 and 180*b*-23, from which the high voltage signal VHV or the low voltage signal VDD is output, are located in locations to which it is difficult for the ink floating on the inside of the liquid discharge apparatus 1 to adhere. Therefore, a problem is reduced in that the floating ink adheres to the contact sections 180*b*-14 and 180*b*-23 from which the high voltage signal VHV and the low voltage signal VDD function as the power voltage of the print head 21 are output. Therefore, it is possible to reduce the problem in that short-circuit occurs because the floating ink adheres to the contact sections 180*b*-14 and 180*b*-23 from which the high voltage signal VHV and the low voltage signal VDD are output. That is, a problem is reduced in that abnormality occurs in the power voltage used for the print head 21 to perform the self-diagnosis. Accordingly, the power voltage is stably supplied to the print head 21. Therefore, it is possible for the print head 21 to perform the self-diagnosis at the stable state.

2 Second Embodiment

Subsequently, a liquid discharge apparatus 1 and a print head control circuit 15 of a second embodiment will be described. Meanwhile, when the liquid discharge apparatus 1 and the print head control circuit 15 of the second embodiment are described, the same reference symbols are attached to the components which are the same as in the first embodiment, and description thereof will not be repeated or simplified. In addition, the print head control circuit 15 of the second embodiment is different from that of the first embodiment in a fact that the print head control circuit 15 is electrically coupled to the print head 21 through four cables 19.

Figure 19:
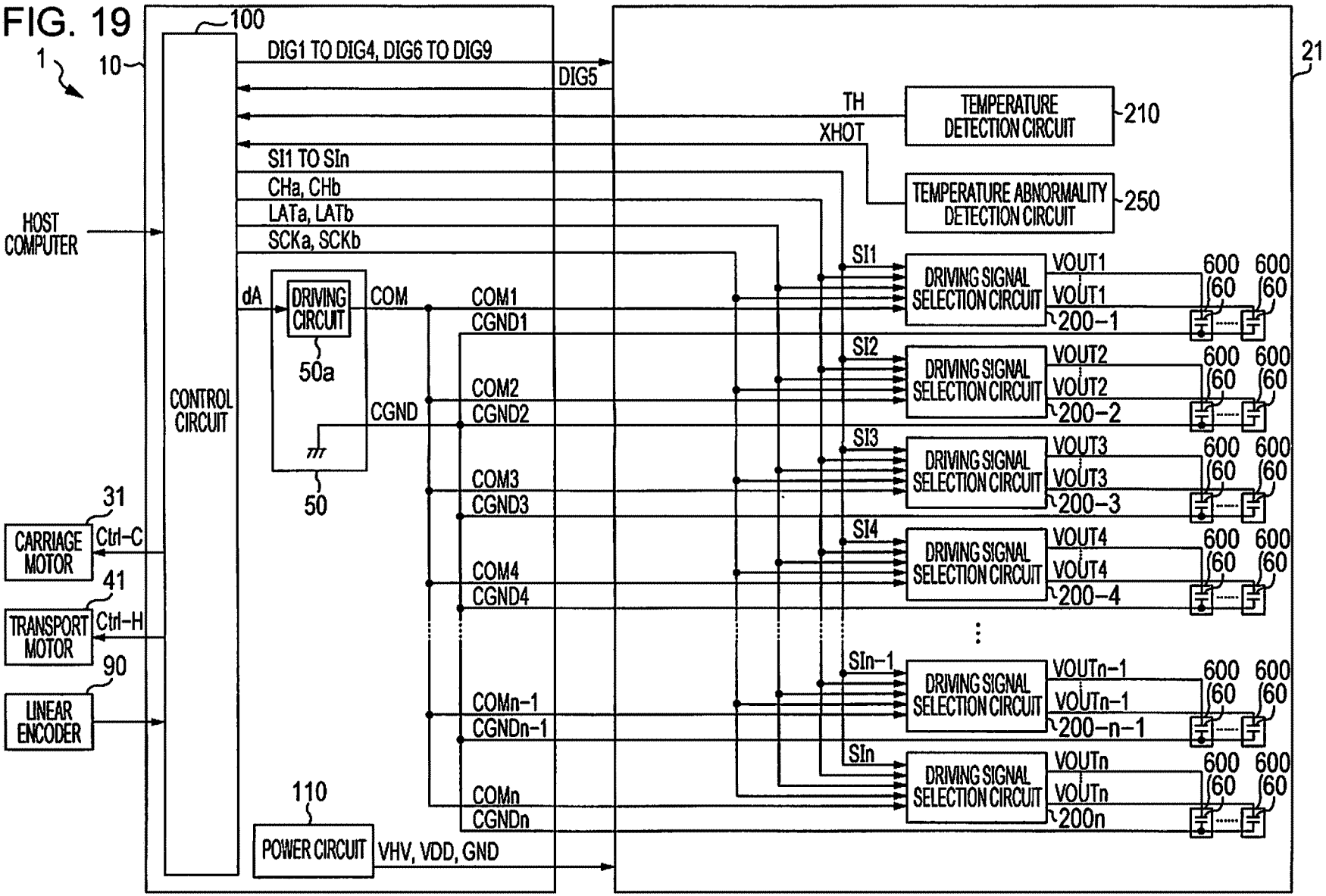
FIG. 19 is a block diagram illustrating an electrical configuration of a liquid discharge apparatus according to a second embodiment.

FIG. 19 is a block diagram illustrating an electrical configuration of the liquid discharge apparatus 1 according to the second embodiment. As illustrated in FIG. 19, a control circuit 100 of the second embodiment outputs two latch signals LATa and LATb for prescribing discharge timing of the print head 21, two change signals CHa and CHb for prescribing switching timing of the waveform of the driving signal COM, and two clock signals SCKa and SCKb for inputting a print data signal SI to the print head 21.

The change signals CHa and CHb, the latch signals LATa and LATb, and the clock signals SCKa and SCKb, which are output from the control circuit 100, are input to a driving signal selection circuit 200. Specifically, the change signal CHa, the latch signal LATa, and the clock signal SCKa are input to any of n number of driving signal selection circuits 200. In addition, the change signal CHb, the latch signal LATb, and the clock signal SCKb are input to any of different n number of driving signal selection circuits 200. Furthermore, the driving signal selection circuit 200 generates driving signals VOUT1 to VOUTn based on any of the print data signals SI1 to SIn, one of the change signals CHa and CHb, one of the latch signals LATa and LATb, and one of the clock signals SCKa and SCKb. Here, the two latch signals LATa and LATb, the two change signals CHa and CHb, and the two clock signals SCKa and SCKb are signals functioning as signals for performing the self-diagnosis of the print head 21.

Description will be performed while it is assumed that the print head 21 of the second embodiment includes 10 number of driving signal selection circuits 200-1 to 200-10. Therefore, 10 number of print data signals SI1 to SI10 corresponding to the 10 number of respective driving signal selection circuits 200-1 to 200-10, 10 number of driving signals COM1 to COM10, and 10 number of reference voltage signals CGND1 to CGND10 are input to the print head 21 of the second embodiment.

Figure 20:
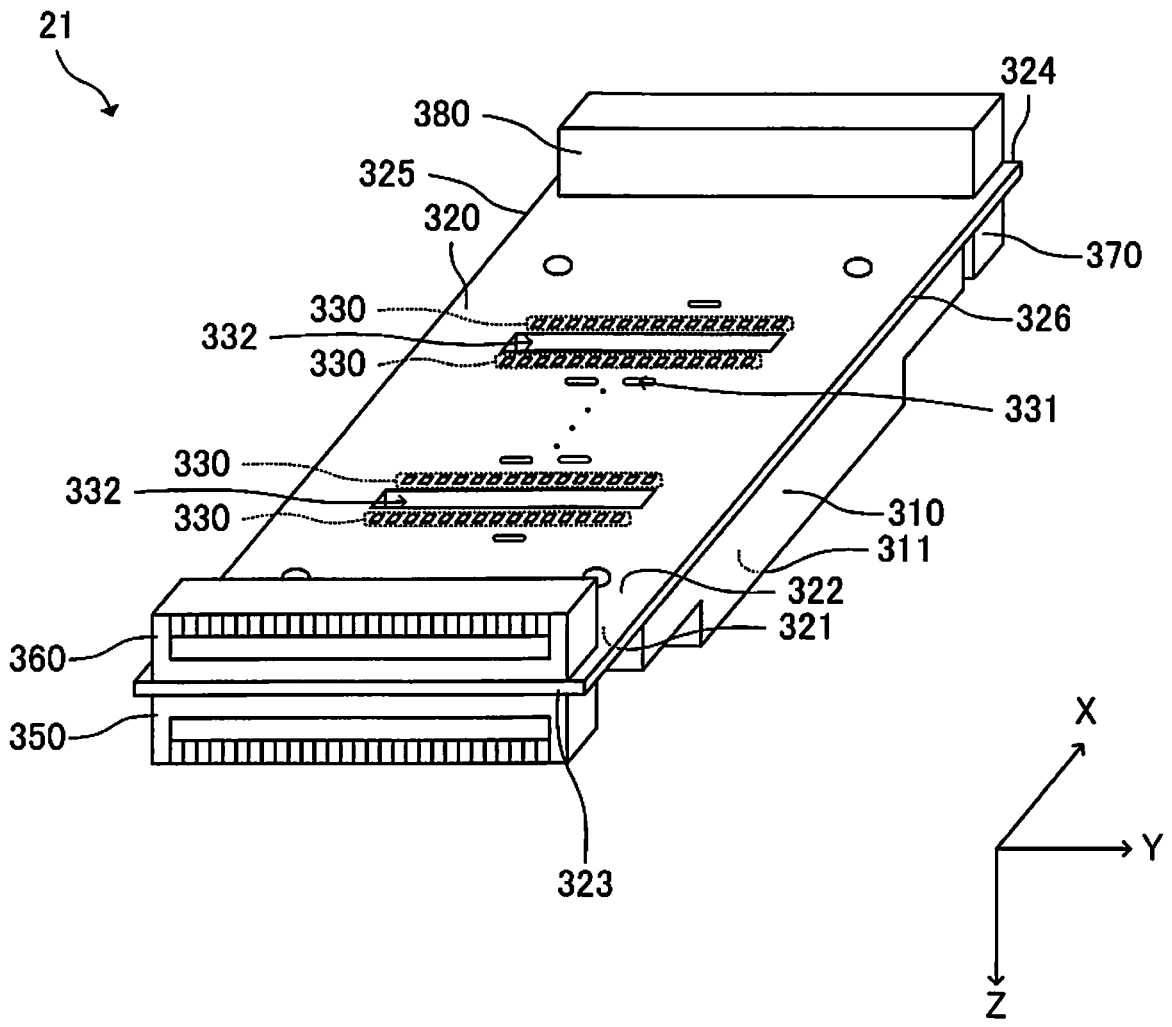
FIG. 20 is a perspective diagram illustrating a configuration of a print head according to the second embodiment.

FIG. 20 is a perspective diagram illustrating a configuration of the print head 21 of the second embodiment. As illustrated in FIG. 20, the print head 21 includes a head 310 and a substrate 320. The substrate 320 includes a surface 321 and a surface 322 which faces the surface 321, and has a substantially rectangular shape formed with a side 323, a side 324 which faces the side 323 in an X direction, a side 325, and a side 326 which faces the side 325 in a Y direction.

Connectors 350, 360, 370, and 380 are provided in the substrate 320. The connector 350 is provided on a side of the surface 321 of the substrate 320 along the side 323. In addition, the connector 360 is provided on a side of the surface 322 of the substrate 320 along the side 323. Here, the connector 350 and the connector 360 of the second embodiment are different from those of the first embodiment in a fact that the number of a plurality of terminals included in the connector 350 and the connector 360 is 20, and other configurations are the same as in FIG. 13. Therefore, detailed description for the connector 350 and the connector 360 of the second embodiment will not be repeated. Meanwhile, there is a case where 20 number of terminals 353, which are provided in parallel in the connector 350 of the second embodiment, are sequentially referred to as terminals 353-1, 353-2, . . . , 353-20 toward the side 325 from the side 326 in a direction along the side 323. In the same manner, there is a case where 20 number of terminals 363, which are provided in parallel in the connector 360 of the second embodiment, are sequentially referred to as terminals 363-1, 363-2, . . . , 363-20 toward the side 326 from the side 325 in the direction along the side 323.

Figure 21:
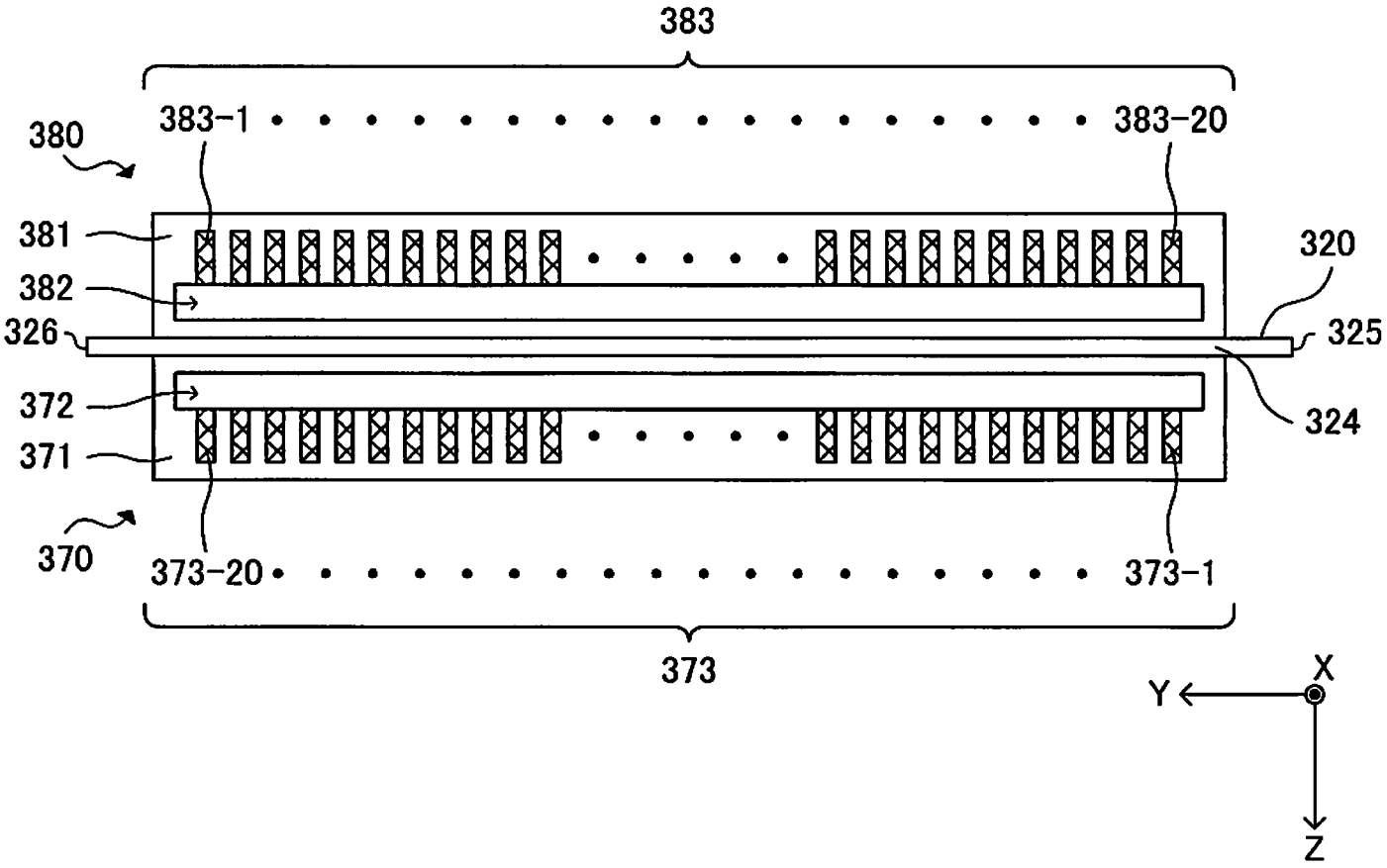
FIG. 21 is a diagram illustrating configurations of connectors.

Subsequently, configurations of the connectors 370 and 380 will be described with reference to FIG. 21. FIG. 21 is a diagram illustrating the configurations of the connectors 370 and 380. The connector 370 is provided on the side of the surface 321 of the substrate 320 along the side 324. In addition, the connector 380 is provided on the side of the surface 322 of the substrate 320 along the side 324.

The connector 370 has a housing 371, a cable attachment section 372, and a plurality of terminals 373. A cable 19 for electrically coupling the control mechanism 10 to the print head 21 is attached to the cable attachment section 372. The plurality of terminals 373 are provided in parallel along the side 324. Furthermore, when the cable 19 is attached to the cable attachment section 372, the plurality of respective terminals included in the cable 19 are electrically coupled to the plurality of respective terminals 373 included in the connector 370. Therefore, various signals output from the control mechanism 10 are input to the print head 21. Meanwhile, in the second embodiment, description is performed while it is assumed that 20 number of terminals 373 are provided in parallel along the side 324 in the connector 370. Here, there is a case where the 20 number of terminals 373 provided in parallel are sequentially referred to as terminals 373-1, 373-2, . . . , 373-20 toward a side of the side 326 from a side of the side 325 in a direction along the side 324.

The connector 380 includes a housing 381, a cable attachment section 382, and a plurality of terminals 383. A cable 19 for electrically coupling the control mechanism 10 to the print head 21 is attached to the cable attachment section 382. The plurality of terminals 383 are provided in parallel along the side 324. Furthermore, when the cable 19 is attached to the cable attachment section 382, the plurality of respective terminals included in the cable 19 are electrically coupled to the plurality of respective terminals 383 included in the connector 380. Therefore, the various signals output from the control mechanism 10 are input to the print head 21. Meanwhile, in the second embodiment, description is performed while it is assumed that 20 number of terminals 383 are provided in parallel along the side 324 in the connector 380. Here, there is a case where the 20 number of terminals 383 provided in parallel are sequentially referred to as terminals 383-1, 383-2, . . . , 383-20 toward the side of the side 325 from the side of the side 326 in the direction along the side 324.

Figure 22:
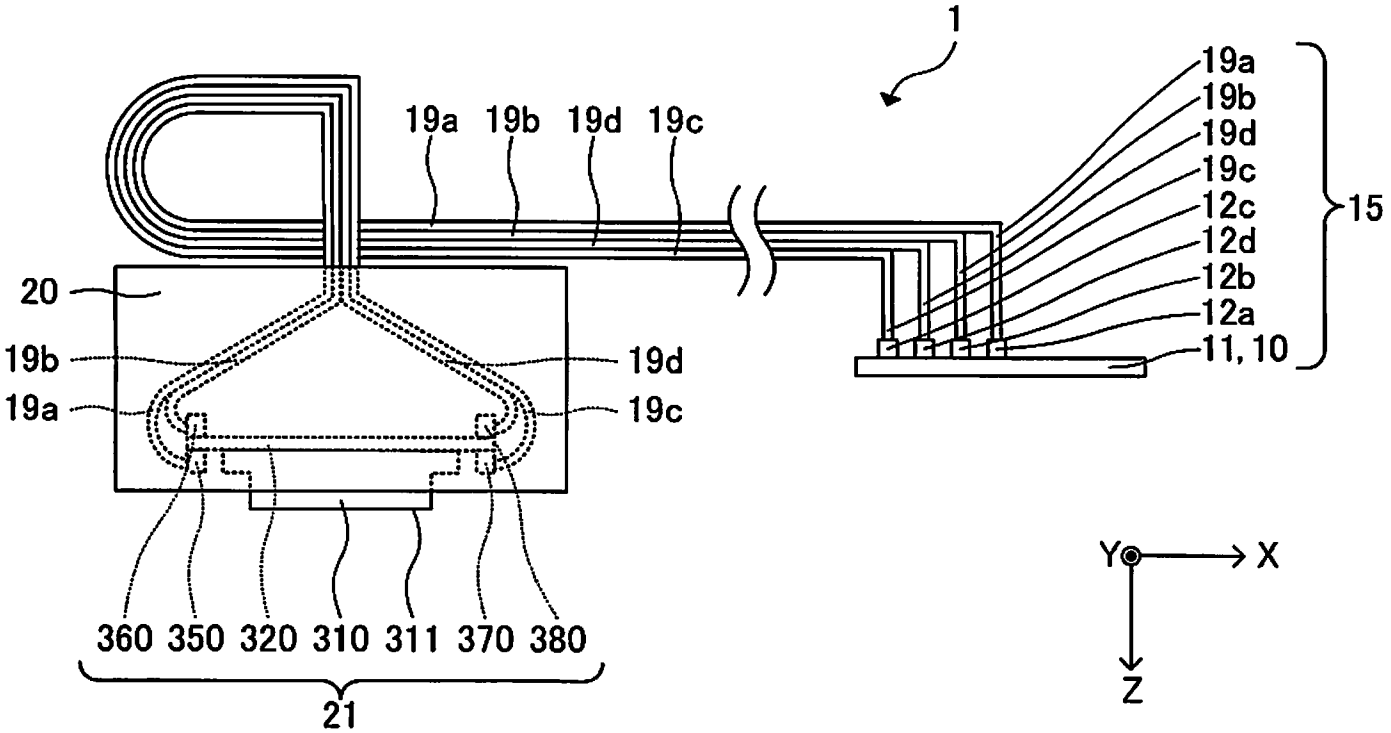
FIG. 22 is a diagram schematically illustrating an inner configuration when the liquid discharge apparatus according to the second embodiment is viewed from a Y direction.

FIG. 22 is a diagram schematically illustrating an inner configuration when the liquid discharge apparatus 1 according to the second embodiment is viewed from the Y direction. As illustrated in FIG. 22, the liquid discharge apparatus 1 includes a main substrate 11, cables 19*a*, 19*b*, 19*c*, and 19*d*, and the print head 21.

Various circuits, which include the driving signal output circuit 50, included in the control mechanism 10 illustrated in FIGS. 1 and 19, and the control circuit 100, are mounted in the main substrate 11. In addition, connectors 12*a*, 12*b*, 12*c*, and 12*d* are mounted in the main substrate 11. One end of the cable 19*a* is attached to the connector 12*a*, one end of the cable 19*b* is attached to the connector 12*b*, one end of the cable 19*c* is attached to the connector 12*c*, and one end of the cable 19*d* is attached to the connector 12*d*.

The print head 21 includes the head 310, the substrate 320, and the connectors 350, 360, 370, and 380. Another end of the cable 19*a* is attached to the connector 350, another end of the cable 19*b* is attached to the connector 360, another end of the cable 19*c* is attached to the connector 370, and another end of the cable 19*d* is attached to the connector 380. That is, the cable 19*a* is attached to the connector 350 provided on the surface 321, on which the head 310 is provided, in the substrate 320 of the print head 21, and the cable 19*b* is attached to the connector 360 provided on the surface 322, on which the head 310 is not provided, in the substrate 320 of the print head 21. In other words, a shortest distance between the nozzle plate 632 of the head 310 and the cable 19*b* is longer than a shortest distance between the nozzle plate 632 and the cable 19*a*. In addition, the cable 19*c* is attached to the connector 370 provided on the surface 321, on which the head 310 is provided, in the substrate 320 of the print head 21, and the cable 19*d* is attached to the connector 380 provided on the surface 322, on which the head 310 is not provided, in the substrate 320 of the print head 21. In other words, a shortest distance between the nozzle plate 632 of the head 310 and the cable 19*d* is longer than a shortest distance between the nozzle plate 632 and the cable 19*c*.

The liquid discharge apparatus 1, which is formed as above, outputs the various signals, which includes the driving signals COM1 to COM10, the reference voltage signals CGND1 to CGND10, the print data signals SI1 to SI10, the latch signals LATa and LATb, the change signals CHa and CHb, the clock signals SCKa and SCKb, and the diagnosis signals DIG1 to DIG5, from the control mechanism 10 mounted in the main substrate 11, and controls an operation of the print head 21 based on the signals. That is, a configuration, which includes the control mechanism 10 included in the liquid discharge apparatus 1 and the cables 19*a*, 19*b*, 19*c*, and 19*d*, is an example of the print head control circuit 15 which controls the operation of the print head 21 having the self-diagnoses function of the second embodiment.

Subsequently, details of the signals which are propagated through the respective cables 19*a*, 19*b*, 19*c*, and 19*d* will be described with reference to FIGS. 23 to 26. Meanwhile, in the description with reference to FIGS. 23 to 26, the terminal 195-*k* (k is any of 1 to 20) provided in each of the cables 19*a*, 19*b*, 19*c*, and 19*d* is referred to as terminals 195*a*-*k*, 195*b*-*k*, 195*c*-*k*, and 195*d*-*k*, the terminal 196-*k* is referred to as terminals 196*a*-*k*, 196*b*-*k*, 196*c*-*k*, and 196*d*-*k*, the wiring 197-*k* is referred to as wirings 197*a*-*k*, 197*b*-*k*, 197*c*-*k*, and 197*d*-*k*, and the contact section 180-*k* is referred to as contact sections 180*a*-*k*, 180*b*-*k*, 180*c*-*k*, and 180*d*-*k*.

FIG. 23 is a diagram illustrating details of the signals propagated through the cable 19*a*. As illustrated in FIG. 23, the cable 19*a* includes a plurality of wirings for propagating the print data signal SI1, the change signal CHa, the latch signal LATa, the clock signal SCKa, and the temperature signal TH, a plurality of wirings for propagating the diagnosis signals DIG1 to DIG4, a plurality of wirings for propagating the plurality of ground signals GND, a plurality of wirings for propagating the driving signals COM1 to COM5, and a plurality of wirings for propagating the reference voltage signals CGND1 to CGND5.

The print data signal SI1, the change signal CHa, the latch signal LATa, the clock signal SCKa, the temperature signal TH, the diagnosis signals DIG1 to DIG4, and the plurality of ground signals GND are propagated through the wirings 197*a*-1 to 197*a*-10, and are output through the contact sections 180*a*-1 to 180*a*-10. In addition, the driving signals COM1 to COM5 and the reference voltage signals CGND1 to CGND5 are propagated through the wirings 197*a*-11 to 197*a*-20, and are output through the contact sections 180*a*-11 to 180*a*-20.

That is, in the cable 19*a*, the voltage signal of the low voltage is propagated through a wiring located on a side of a long side 193, and the voltage signal of the high voltage is propagated through a wiring located on a side of a long side 194. Therefore, in the cable 19*a*, the wiring through which the voltage signal of the low voltage is propagated and the wiring through which the voltage signal of the high voltage is propagated are separately located. Therefore, it is possible to reduce the problem in that the voltage signal of the high voltage interferes in the voltage signal of the low voltage, which is propagated through the cable 19*a*.

In addition, in the print head control circuit 15, the voltage signal of the low voltage is output from the contact section located on the side of the long side 193, and the voltage signal of the high voltage is output from the contact section located on the side of the long side 194. Therefore, in the print head control circuit 15, the contact section, from which the voltage signal of the low voltage is output, and the contact section, from which the voltage signal of the high voltage is output, are separately located. Therefore, the problem is reduced in that the voltage signal of the high voltage interferes in the voltage signal of the low voltage, which is output from the print head control circuit 15.

In addition, as illustrated in FIG. 23, the wiring 197*a*-4 functions as the wiring for propagating the diagnosis signal DIG1 and the wiring for propagating the latch signal LATa for prescribing the ink discharge timing. In addition, the wiring 197*a*-8 functions as the wiring for propagating the diagnosis signal DIG2 and the wiring for propagating the change signal CHa for prescribing switching timing of the waveform of the driving signal COM. In addition, the wiring 197*a*-10 functions as the wiring for propagating the diagnosis signal DIG3, and the wiring for propagating the print data signal SI1 for prescribing the selection of the waveform of the driving signal COM. In addition, the wiring 197*a*-6 functions as the wiring for propagating the diagnosis signal DIG4, and the wiring for propagating the clock signal SCKa. Therefore, it is possible to diagnose a connection state of the wirings, through which the print data signal SI1, the change signal CHa, the latch signal LATa, and the clock signal SCKa are propagated, based on a result of the self-diagnosis of the print head 21. Furthermore, since the plurality of signals are propagated through one wiring, it is possible to reduce the number of wirings to be provided in the cable 19*a*.

Furthermore, as illustrated in FIG. 23, it is preferable that each of the wirings, through which the ground signals GND is propagated, is located between the wirings through which the respective diagnosis signals DIG1 to DIG4 are propagated. Therefore, it is possible to reduce the problem in that the propagated diagnosis signals DIG1 to DIG4 interfere in each other.

Subsequently, details of signals propagated through the cable 19*b* will be described with reference to FIG. 24. FIG. 24 is a diagram illustrating details of the signals propagated through the cable 19*b*. As illustrated in FIG. 24, the cable 19*b* includes a plurality of wirings for propagating the driving signals COM1 to COM5, a plurality of wirings for propagating the reference voltage signals CGND1 to CGND5, a plurality of wirings for propagating the print data signals SI2 to SI5, a wiring for propagating the low voltage signal VDD, and a plurality of wirings for propagating the plurality of ground signals GND.

The driving signals COM1 to COM5 and the reference voltage signals CGND1 to CGND6 are propagated through the wirings 197*b*-1 to 197*b*-10, and are output through the contact sections 180*b*-1 to 180*b*-10. In addition, the print data signals SI2 to SI5, the low voltage signal VDD, and the plurality of ground signals GND are propagated through the wirings 197*b*-11 to 197*b*-20, and are output through the contact sections 180*b*-11 to 180*b*-20.

That is, in the cable 19*b*, the voltage signal of the high voltage is propagated through the wiring on the side of the long side 193, and the voltage signal of the low voltage is propagated through the wiring on the side of the long side 194. Therefore, in the cable 19*b*, the wiring through which the voltage signal of the low voltage is propagated and the wiring through which the voltage signal of the high voltage is propagated are separately located. Therefore, the problem is reduced in that the voltage signal of the high voltage interferes in the voltage signal of the low voltage, which is propagated through the cable 19*b*.

In addition, in the print head control circuit 15, the voltage signal of the high voltage is output from the contact section located on the side of the long side 193, the voltage signal of the low voltage is output from the contact section located on the side of the long side 194. Therefore, in the cable 19*b*, the contact section, from which the voltage signal of the low voltage is output, and the contact section, from which the voltage signal of the high voltage is output, are separately located. Therefore, the problem is reduced that the voltage signal of the high voltage interferes in the voltage signal of the low voltage, which is output from the print head control circuit 15.

FIG. 25 is a diagram illustrating details of signals which are propagated through the cable 19*c* according to the second embodiment. As illustrated in FIG. 25, the cable 19*c* includes a plurality of wirings for propagating the print data signal SI10, the change signal CHb, the latch signal LATb, the clock signal SCKb, and the abnormality signal XHOT, a plurality of wirings for propagating the diagnosis signal DIG5 to DIG9, a plurality of wirings for propagating the ground signals GND, a plurality of wirings for propagating the driving signals COM6 to COM10, and a plurality of wirings for propagating the reference voltage signal CGND6 to CGND10.

The driving signals COM6 to COM10 and the reference voltage signal CGND6 to CGND10 are propagated through the wirings 197*c*-1 to 197*c*-10, and are output from the contact sections 180*c*-1 to 180*c*-10. In addition, the print data signal SI10, the change signal CHb, the latch signal LATb, the clock signal SCKb, the abnormality signal XHOT, the diagnosis signals DIG5 to DIG9, and the plurality of ground signals GND are propagated through the wirings 197*c*-11 to 197*c*-20, and are output from the contact sections 180*c*-11 to 180*c*-20.

That is, in the cable 19*c*, the voltage signal of the high voltage is propagated through the wiring located on the side of the long side 193, and the voltage signal of the low voltage is propagated through the wiring located on the side of the long side 194. Therefore, in the cable 19*c*, the wiring through which the voltage signal of the low voltage is propagated and the wiring through which the voltage signal of the high voltage is propagated are separately located. Therefore, the problem in that the voltage signal of the high voltage interferes in the voltage signal of the low voltage propagated through the cable 19*c*.

In addition, in the print head control circuit 15, the voltage signal of the high voltage is output from the contact section located on the side of the long side 193, and the voltage signal of the low voltage is output from the contact section located on the side of the long side 194. Therefore, in the print head control circuit 15, the contact section, from which the voltage signal of the low voltage is output, and the contact section, from which the voltage signal of the high voltage is output, are separately located. Therefore, the problem in that the voltage signal of the high voltage interferes in the voltage signal of the low voltage, which is output from the print head control circuit 15.

In addition, as illustrated in FIG. 25, the wiring 197*c*-12 functions as the wiring for propagating the diagnosis signal DIG5 and the wiring for propagating the abnormality signal XHOT for indicating the existence/non-existence of the temperature abnormality of the print head 21. In addition, the wiring 197*c*-14 functions as the wiring for propagating the diagnosis signal DIG6 and the wiring for propagating the latch signal LATb for prescribing the ink discharge timing. In addition, the wiring 197*c*-18 functions as the wiring for propagating the diagnosis signal DIG7 and the wiring for propagating the change signal CHb for prescribing the timing at which the waveform of the driving signal COM is switched. In addition, the wiring 197*c*-20 functions as the wiring for propagating the diagnosis signal DIG8 and the wiring for propagating the print data signal SI10 for prescribing the selection of the waveform of the driving signal COM. In addition, the wiring 197*c*-16 functions as the wiring for propagating the diagnosis signal DIG9 and the wiring for propagating the clock signal SCKb. Therefore, it is possible to diagnose the connection state of the wirings, through which the print data signal SI10, the change signal CHb, the latch signal LATb, the clock signal SCKb, and the abnormality signal XHOT are propagated, based on the result of the self-diagnosis of the print head 21. Furthermore, since the plurality of signals are propagated through one wiring, it is possible to reduce the number of wirings to be provided in the cable 19*a*.

Furthermore, as illustrated in FIG. 25, it is preferable that the wiring through which the ground signal GND is propagated is located between the wirings through which the diagnosis signals DIG5 to DIG9 are propagated, respectively. Therefore, it is possible to reduce the problem in that the propagated diagnosis signals DIG5 to DIG9 interfere in each other.

Subsequently, details of signals propagated through the cable 19*d* will be described with reference to FIG. 26. FIG. 26 is a diagram illustrating the details of the signals propagated through the cable 19*d*. As illustrated in FIG. 26, the cable 19*d* includes a plurality of wirings for propagating the print data signals SI6 to SI9, a plurality of wirings for propagating the plurality of ground signals GND, a wiring for propagating the high voltage signal VHV, a plurality of wirings for propagating the driving signals COM6 to COM10, and a plurality of wirings for propagating the reference voltage signal CGND6 to CGND10.

The print data signals SI6 to SI9 and the plurality of ground signals GND are propagated through the wirings 197*d*-1 to 197*d*-9, and are output through the contact sections 180*d*-1 to 180*d*-9. In addition, the driving signals COM6 to COM10 and the reference voltage signals CGND6 to CGND10 are propagated through the wirings 197*d*-11 to 197*d*-20, and are output through the contact sections 180*d*-11 to 180*d*-20.

That is, in the cable 19*d*, the signal of the high voltage is propagated through the wiring located on the side of the long side 193, the signal of the low voltage is propagated through the wiring located on the side of the long side 194. In addition, the high voltage signal VHV is propagated through the wiring 197*b*-10 located between the wiring through which the signal of the high voltage is propagated and the wiring through which the signal of the low voltage is propagated. In the cable 19*d*, which is formed as above, the wiring through which the signal of the high voltage is propagated and the wiring through which the signal of the low voltage is propagated are separately located, and thus the problem is reduced in that the signal of the high voltage interferes in the signal of the low voltage, which is propagated through the cable 19*d*. Furthermore, the wiring 197*d*-10 through which the high voltage signal VHV is propagated is located between the wirings through which the driving signals COM6 to COM10 are propagated and the wirings through which the print data signal SI6 to SI9 are propagated, and thus the wiring 197*d*-10 functions as a shield wiring for reducing mutual interference which occurs between the wirings through which the driving signals COM6 to COM10 are propagated and the wirings through which the print data signal SI6 to SI9 are propagated. Therefore, it is possible to further reduce the problem in that the voltage signal of the high voltage interferes in the voltage signal of the low voltage, which is propagated through the cable 19*d*.

In addition, in the print head control circuit 15, the signal of the high voltage is output from the contact section located on the side of the long side 193, and the signal of the low voltage is output from the contact section located on the side of the long side 194. In addition, the high voltage signal VHV is output from the contact section 180*b*-10 located between the contact section, from which the signal of the high voltage is output, and the contact section from which the signal of the low voltage is output. In the cable 19*d*, which is formed as above, the contact section, from which the signal of the high voltage is output, and the contact section, from which the signal of the low voltage is output, are separately located, and thus the problem is reduced in that the signal of the high voltage interferes in the signal of the low voltage, which is propagated through the cable 19*d*. Furthermore, the contact section 180*d*-10, from which the high voltage signal VHV is output, is located between the contact sections, through which the driving signals COM6 to COM10 are output, and the contact section through which the print data signals SI6 to SI9 are output, and thus the contact section 180*d*-10 functions as a shield for reducing the mutual interference which occurs between the contact sections, from which the driving signals COM6 to COM10 are output, and the contact sections from which the print data signals SI6 to SI9 are output. Therefore, it is possible to further reduce the problem in that the voltage signal of the high voltage interferes in the voltage signal of the low voltage, which is output from the print head control circuit 15.

Here, the high voltage signal VHV is an example of a first power voltage signal of the second embodiment, and the wiring 197*d*-10 for propagating the high voltage signal VHV is an example of a first power voltage signal propagation wiring of the second embodiment. Furthermore, the cable 19*d* including the wiring 197*d*-10 is an example of a first cable of the second embodiment.

In addition, the diagnosis signal DIG6 is an example of a first diagnosis signal of the second embodiment, the diagnosis signal DIG7 is an example of a second diagnosis signal of the second embodiment, the diagnosis signal DIG8 is an example of a third diagnosis signal of the second embodiment, the diagnosis signal DIG9 is an example of a fourth diagnosis signal of the second embodiment, and the diagnosis signal DIG5 is an example of a fifth diagnosis signal of the second embodiment. In addition, the wiring 197*c*-14 for propagating the diagnosis signal DIG6 is an example of a first diagnosis signal propagation wiring of the second embodiment, the wiring 197*c*-18 for propagating the diagnosis signal DIG7 is an example of a second diagnosis signal propagation wiring of the second embodiment, the wiring 197*c*-20 for propagating the diagnosis signal DIG8 is an example of a third diagnosis signal propagation wiring of the second embodiment, the wiring 197*c*-16 for propagating the diagnosis signal DIG5 is an example of a fourth diagnosis signal propagation wiring of the second embodiment, the wiring 197*c*-12 for propagating the diagnosis signal DIG5 is an example of a fifth diagnosis signal propagation wiring of the second embodiment. In addition, any of the wirings 197*c*-2, 197*c*-4, 197*c*-6, 197*c*-8, and 197*c*-10 for propagating the driving signal COM is an example of a driving signal propagation wiring of the second embodiment. In addition, the wirings 197*c*-15, 197*c*-17, and 197*c*-19 for propagating the ground signal are examples of a ground signal propagation wiring. Furthermore, the cable 19*c*, which includes the wirings 197*c*-14, 197*c*-18, 197*c*-20, 197*c*-16, and 197*c*-12, the wirings 197*c*-2, 197-4, 197*c*-6, 197*c*-8, and 197*c*-10, and the wirings 197*c*-15, 197*c*-17, and 197*c*-19, is an example of a second cable of the second embodiment.

In addition, the low voltage signal VDD is an example of a second power voltage signal of the second embodiment, the wiring 197*b*-20 for propagating the low voltage signal VDD is an example of a second power voltage signal propagation wiring. Furthermore, the cable 19*b*, which includes the wiring 197*b*-20, is an example of a third cable of the second embodiment.

In addition, the diagnosis signal DIG1 is an example of a sixth diagnosis signal of the second embodiment, the diagnosis signal DIG2 is an example of a seventh diagnosis signal of the second embodiment, the diagnosis signal DIG3 is an example of an eighth diagnosis signal of the second embodiment, the diagnosis signal DIG4 is an example of a ninth diagnosis signal of the second embodiment. In addition, the wiring 197*a*-4 for propagating the diagnosis signal DIG1 is an example of a sixth diagnosis signal propagation wiring of the second embodiment, the wiring 197*a*-8 for propagating the diagnosis signal DIG2 is an example of a seventh diagnosis signal propagation wiring of the second embodiment, the wiring 197*a*-10 for propagating the diagnosis signal DIG3 is an example of an eighth diagnosis signal propagation wiring of the second embodiment, the wiring 197*a*-6 for propagating the diagnosis signal DIG4 is an example of a ninth diagnosis signal propagation wiring of the second embodiment. Furthermore, the cable 19*a*, which includes the wirings 197*a*-4, 197*a*-8, 197*a*-10, and 197*a*-6, is an example of a fourth cable of the second embodiment.

When the cables 19*a*, 19*b*, 19*c*, and 19*d* are electrically coupled to the connectors 350, 360, 370, and 380, the print head control circuit 15 supplies the various signals generated in the control mechanism 10 to the print head 21.

Specifically, the cable 19*a* is electrically coupled to the connector 350 provided on the surface 321 which is a surface on a side of the ink discharge surface 311, on which the nozzle plate 632 is provided, in the print head 21 of the substrate 320. Specifically, the diagnosis signal DIG1 output from the control circuit 100 is propagated through the wiring 197*a*-4, and is input to the print head 21 through the terminal 196*a*-4, the contact section 180*a*-4, and the terminal 353-4. In addition, the diagnosis signal DIG2 is propagated through the wiring 197*a*-8, and is input to the print head 21 through the terminal 196*a*-8, the contact section 180*a*-8, and the terminal 353-8. In addition, the diagnosis signal DIG3 is propagated through the wiring 197*a*-10, and is input to the print head 21 through the terminal 196*a*-10, the contact section 180*a*-10, and the terminal 353-10. In addition, the diagnosis signal DIG4 is propagated through the wiring 197*a*-6, and is input to the print head 21 through the terminal 196*a*-6, the contact section 180*a*-6, and the terminal 353-6.

In addition, the cable 19*b* is electrically coupled to the connector 360 provided on the surface 322 of the substrate 320. Furthermore, the signals output from the control mechanism 10 are supplied to the terminal 195*b*-*k* and are propagated through the wiring 197*b*-*k*, and, thereafter, the signals are supplied to the print head 21 through the terminal 196*b*-*k*, the contact section 180*b*-*k*, and the terminal 363-*k* included in the connector 360.

In addition, the cable 19*c* is electrically coupled to the connector 370 provided on the surface 321, which is the surface on the side of the ink discharge surface 311, on which the nozzle plate 632 is provided, in the print head 21 of the substrate 320. Specifically, the diagnosis signal DIG6 output from the control circuit 100 is propagated through the wiring 197*c*-14, and is input to the print head 21 through the terminal 196*c*-14, the contact section 180*c*-14, and the terminal 373-14. In addition, diagnosis signal DIG7 is propagated through the wiring 197*c*-18, and is input to the print head 21 through the terminal 196*c*-18, the contact section 180*c*-18, and the terminal 373-18. In addition, the diagnosis signal DIG8 is propagated through the wiring 197*c*-20, and is input to the print head 21 through the terminal 196*c*-20, the contact section 180*c*-20, and the terminal 373-20. In addition, the diagnosis signal DIG9 is propagated through the wiring 197*c*-16, and is input to the print head 21 through the terminal 196*c*-16, the contact section 180*c*-16, and the terminal 373-16. In addition, the diagnosis signal DIG5 is supplied from the print head 21 to the terminal 373-12, and is propagated through the wiring 197*c*-12 through the contact section 180*c*-12 and the terminal 196*c*-12.

In addition, the cable 19*d* is electrically coupled to the connector 380 provided on the surface 322 of the substrate 320. Furthermore, the signals output from the control mechanism 10 are supplied to the terminal 195*d*-*k* and are propagated through the wiring 197*d*-*k*, and, thereafter, the signals are supplied to the print head 21 through the terminal 196*d*-*k*, the contact section 180*c*-*k*, and the terminal 383-*k* included in the connector 380.

Here, the terminal 373-14, to which the diagnosis signal DIG6 is input, is an example of a first coupling point of the second embodiment. In addition, the terminal 373-18, to which the diagnosis signal DIG7 is input, is an example of a second coupling point of the second embodiment. In addition, the terminal 373-20, to which the diagnosis signal DIG8 is input, is an example of a third coupling point of the second embodiment. In addition, the terminal 373-16, to which the diagnosis signal DIG9 is input, is an example of a fourth coupling point of the second embodiment. In addition, the terminal 373-12, to which the diagnosis signal DIG5 is input, is an example of a fifth coupling point of the second embodiment. In addition, the terminal 353-4, to which the diagnosis signal DIG1 is input, is an example of a sixth coupling point of the second embodiment. In addition, the terminal 353-8, to which the diagnosis signal DIG2 is input, is an example of a seventh coupling point of the second embodiment. In addition, the terminal 353-10, to which the diagnosis signal DIG3 is input, is an example of an eighth coupling point of the second embodiment. In addition, the terminal 353-6, to which the diagnosis signal DIG4 is input, is an example of a ninth coupling point of the second embodiment. In addition, the terminal 383-10, to which the high voltage signal VHV is input, is an example of a tenth coupling point of the second embodiment. In addition, any of the terminals 373-2, 373-4, 373-6, 373-8, and 373-10, to which the driving signal COM is input, is an example of a eleventh coupling point. In addition, the terminal 363-20, to which the low voltage signal VDD is input, is an example of a twelfth coupling point of the second embodiment. In addition, the terminals 373-15, 373-17, and 373-19, to which the ground signal is input, are examples of a ground coupling point of the second embodiment.

Furthermore, the contact section 180*c*-10, at which the terminal 373-14 is in electrical contact with the terminal 196*c*-14 of the cable 19*c*, is an example of a first contact section of the second embodiment. In addition, the contact section 180*c*-18, at which the terminal 373-18 is in electrical contact with the terminal 196*c*-18 of the cable 19*c*, is an example of a second contact section of the second embodiment. In addition, the contact section 180*c*-20, at which the terminal 373-20 is in electrical contact with the terminal 196*c*-20 of the cable 19*c*, is an example of a third contact section of the second embodiment. In addition, the contact section 180*c*-16, at which the terminal 373-16 is in electrical contact with the terminal 196*c*-16 of the cable 19*c*, is an example of a fourth contact section of the second embodiment. In addition, the contact section 180*a*-4, at which the terminal 353-4 is in electrical contact with the terminal 196*a*-4 of the cable 19*a*, is an example of a sixth contact section of the second embodiment. In addition, the contact section 180*a*-8, at which the terminal 353-8 is in electrical contact with the terminal 196*a*-8 of the cable 19*a*, is an example of a seventh contact section of the second embodiment. In addition, the contact section 180*a*-10, at which the terminal 353-10 is in electrical contact with the terminal 196*a*-10 of the cable 19*a*, is an example of an eighth contact section of the second embodiment. In addition, the contact section 180*a*-6, at which the terminal 353-6 is in electrical contact with the terminal 196*a*-6 of the cable 19*a*, is an example of a ninth contact section of the second embodiment. In addition, the contact section 180*d*-10, at which the terminal 383-10 is in electrical contact with the terminal 196*d*-10 of the cable 19*d*, is an example of a tenth contact section of the second embodiment. In addition, any of the contact sections 180*c*-2, 180*c*-4, 180*c*-6, 180*c*-8, and 180*c*-10, at which the respective terminals 373-2, 373-4, 373-6, 373-8, and 373-10 are in electrical contact with the respective terminals 196*c*-2, 196*c*-4, 196*c*-6, 196*c*-8, and 196*c*-10 of the cable 19*c*, is an example of an eleventh contact section of the second embodiment. In addition, the contact section 180*b*-20, at which the terminal 363-20 is in electrical contact with the terminal 196*b*-20 of the cable 19*b*, is an example of a twelfth contact section of the second embodiment. In addition, any of the contact sections 180*c*-15, 180*c*-17, and 180*c*-19, at which the respective terminals 373-15, 373-17, and 373-19 are in electrical contact with the respective terminals 196*c*-15, 196*c*-17, and 196*c*-19 of the cable 19*c*, is an example of a ground contact section of the second embodiment.

As above, the cable 19*a* is coupled to the connector 350 provided on the surface 321 of the substrate 320 that is the surface on the side of the ink discharge surface 311, on which the nozzle plate 632 of the print head 21 is provided, and the cable 19*b* is coupled to the connector 360 provided on the surface 322 of the substrate 320 of the print head 21. In addition, the cable 19*c* is coupled to the connector 370 provided on the surface 321 of the substrate 320 that is the surface of the side of the ink discharge surface 311, on which the nozzle plate 632 of the print head 21 is provided, and the cable 19*d* is coupled to the connector 380 provided on the surface 322 of the substrate 320 of the print head 21.

That is, the cables 19*a*, 19*b*, 19*c*, and 19*d* is provided such that a shortest distance between the nozzle plate 632 and the cable 19*b* is longer than a shortest distance between the nozzle plate 632 and the cable 19*a* and a shortest distance between the nozzle plate 632 and the cable 19*d* is longer than a shortest distance between the nozzle plate 632 and the cable 19*c*. In other words, the shortest distance between the contact section 180*d*-10, at which the wiring 197*d*-10 through which the high voltage signal VHV is propagated is in contact with the terminal 383-10 of the connector 380, and the nozzle plate 632 is longer than the shortest distance between the contact section 180*c*-14, at which the wiring 197*c*-14 through which the diagnosis signal DIG6 is propagated is in contact with the terminal 373-14 of the connector 370, and the nozzle plate 632, and the shortest distance between the contact section 180*b*-20, at which the wiring 197*b*-20 through which the low voltage signal VDD is propagated is in contact with the terminal 363-20 of the connector 360, and the nozzle plate 632 is longer than the shortest distance between the contact section 180*a*-4, at which the wiring 197*a*-4 through which the diagnosis signal DIG1 is propagated is in contact with the terminal 353-4 of the connector 350, and the nozzle plate 632.

In the liquid discharge apparatus 1 and the print head control circuit 15, which are formed as above, according to the second embodiment, the print head 21 includes four connectors 350, 360, 370, and 380. Therefore, even when a large number of signals are input, it is possible to acquire the same advantages as in the first embodiment by forming the cables 19*a*, 19*b*, 19*c*, and 19*d* as described above.

3 Modified Example

In the above-described liquid discharge apparatus 1, the driving signal output circuit 50 may include two driving circuits 50*a* and 50*b* which generate driving signals COMA and COMB having different waveforms.

Furthermore, for example, the driving signal COMA may be a waveform acquired by succeeding two waveforms which causes an intermediate amount of ink to be discharged from the nozzle 651, and the driving signal COMB may be a waveform acquired by a waveform which causes a small amount of ink to be discharged from the nozzle 651 and a waveform which causes a vicinity of an opening section of the nozzle 651 to slightly vibrate. In this case, a driving signal selection circuit 200 may select any of the waveforms included in the driving signal COMA and any of the waveforms included in the driving signal COMB at a cycle Ta, and may output the selected trapezoid waveform as a driving signal VOUT.

That is, when the driving signal selection circuit 200 selects and combines a plurality of waveforms included in each of the two driving signals COMA and COMB, the driving signal selection circuit 200 may generate and output the driving signal VOUT. Therefore, the number of combinations of the waveforms, which are capable of being output as the driving signal VOUT, increases without making the cycle Ta long. Therefore, it is possible to increase a range of selection of a dot size of the ink which is discharged to the medium P. Accordingly, it is possible to increase grayscale of the dots formed on the medium P by the liquid discharge apparatus 1. That is, it is possible to improve print accuracy of the liquid discharge apparatus 1.

In addition, when the driving signal output circuit 50 includes the two driving circuits 50*a* and 50*b* which generate the driving signals COMA and COMB of different waveforms, for example, the driving signal COMA may be a waveform acquired by succeeding a waveform which causes an intermediate amount of ink to be discharged from the nozzle 651, a waveform which causes a small amount of ink to be discharged from the nozzle 651, and a waveform which causes a vicinity of an opening section of the nozzle 651 to slightly vibrate, and the driving signal COMB may be a waveform, which is different from the waveform included in the driving signal COMA, and which is acquired by succeeding the waveform which causes an intermediate amount of ink to be discharged from the nozzle 651, the waveform which causes a small amount of ink to be discharged from the nozzle 651, and the waveform which causes the vicinity of the opening section of the nozzle 651 to slightly vibrate. Furthermore, the driving signal COMA and the driving signal COMB are input to the driving signal selection circuits 200 which respectively correspond to different nozzle columns. Therefore, it is possible to supply the optimal driving signal VOUT to each individual nozzle column with respect to a case where the ink of different characteristics is supplied to each nozzle column formed in the print head 21 or a difference in a shape of the channel to which the ink is supplied. Therefore, it is possible to reduce dispersion of the dot size for each nozzle column, and it is possible to improve the print accuracy of the liquid discharge apparatus 1.

Hereinabove, the embodiments and the modified example are described. The present disclosure is not limited to the embodiments and the modified example, and various forms are possible in a scope without departing from the gist of the present disclosure. For example, it is possible to appropriately combine the above-described embodiments.

In addition, the present disclosure includes a configuration (for example, a configuration in which a function, a method, and a result are the same or a configuration in which an object and effects are the same) which is substantially the same as the configuration described in the embodiments and the modified example. In addition, the present disclosure includes a configuration in which a non-essential part of the configuration described in the embodiments and the modified example is replaced. In addition, the present disclosure includes a configuration which accomplishes the same effects as the configuration described in the embodiments and the modified example, or a configuration in which it is possible to accomplish the same object. In addition, the present disclosure includes a configuration in which a well-known technology is added to the configuration described in the embodiments and the modified example.

What is claimed is:

1. A print head control circuit, which controls an operation of a print head that includes a nozzle plate having a nozzle for discharging liquid based on a driving signal, a first coupling point, a second coupling point, a third coupling point, and a fourth coupling point, and that has a self-diagnosis function performed based on signals input from the first coupling point, the second coupling point, the third coupling point, and the fourth coupling point, the print head control circuit comprising:

a first cable that includes a first power voltage signal propagation wiring for propagating a first power voltage signal;

a second cable that includes a first diagnosis signal propagation wiring for propagating a first diagnosis signal input to the first coupling point, a second diagnosis signal propagation wiring for propagating a second diagnosis signal input to the second coupling point, a third diagnosis signal propagation wiring for propagating a third diagnosis signal input to the third coupling point, a fourth diagnosis signal propagation wiring for propagating a fourth diagnosis signal input to the fourth coupling point, a driving signal propagation wiring for propagating the driving signal, and a plurality of ground signal propagation wirings for propagating a voltage signal with a ground potential, the plurality of ground signal propagation wirings including at least a first ground signal propagation wiring, a second ground signal propagation wiring, and a third ground signal propagation wiring;

a diagnosis signal output circuit that outputs the first diagnosis signal, the second diagnosis signal, the third diagnosis signal, and the fourth diagnosis signal; and a driving signal output circuit that outputs the driving signal, wherein a shortest distance between the nozzle plate and the first cable is longer than a shortest distance between the nozzle plate and the second cable, in the second cable, the driving signal propagation wiring is not located between the first diagnosis signal propagation wiring and the second diagnosis signal propagation wiring, between the second diagnosis signal propagation wiring and the third diagnosis signal propagation wiring, between the third diagnosis signal propagation wiring and the fourth diagnosis signal propagation wiring, and between the fourth diagnosis signal propagation wiring and the first diagnosis signal propagation wiring, and in the second cable, the first diagnosis signal propagation wiring, the first ground signal propagation wiring, the fourth diagnosis signal propagation wiring, the second ground signal propagation wiring, the second diagnosis signal propagation wiring, the third ground signal propagation wiring, and the third diagnosis signal propagation wiring are arranged in an order of the first diagnosis signal propagation wiring, the first ground signal propagation wiring, the fourth diagnosis signal propagation wiring, the second ground signal propagation wiring, the second diagnosis signal propagation wiring, the third ground signal propagation wiring, and the third diagnosis signal propagation wiring.

2. The print head control circuit according to claim 1, wherein the print head further includes a sixth coupling point, a seventh coupling point, an eighth coupling point, and a ninth coupling point, and further has a self-diagnosis function performed based on signals input from the sixth coupling point, the seventh coupling point, the eighth coupling point, and the ninth coupling point, the print head control circuit further comprises a third cable that includes a second power voltage signal propagation wiring for propagating a second power voltage signal; and a fourth cable that includes a sixth diagnosis signal propagation wiring for propagating a sixth diagnosis signal input to the sixth coupling point, a seventh diagnosis signal propagation wiring for propagating a seventh diagnosis signal input to the seventh coupling point, an eighth diagnosis signal propagation wiring for propagating an eighth diagnosis signal input to the eighth coupling point, and a ninth diagnosis signal propagation wiring for propagating a ninth diagnosis signal input to the ninth coupling point; and a shortest distance between the nozzle plate and the third cable is longer than a shortest distance between the nozzle plate and the fourth cable.

3. The print head control circuit according to claim 1, wherein the first diagnosis signal propagation wiring functions as a wiring for propagating a signal for prescribing a discharge timing of the liquid.

4. The print head control circuit according to claim 1, wherein the second diagnosis signal propagation wiring functions as a wiring for propagating a signal for prescribing a waveform switching timing of the driving signal.

5. The print head control circuit according to claim 1, wherein the third diagnosis signal propagation wiring functions as a wiring for propagating a signal for prescribing selection of a waveform of the driving signal.

6. The print head control circuit according to claim 1, wherein the fourth diagnosis signal propagation wiring functions as a wiring for propagating a clock signal.

7. The print head control circuit according to claim 1, wherein the print head further includes a fifth coupling point, and the second cable further includes a fifth diagnosis signal propagation wiring for propagating a fifth diagnosis signal which is output from the fifth coupling point and which indicates a result of self-diagnosis of the print head.

8. The print head control circuit according to claim 7, wherein the fifth diagnosis signal propagation wiring functions as a wiring for propagating a signal which indicates existence/non-existence of temperature abnormality of the print head.

9. A print head control circuit, which controls an operation of a print head that includes a nozzle plate having a nozzle for discharging liquid based on a driving signal, a first coupling point, a second coupling point, a third coupling point, a fourth coupling point, a tenth coupling point, an eleventh coupling point, and a plurality of ground coupling points including at least a first ground coupling point, a second ground coupling point, and a third ground coupling points, and that has a self-diagnosis function performed based on signals input from the first coupling point, the second coupling point, the third coupling point, and the fourth coupling point, the print head control circuit comprising:

a first cable that includes a first power voltage signal propagation wiring for propagating a first power voltage signal input to the tenth coupling point;

a second cable that includes a first diagnosis signal propagation wiring for propagating a first diagnosis signal input to the first coupling point, a second diagnosis signal propagation wiring for propagating a second diagnosis signal input to the second coupling point, a third diagnosis signal propagation wiring for propagating a third diagnosis signal input to the third coupling point, a fourth diagnosis signal propagation wiring for propagating a fourth diagnosis signal input to the fourth coupling point, a driving signal propagation wiring for propagating the driving signal input to the eleventh coupling point, and a plurality of ground signal propagation wirings for propagating a voltage signal with a ground potential, the plurality of ground signal propagation wirings including at least a first ground signal propagation wiring, a second ground signal propagation wiring, and a third ground signal propagation wiring;

a diagnosis signal output circuit that outputs the first diagnosis signal, the second diagnosis signal, the third diagnosis signal, and the fourth diagnosis signal; and a driving signal output circuit that outputs the driving signal, wherein the first diagnosis signal propagation wiring is in electrical contact with the first coupling point at a first contact section, the second diagnosis signal propagation wiring is in electrical contact with the second coupling point at a second contact section, the third diagnosis signal propagation wiring is in electrical contact with the third coupling point at a third contact section, the fourth diagnosis signal propagation wiring is in electrical contact with the fourth coupling point at a fourth contact section, the driving signal propagation wiring is in electrical contact with the eleventh coupling point at an eleventh contact section, the first ground signal propagation wiring is in electrical contact with the first ground coupling point at a first ground contact section, the second ground signal propagation wiring is in electrical contact with the second ground coupling point at a second ground contact section, the third ground signal propagation wiring is in electrical contact with the third ground coupling point at a third ground contact section, the first power voltage signal propagation wiring is in electrical contact with the tenth coupling point at a tenth contact section, and a shortest distance between the tenth contact section and the nozzle plate is longer than a shortest distance between the first contact section and the nozzle plate, the eleventh contact section is not located between the first contact section and the second contact section, between the second contact section and the third contact section, between the third contact section and the fourth contact section, and between the fourth contact section and the first contact section, and the first contact section, the first ground contact section, the fourth contact section, the second ground contact section, the second contact section, the third ground contact section, and the third contact section are arranged in an order of the first contact section, the first ground contact section, the fourth contact section, the second ground contact section, the second contact section, the third ground contact section, and the third contact section.

10. The print head control circuit according to claim 9, wherein the print head further includes a sixth coupling point, a seventh coupling point, an eighth coupling point, a ninth coupling point, and a twelfth coupling point, and further has a self-diagnosis function performed based on signals input from the sixth coupling point, the seventh coupling point, the eighth coupling point, and the ninth coupling point, the print head control circuit further comprises a third cable that includes a second power voltage signal propagation wiring for propagating a second power voltage signal input to the twelfth coupling point, and a fourth cable that includes a sixth diagnosis signal propagation wiring for propagating a sixth diagnosis signal input to the sixth coupling point, a seventh diagnosis signal propagation wiring for propagating a seventh diagnosis signal input to the seventh coupling point, an eighth diagnosis signal propagation wiring for propagating an eighth diagnosis signal input to the eighth coupling point, and a ninth diagnosis signal propagation wiring for propagating a ninth diagnosis signal input to the ninth coupling point, the sixth diagnosis signal propagation wiring is in electrical contact with the sixth coupling point at a sixth contact section, the seventh diagnosis signal propagation wiring is in electrical contact with the seventh coupling point at a seventh contact section, the eighth diagnosis signal propagation wiring is in electrical contact with the eighth coupling point at an eighth contact section, the ninth diagnosis signal propagation wiring is in electrical contact with the ninth coupling point at a ninth contact section, the second power voltage signal propagation wiring is in electrical contact with the twelfth coupling point at a twelfth contact section, and a shortest distance between the twelfth contact section and the nozzle plate is longer than a shortest distance between the sixth contact section and the nozzle plate.

11. A liquid discharge apparatus comprising:

a print head that includes a nozzle plate having a nozzle for discharging liquid based on a driving signal, a first coupling point, a second coupling point, a third coupling point, and a fourth coupling point, and that has a self-diagnosis function performed based on signals input from the first coupling point, the second coupling point, the third coupling point, and the fourth coupling point; and a print head control circuit that controls an operation of the print head, wherein the print head control circuit includes a first cable that includes a first power voltage signal propagation wiring for propagating a first power voltage signal, a second cable that includes a first diagnosis signal propagation wiring for propagating a first diagnosis signal input to the first coupling point, a second diagnosis signal propagation wiring for propagating a second diagnosis signal input to the second coupling point, a third diagnosis signal propagation wiring for propagating a third diagnosis signal input to the third coupling point, a fourth diagnosis signal propagation wiring for propagating a fourth diagnosis signal input to the fourth coupling point, a driving signal propagation wiring for propagating the driving signal, and a plurality of ground signal propagation wirings for propagating a voltage signal with a ground potential, the plurality of ground signal propagation wirings including at least a first ground signal propagation wiring, a second ground signal propagation wiring, and a third ground signal propagation wiring, a diagnosis signal output circuit that outputs the first diagnosis signal, the second diagnosis signal, the third diagnosis signal, and the fourth diagnosis signal, and a driving signal output circuit that outputs the driving signal, and a shortest distance between the nozzle plate and the first cable is longer than a shortest distance between the nozzle plate and the second cable, in the second cable, the driving signal propagation wiring is not located between the first diagnosis signal propagation wiring and the second diagnosis signal propagation wiring, between the second diagnosis signal propagation wiring and the third diagnosis signal propagation wiring, between the third diagnosis signal propagation wiring and the fourth diagnosis signal propagation wiring, and between the fourth diagnosis signal propagation wiring and the first diagnosis signal propagation wiring, and in the second cable, the first diagnosis signal propagation wiring, the first ground signal propagation wiring, the fourth diagnosis signal propagation wiring, the second ground signal propagation wiring, the second diagnosis signal propagation wiring, the third ground signal propagation wiring, and the third diagnosis signal propagation wiring are arranged in an order of the first diagnosis signal propagation wiring, the first ground signal propagation wiring, the fourth diagnosis signal propagation wiring, the second ground signal propagation wiring, the second diagnosis signal propagation wiring, the third ground signal propagation wiring, and the third diagnosis signal propagation wiring.

12. The liquid discharge apparatus according to claim 11, wherein the print head further includes a sixth coupling point, a seventh coupling point, an eighth coupling point, and a ninth coupling point, and further has a self-diagnosis function performed based on signals input from the sixth coupling point, the seventh coupling point, the eighth coupling point, and the ninth coupling point, the print head control circuit further includes a third cable that includes a second power voltage signal propagation wiring for propagating a second power voltage signal, and a fourth cable that includes a sixth diagnosis signal propagation wiring for propagating a sixth diagnosis signal input to the sixth coupling point, a seventh diagnosis signal propagation wiring for propagating a seventh diagnosis signal input to the seventh coupling point, an eighth diagnosis signal propagation wiring for propagating an eighth diagnosis signal input to the eighth coupling point, and a ninth diagnosis signal propagation wiring for propagating a ninth diagnosis signal input to the ninth coupling point, and a shortest distance between the nozzle plate and the third cable is longer than a shortest distance between the nozzle plate and the fourth cable.

13. The liquid discharge apparatus according to claim 11, wherein the first diagnosis signal propagation wiring functions as a wiring for propagating a signal for prescribing a discharge timing of the liquid.

14. The liquid discharge apparatus according to claim 11, wherein the second diagnosis signal propagation wiring functions as a wiring for propagating a signal for prescribing a waveform switching timing of the driving signal.

15. The liquid discharge apparatus according to claim 11, wherein the third diagnosis signal propagation wiring functions as a wiring for propagating a signal for prescribing selection of a waveform of the driving signal.

16. The liquid discharge apparatus according to claim 11, wherein the fourth diagnosis signal propagation wiring functions as a wiring for propagating a clock signal.

17. The liquid discharge apparatus according to claim 11, wherein the print head further includes a fifth coupling point, and the second cable further includes a fifth diagnosis signal propagation wiring for propagating a fifth diagnosis signal which is output from the fifth coupling point and which indicates a result of self-diagnosis of the print head.

18. The liquid discharge apparatus according to claim 17, wherein the fifth diagnosis signal propagation wiring functions as a wiring for propagating a signal which indicates existence/non-existence of temperature abnormality of the print head.

19. A liquid discharge apparatus comprising:

a print head that includes a nozzle plate having a nozzle for discharging liquid based on a driving signal, a first coupling point, a second coupling point, a third coupling point, a fourth coupling point, a tenth coupling point, an eleventh coupling point, and a plurality of ground coupling points including at least a first ground coupling point, a second ground coupling point, and a third ground coupling points, and that has a self-diagnosis function performed based on signals input from the first coupling point, the second coupling point, the third coupling point, and the fourth coupling point; and a print head control circuit that controls an operation of the print head, wherein the print head control circuit includes a first cable that includes a first power voltage signal propagation wiring for propagating a first power voltage signal input to the tenth coupling point, a second cable that includes a first diagnosis signal propagation wiring for propagating a first diagnosis signal input to the first coupling point, a second diagnosis signal propagation wiring for propagating a second diagnosis signal input to the second coupling point, a third diagnosis signal propagation wiring for propagating a third diagnosis signal input to the third coupling point, a fourth diagnosis signal propagation wiring for propagating a fourth diagnosis signal input to the fourth coupling point, a driving signal propagation wiring for propagating the driving signal input to the eleventh coupling point, and a plurality of ground signal propagation wirings for propagating a voltage signal with a ground potential, the plurality of ground signal propagation wirings including at least a first ground signal propagation wiring, a second ground signal propagation wiring, and a third ground signal propagation wiring, a diagnosis signal output circuit that outputs the first diagnosis signal, the second diagnosis signal, the third diagnosis signal, and the fourth diagnosis signal, and a driving signal output circuit that outputs the driving signal, the first diagnosis signal propagation wiring is in electrical contact with the first coupling point at a first contact section, the second diagnosis signal propagation wiring is in electrical contact with the second coupling point at a second contact section, the third diagnosis signal propagation wiring is in electrical contact with the third coupling point at a third contact section, the fourth diagnosis signal propagation wiring is in electrical contact with the fourth coupling point at a fourth contact section, the driving signal propagation wiring is in electrical contact with the eleventh coupling point at an eleventh contact section, the first ground signal propagation wiring is in electrical contact with the first ground coupling point at a first ground contact section, the second ground signal propagation wiring is in electrical contact with the second ground coupling point at a second ground contact section, the third ground signal propagation wiring is in electrical contact with the third ground coupling point at a third ground contact section, the first power voltage signal propagation wiring is in electrical contact with the tenth coupling point at a tenth contact section, and a shortest distance between the tenth contact section and the nozzle plate is longer than a shortest distance between the first contact section and the nozzle plate, the eleventh contact section is not located between the first contact section and the second contact section, between the second contact section and the third contact section, between the third contact section and the fourth contact section, and between the fourth contact section and the first contact section, and the first contact section, the first ground contact section, the fourth contact section, the second ground contact section, the second contact section, the third ground contact section, and the third contact section are arranged in an order of the first contact section, the first ground contact section, the fourth contact section, the second ground contact section, the second contact section, the third ground contact section, and the third contact section.

20. The liquid discharge apparatus according to claim 19, wherein the print head further includes a sixth coupling point, a seventh coupling point, an eighth coupling point, a ninth coupling point, and a twelfth coupling point, and has a self-diagnosis function performed based on signals input from the sixth coupling point, the seventh coupling point, the eighth coupling point, and the ninth coupling point, the print head control circuit further includes a third cable that includes a second power voltage signal propagation wiring for propagating a second power voltage signal input to the twelfth coupling point, and a fourth cable that includes a sixth diagnosis signal propagation wiring for propagating a sixth diagnosis signal input to the sixth coupling point, a seventh diagnosis signal propagation wiring for propagating a seventh diagnosis signal input to the seventh coupling point, an eighth diagnosis signal propagation wiring for propagating an eighth diagnosis signal input to the eighth coupling point, and a ninth diagnosis signal propagation wiring for propagating a ninth diagnosis signal input to the ninth coupling point, the sixth diagnosis signal propagation wiring is in electrical contact with the sixth coupling point at a sixth contact section, the seventh diagnosis signal propagation wiring is in electrical contact with the seventh coupling point at a seventh contact section, the eighth diagnosis signal propagation wiring is in electrical contact with the eighth coupling point at an eighth contact section, the ninth diagnosis signal propagation wiring is in electrical contact with the ninth coupling point at a ninth contact section, the second power voltage signal propagation wiring is in electrical contact with the twelfth coupling point at a twelfth contact section, and a shortest distance between the twelfth contact section and the nozzle plate is longer than a shortest distance between the sixth contact section and the nozzle plate.

* * * * *